US006899326B2

(12) United States Patent
Kawakami et al.

(10) Patent No.: US 6,899,326 B2
(45) Date of Patent: May 31, 2005

(54) SHEET FEEDER AND RECORDING APPARATUS INCORPORATING THE SAME

(75) Inventors: Kazuhisa Kawakami, Nagano (JP); Masaki Shimomura, Nagano (JP); Takuya Yasue, Nagano (JP); Toru Fukushima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 10/402,134

(22) Filed: Mar. 31, 2003

(65) Prior Publication Data

US 2004/0017037 A1 Jan. 29, 2004

(30) Foreign Application Priority Data

Mar. 29, 2002 (JP) ..... P2002-095180
Jul. 15, 2002 (JP) ..... P2002-206110
Aug. 23, 2002 (JP) ..... P2002-244169

(51) Int. Cl.[7] ..... B41J 2/65
(52) U.S. Cl. ..... 271/114
(58) Field of Search ..... 271/114

(56) References Cited

U.S. PATENT DOCUMENTS 4,991,828 A * 2/1991 Mizoguchi ..... 271/3.2
6,196,653 B1 3/2001 Igarashi et al.
2004/0061278 A1 * 4/2004 Nakano ..... 271/114

FOREIGN PATENT DOCUMENTS

EP 0 482 356 A2 4/1992
JP 10-329965 12/1998

* cited by examiner

*Primary Examiner*—Donald P. Walsh
*Assistant Examiner*—Kenneth W Bower
(74) *Attorney, Agent, or Firm*—Sughrue Mion, PLLC

(57) ABSTRACT

A first non-recording region is situated in one of both outer sides of a recording region in a main scanning direction of recording. A second non-recording region is situated in the other one of the both sides of the recording region. A power source provides a driving force. A driving gear is interconnected with the power source. A transmission gear is operable to be coupled with the driving gear to transmit the driving force to a rotatable member. An actuator is operable to move in the main scanning direction. A first trigger is disposed in the first non-recording region. A second trigger is disposed in the second non-recording region. A clutch is interconnected with the trigger so as to couple the driving gear and the transmission gear when the one of the first trigger and the second trigger is actuated by the actuator.

14 Claims, 42 Drawing Sheets

SHEET FEEDER AND RECORDING APPARATUS INCORPORATING THE SAME

BACKGROUND OF THE INVENTION

The present invention relates to a recording apparatus, such as an ink jet printer, which includes a drive gear coupled to a power source, a transmission gear for transmitting power to other rotary members, and a clutch device for selecting permission or prohibition of power transmission between the drive gear and the transmission gear. The invention also relates to a sheet feeder for feeding printing sheets incorporated in such a recording apparatus.

In the specification, the "recording apparatus" includes a recording apparatus, such a printer, a copying machine and a facsimile, in which an ink jet recording head is used, and the recording head which ejects ink to a recording medium to perform recording, and also includes a liquid jetting apparatus in which a liquid jetting head corresponding to the recording head which ejects liquid, instead of the ink, selected for its use to a medium corresponding to the recording medium, whereby the liquid sticks to the medium.

Examples of the liquid jetting heads are the recording head mentioned above, a coloring material jetting head used for manufacturing color filters in use for a liquid crystal display or the like, an electrode material (conductive paste) jetting head used for forming electrodes of an organic EL (electro luminescence) display, a field emission display (FED) and the like, an organic material jetting head used for manufacturing biological biochips, and a sample jetting head as a micro pipette.

One kind of the recording apparatus is an ink jet printer (referred to as a "printer"). Some types of printers are each provided with an auto sheet feeder (ASF) for feeding a recording sheet which is one kind of the recording medium, toward an ink jet recording head. The sheet feeder includes a feeding roller for feeding recording sheets. It is a common practice that for the purpose of cost reduction, a drive source for the feeding roller is also used for a drive source for a transporting roller for transporting the recording sheets to the ink jet recording head. In the description to follow, the recording sheet will be used as a typical example of the recording medium. Accordingly, "feeding", "feeder", and "feeding roller" will be referred frequently to as "sheet feeding", "sheet feeder", and "sheet feeding roller", respectively.

When power is transmitted from a drive motor as the drive source to the transporting roller and the sheet feeding roller, for example, when the recording sheet is transported by the transporting roller, it is necessary to stop the rotation of the sheet feeding roller. Further, it is necessary to forwardly and reversely rotate the transporting roller. In this respect, as disclosed in Japanese Patent Publication No. 10-329965A, a clutch device is provided which selects permission or prohibition of power transmission from the drive motor to the sheet feeding roller.

A trigger for selecting the permission or prohibition of power transmission by the clutch device is normally at one end of the main scan direction of a carriage, viz., one end of the main body of the printer as horizontally viewed. The carriage is moved to a position of the trigger located at one end of the scanning path of the carriage, and pressed against the trigger, whereby the clutch device is readily operated.

Since the trigger is provided at only one end of the scanning path of the carriage, when the carriage is positioned at the other end of the scanning path at the end of the recording operation and just before the clutch device is subjected to the selection of the permission or prohibition of power transmission, the carriage must be moved to the position of the trigger over substantially the entire recording region in order to actuate the clutch device. Thus, the carriage consumes time only for traversing the recording region. This time consumption hinders improvement of the throughput from the sheet feeding to the sheet discharging in the recording operation by the printer.

In a technique that the carriage per se engages with a part of the clutch device through the scanning movement to thereby select the permission or prohibition of power transmission to the sheet feeding roller (in other words, the carriage per se serves as a trigger). Sometimes, a position of the carriage when the permission of actual power transmission is switched to its prohibition or permission somewhat varies depending on the dimensional or assembling accuracy of the components.

Upon start of rotation of the sheet feeding roller, various sheet feeding operations are performed during a period of one rotation of the sheet feeding roller. For example, after the sheet feeding roller is rotated by a predetermined angle, the ascending operation of the hopper starts. After the sheet feeding roller is further rotated by a predetermined angle, for example, a retracting operation of a sheet returning lever for returning multi-feeding print sheets to the upstream side is performed. Thus, operation timing charts of components forming the sheet feeder are determined with respect to a rotation start point of the sheet feeding roller. A sequence of sheet feed controls are executed according to the timing charts.

As described above, a position of the carriage when the permission of actual power transmission is switched to its prohibition or permission, varies depending on the dimensional or assembling accuracy of the components. Accordingly, the rotation start point of the sheet feeding roller on which the operation timings determination is based is different for each printer, and hence, exact sheet feed controls are not secured.

SUMMARY OF THE INVENTION

It is therefore an object of the present invention to provide a recording apparatus in which the carriage can reach the trigger for a relatively short time even when the carriage is at any position in order to attain a high throughput of the recording process.

It is also an object of the invention is to provide exact sheet feeding controls in a sheet feeder which controls the sheet feeding operation based on the rotation start point of the sheet feeding roller which starts its rotation when the clutch device permits the power transmission.

In order to achieve the above objects, according to the invention, there is provided a recording apparatus, comprising:

a recording region;

a first non-recording region, situated in one of both outer sides of the recording region in a main scanning direction of recording;

a second non-recording region, situated in the other one of the both sides of the recording region;

a power source, which provides a driving force;

a driving gear, interconnected with the power source;

a transmission gear, operable to be coupled with the driving gear to transmit the driving force to a rotatable member;

an actuator, operable to move in the main scanning direction;

a first trigger, disposed in the first non-recording region;

a second trigger, disposed in the second non-recording region; and a clutch, interconnected with the trigger so as to couple the driving gear and the transmission gear when the one of the first trigger and the second trigger is actuated by the actuator.

In such a configuration, in comparison with a related-art configuration where the trigger is provided to one end side alone, the maximum distance needed for the actuator to reach the trigger is reduced by half. It is thus possible to obtain a recording apparatus capable of activating the rotating body (e.g., gears) quickly.

Here, it is preferable that: the rotatable member is a medium feeding roller which feeds a recording medium to the recording region; the driving gear is a ratchet gear; the clutch comprises a clutcher, formed with a tooth and an engagement portion, the clutcher held by the transmission gear so as to be pivotable between a first position where the tooth is engaged with the ratchet gear and a second position where the tooth is disengaged from the ratchet gear; the transmission gear rotates with the clutcher when the clutcher is placed in the first position, so that the driving force is transmitted to the medium feeding roller; and the clutch comprises a clutch lever, operable to engage with the engagement portion of the clutcher, and to place the clutcher in the second position when the clutch lever engages with the engagement portion under a condition that the transmission gear rotates with the clutcher.

In such a configuration, since the power transmitted by the clutcher is used to drive the medium feeding roller, a distance needed for the carriage to reach the trigger at the time of medium feed processing can be reduced to a half the distance that is needed in the related art, and the medium feeding roller can be activated quickly. It is thus possible to obtain a recording apparatus with high throughput as to the recording processing including the medium feeding processing.

Preferably, the actuator is a carriage for reciprocating a recording head which performs recording with respect to the recording medium in the main scanning direction.

In such a configuration, since the carriage is merely moved to actuate on the trigger, very simple configuration can be attained.

It is further preferable that: the recording apparatus further comprises a link, interconnected with the clutch lever, and extending in the main scanning direction from the first non-recording region to the second non-recording region; the clutch lever is disposed in the second non-recording region; and at least the first trigger is provided with the link.

In such a configuration, it is possible to provide the first trigger positioned away from the clutch lever in a simple arrangement. This can minimize an increase of the number of components.

The word "interlocked" means both a case where the link and the clutch lever are formed integrally and operate as a single member, and a case where each is formed as a separate member and operate in association through their respective interlocking mechanisms.

It is further preferable that the second trigger is provided with the clutch lever.

In such a configuration, since the second trigger is provided with the existing component, it will not involve the increase of component. Further, since the second trigger is not provided on the link, the link may be simple.

It is further preferable that: a first end of the clutch lever is formed with a hook member; a second end of the clutch lever is pivotably supported such that the hook member is engageable with the engagement portion of the clutcher, to thereby serves as the second trigger; the clutch comprises an elastic member which urges the hook member toward the engagement portion of the clutcher; the link is slidable in the main scanning direction; the actuator actuates the first trigger such that the link is slid away from the clutch lever; and the clutch lever is pivoted when the link is slid, so that the hook member is disengaged from the engagement portion of the clutcher.

In such a configuration, no additional power is needed to switch the states of the clutch lever. Further, since a tensile force in the longitudinal direction of the link member is exerted on the link member, and the link portion need not to receive a force in the direction perpendicular to the tensile force. Hence, a member with a relatively low stiffness can be used, and a narrow wire or the like can be used as long as it can withstand the tensile force.

It is further preferable that the hook member is formed with a tapered portion which is to be abutted against the engagement portion of the clutcher.

In such a configuration, when the hook portion proceeds in a direction to enable engagement with the engagement portion of the clutcher, the tapered portion moves so that it pivots the clutcher in a direction such that the tooth of the clutcher comes out of the ratchet gear, which allows the transition to the first position to take place speedily in a reliable manner.

It is also preferable that: the medium feeding roller is provided with a cam having a cam face formed with a recess; the recording apparatus further comprises a cam follower, operable to engage with the cam; the clutch lever engages with the engagement portion of the clutcher when the cam follower begins to engage with the cam; and the medium feeding roller is rotated by an action that the cam follower engages with the recess, so that the transmission roller is accordingly rotated to place the clutcher in the second position.

In such a configuration, it is possible to release the ratchet gear and the tooth from the first position in a reliable manner through the use of the existing component without the need of complicated control or the like.

It is also preferable that the clutch lever is disengaged from the engagement portion of the clutcher and the ratchet gear is rotated reversely in a case where the actuator is to actuate one of the first trigger and the second trigger in connection with operation other than a paper feeding operation, so that the clutch is placed in the second position against an urging force of the elastic member.

In such a configuration, no power transmission state can be selected when it is not necessary to switch the power transmission state of the rotational driving of the medium feeding roller, even when the carriage actuates on the trigger. For example, when the stand-by position of the carriage is outside of the recording region and the carriage is moved to the stand-by position for the cleaning of the recording head, etc.

According to the invention, there is also provided a recording apparatus, comprising:

a power source, which provides a driving force;

a medium feeding roller, operable to rotate to feed a recording medium;

a transmitter, operable to transmit the driving force to the medium feeding roller;

an actuator, operable to move in a main scanning direction of recording;

a clutch, operable to be actuated by the actuator so that the transmitter transmits the driving force to the medium feeding roller; and a controller, which judges a position in the main scanning direction where the clutch is actuated by the actuator, and determines a reference position of the rotation of the medium feeding roller in accordance with the judged position.

In such a configuration, by performing the medium feeding control using the position of the carriage at the instant the medium feeding roller starts to rotate as the judged position, it is possible to perform precise medium feeding control regardless of the dimensional or assembling accuracy of the components.

Preferably, the clutch comprises an actuated member which is pivotable about an axis extending in the main scanning direction, and operable to be actuated by the actuator.

In such a configuration, it is possible to provide an inexpensive recording apparatus in a simple arrangement by using such an actuated member.

Here, it is preferable that the actuated member is formed with a portion slanting in the main scanning direction, against which the actuator is to be abutted.

In such a configuration. It is possible to allow the actuated member to move naturally without giving a load to the actuator.

Preferably, the recording apparatus further comprises: a recording region; a first non-recording region, situated in one of both outer sides of the recording region in a main scanning direction of recording; a second non-recording region, situated in the other one of the both sides of the recording region; and a trigger, operable to be slid by the actuator in the main scanning direction, to actuate the clutch to cause the transmitter to transmit the driving force to the medium feeding roller. The trigger is disposed in the first non-recording region and the clutch is disposed in the second non-recording region.

In such a configuration, in comparison with a related-art configuration where the trigger is provided to one end side alone, the maximum distance needed for the actuator to reach the trigger is reduced by half. It is thus possible to obtain a recording apparatus capable of activating the rotating body (e.g., gears) quickly.

It is preferable that: the recording apparatus further comprises a ratchet gear, interconnected with the power source; the clutch comprises a clutcher, formed with a tooth and an engagement portion, the clutcher held by the transmitter so as to be pivotable between a first position where the tooth is engaged with the ratchet gear and a second position where the tooth is disengaged from the ratchet gear; the transmitter rotates with the clutcher when the clutcher is placed in the first position, so that the driving force is transmitted to the medium feeding roller; and the clutch comprises a clutch lever, operable to engage with the engagement portion of the clutcher, and to place the clutcher in the second position when the clutch lever engages with the engagement portion under a condition that the transmitter rotates with the clutcher.

In such a configuration, since the power transmitted by the clutcher is used to drive the medium feeding roller, a distance needed for the carriage to reach the trigger at the time of medium feed processing can be reduced to a half the distance that is needed in the related art, and the medium feeding roller can be activated quickly. It is thus possible to obtain a recording apparatus with high throughput as to the recording processing including the medium feeding processing.

DETAILED DESCRIPTION OF THE PREFERRED EMBODIMENTS

Preferred embodiments of the present invention will be described with reference to the accompanying drawings. An entire configuration of an ink jet printer (referred to as a "printer") 100 which is one kind of a recording apparatus according to a first embodiment of the present invention will first be described with reference to FIGS. 1 and 2.

Figure 1:
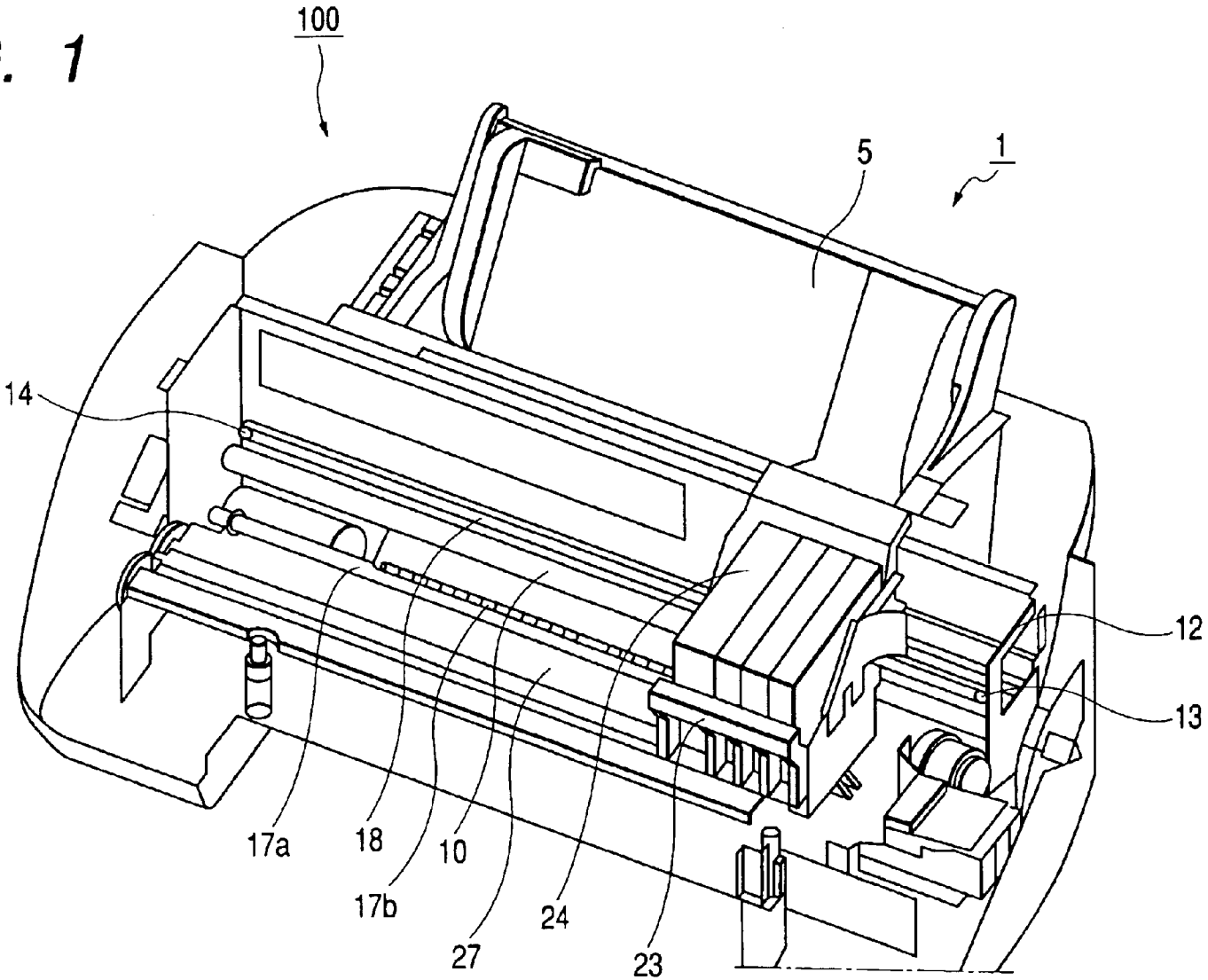
FIG. 1 is a perspective view showing an exterior appearance of an ink jet printer according to a first embodiment of the invention.
Figure 2:
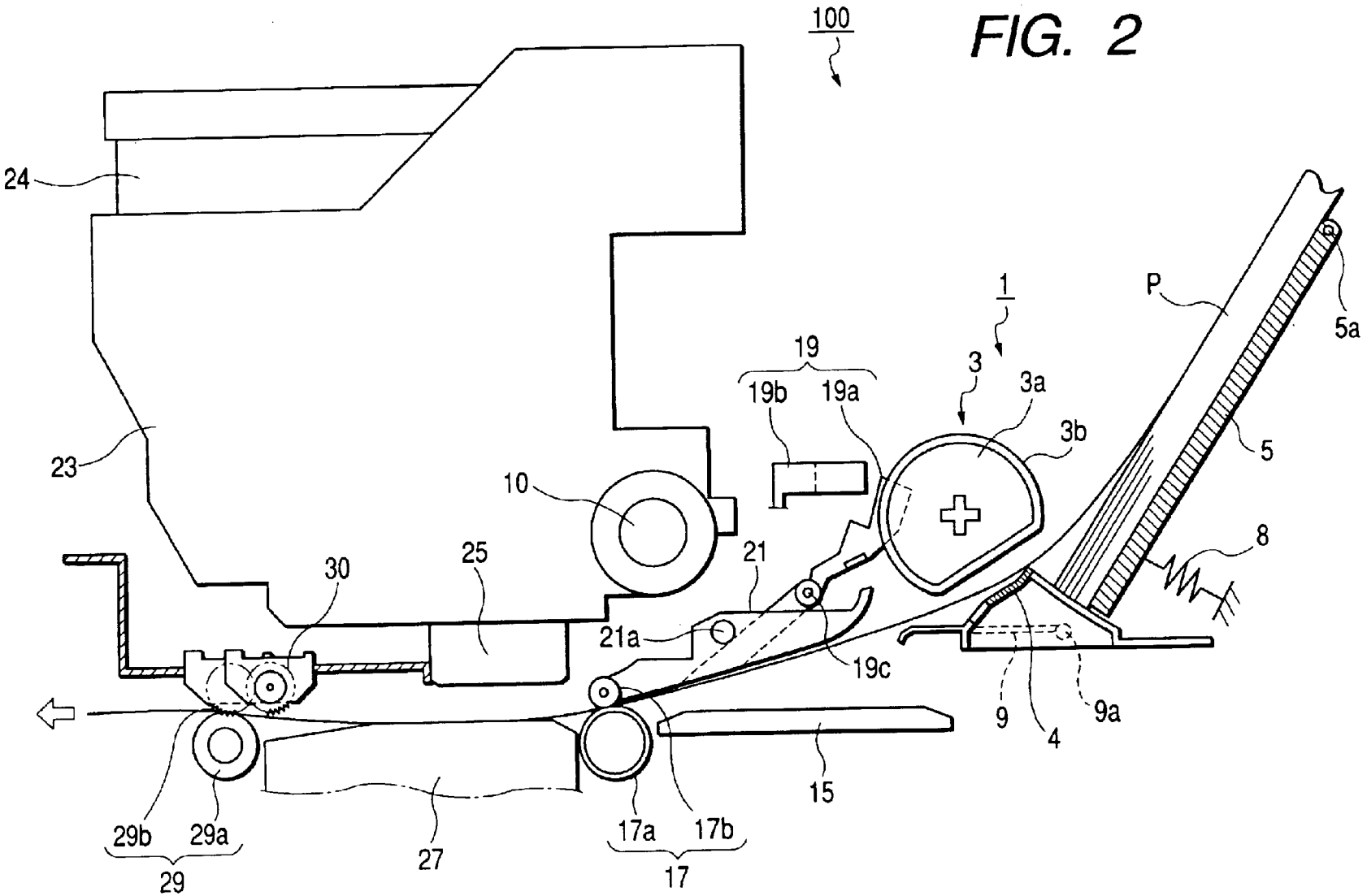
FIG. 2 is a schematic section view of the ink jet printer.

FIG. 1 is a perspective view showing an exterior appearance of a main body of the printer 100 (a state that a cover forming the exterior appearance is removed). FIG. 2 is a sectional side view schematically showing the same. In the description to follow, a right side in FIG. 1 (back side of the printer 100) will be referred to as an "upstream side" (upstream side of a sheet transporting path), and a left side in FIG. 1 (front side of the printer 100) will be referred to as a "downstream side" (downstream side of the sheet transporting path).

The printer 100 includes a sheet feeder 1, which is disposed on the rear side of a U-shaped (in plan view) main frame 12 which defines a base of a main body of the printer as shown FIG. 1. Recording sheets are fed one by one to the front side of the printer, from the sheet feeder 1. As shown in FIG. 2, the sheet feeder 1 includes a sheet feeding roller 3, a separation pad 4, and a sheet returning lever 9, and a hopper 5.

The sheet feeding roller 3, which is driven to rotate by a drive motor (not shown), is shaped like D in side view, and includes a roller body 3*a* and a rubber material 3*b* wound on an outer peripheral surface of the roller body 3*a*. The sheet feeding roller 3 feeds a recording sheet P by use of its arcuate part, and allows the recording sheet P to pass there by use of its flat part to thereby impart no transport load to a downstream transporting roller 17 disposed in the downstream side when it is in a transporting operation.

The hopper 5 is formed with a plate-like member, and as shown, it is provided taking a slanted posture. Further, it may be pivoted about a rotary shaft 5*a* provided in an upper part, clockwise and counterclockwise in FIG. 2. When the hopper is pivoted by a cam mechanism to be described later, the lower end of the hopper is brought into pressing contact with the sheet feeding roller 3 and separated from the same. When the hopper 5 is pivoted in a direction in which the hopper is brought into pressing contact with the sheet feeding roller 3, a bundle of recording sheets P stacked on the hopper 5 is put in pressing contact with the sheet feeding roller 3. In this state, the uppermost recording sheet P of the sheet stack is fed to the downstream side by rotating the sheet feeding roller 3.

The separation pad 4 is made of a high friction material, and provided at a position where it faces the sheet feeding roller 3. When the sheet feeding roller 3 is rotated, the arcuate part of the sheet feeding roller 3 is brought into pressing contact with the separation pad 4 to thereby form a pressing contact part (nipping part). The uppermost recording sheet P that is fed out by the arcuate part of the sheet feeding roller 3 passes the pressing part and advances to the downstream side. The next recording sheet P and the subsequent ones, which will advance to the downstream while being taken by the uppermost recording sheet P, are blocked in their advancing by the pressing part, whereby the multi-feeding of the recording sheets P is prevented.

The separation pad 4 may be substituted by another multi-feed preventing member, such as a retard roller. When the retard roller is used, the sheet feeding roller 3 used may be circular in side view.

The sheet returning lever 9, which is shaped like a lever, and disposed near the lower end of the hopper 5, may be pivoted about a supporting point 9*a* by a drive mechanism (not shown), clockwise and counterclockwise in FIG. 2. In a feeding operation of the recording sheet P, the sheet returning lever 9 is pivoted to the downstream side as shown in FIG. 2, and does not hinder the feeding operation of the recording sheet P. When the feeding of the recording sheet P starts and the leading end of the recording sheet P advances to the downstream side of the sheet returning lever 9, the sheet returning lever 9 rises toward the upstream side, and pushes back to the upstream side the next recording sheets P and the subsequent ones, which are taken by the fed recording sheet P and on the verge of multi-feeding. With the pushing back action, the multi-feeding of the recording sheets P is more securely prevented.

A sheet guide 15 formed with a plate-like member is substantially horizontally disposed downstream of the sheet feeder 1. The front end of the recording sheet P fed out by the sheet feeding roller 3 comes in contact with the sheet guide 15 in an oblique direction and the sheet is smoothly guided to the downstream side. A transporting roller 17 is provided downstream of the sheet guide 15. The transporting roller 17 includes a drive roller 17*a* to be driven to rotate and a follower roller 17*b* to be in pressing contact with the drive roller 17*a*. The recording sheet P is nipped between the drive roller 17*a* and the follower roller 17*b*, and transported to the downstream side at a pitch which depends on print conditions.

The follower roller 17*b* is shaft-supported at a downstream position of a follower roller holder 21. The follower roller holder 21 is provided such that it is rotatable about a rotary shaft 21*a* clockwise and counterclockwise in FIG. 2. The follower roller 17*b* is constantly urged in a direction in which it is pressed against the drive roller 17*a* (counterclockwise in FIG. 2), by a coiled spring (not shown). The drive roller 17*a* is formed with a shaft member extending in main scanning directions (orthogonal to the drawing sheet of FIG. 2). A plurality of follower rollers 17*b* and a plurality of follower roller holders 21 (not shown) are disposed in the axial direction of the drive roller 17*a*.

A sheet sensor 19 for sensing passing of the recording sheet P, which includes a sensor body 19*b* and a detecting lever 19*a*, is disposed near the follower roller holder 21 located closest to a home position (the right side of FIG. 1). The detecting lever 19*a*, shaped like a dogleg in side view, is rotatable about a rotary shaft 19*c* located substantially at the center thereof, clockwise and counterclockwise in FIG. 2. The sensor body 19*b*, located above the detecting lever 19*a*, includes a light emitting part (not shown) and a light receiving part (not shown) for receiving light from the light emitting part. An upper part of the detecting lever 19*a* with respect to the rotary shaft 19*c* interrupts light originated from the light emitting part to the light receiving part and allows the same light to go from the former to the latter, through the pivoting operation of the upper part of the detecting lever 19*a*. Accordingly, when with the passing of the recording sheet P, the detecting lever 19*a* is pivoted to move upward as shown in FIG. 2, the upper part of the detecting lever 19*a* comes off from the sensor body 19*b*. As a result, the light receiving part is brought in a light receiving state to detect the passing of the recording sheet P.

A platen 27 and an ink jet recording head 25 are disposed downstream of the drive roller 17*a*, while being opposite to each other in the vertical direction. The recording sheet P which is transported to under the ink jet recording head 25 by the transporting roller 17 is supported from its underside by the platen 27. The ink jet recording head 25 is provided on a bottom part of a carriage 23 on which an ink cartridge 24 is mounted. The carriage 23 which extends in the main scanning direction is guided in the main scanning direction by a carriage guide shaft 10, which is supported by the main frame 12 (FIG. 1).

In FIG. 1, a follower pulley 13 which is freely rotatable and a drive pulley 14 driven to rotate by a drive motor (not shown) are provided on both side parts of the main frame 12. An endless belt 18 is wound on the drive pulley 14 and the follower pulley 13. The carriage 23 is fixed to a part of the endless belt 18, whereby the carriage 23 is reciprocatively moved in the main scanning direction. While the carriage 23 is reciprocatively moved in the main scanning direction, the ink jet recording head 25 (FIG. 2), which receives ink from the ink cartridge 24, ejects ink drops to a recording sheet P to thereby record on the recording sheet.

Returning to FIG. 2, a sheet discharging section is located downstream of the ink jet recording head 25, and contains a discharging roller 29 which is formed with a drive roller 29*a* to be driven to turn and a follower roller 29*b* which is freely rotatable. A recording sheet P having undergone a recording by the ink jet recording head 25 is discharged in a direction of an arrow in a state that the recording sheet P is nipped between the rotating drive roller 29*a* and the follower roller 29*b*. An auxiliary roller 30 which is freely rotatable is disposed slight upstream of the follower roller 29*b*. A plurality of drive rollers 29*a* are substantially equidistantly disposed in the main scanning direction. The follower rollers 29*b* are also substantially equidistantly disposed, while corresponding to the drive rollers so disposed (not specifically illustrated). The auxiliary roller 30 is located at a mid position between adjacent discharging roller pairs (not specifically illustrated).

As shown in FIG. 2, in the transporting roller 17, a nip point between the drive roller 17*a* and the follower roller 17*b* is set at a position slightly shifted to the downstream side with respect to the rotation axis of the drive roller 17*a*. In the discharging roller 29, a nip point between the drive roller 29*a* and the follower roller 29*b* is set at a position slightly shifted to the upstream side with respect to the rotation axis of the drive roller 29*a*. Accordingly, between the transporting roller 17 and the discharging roller 29, the recording sheet P is gently curved downward as shown, so that the recording sheet P is pressed against the platen 27. As a result, the recording sheet P is prevented from lifting from the platen 27, and a distance between the recording surface and the ink jet recording head 25 is kept constant, and hence deterioration of the print quality is prevented.

Figure 3:
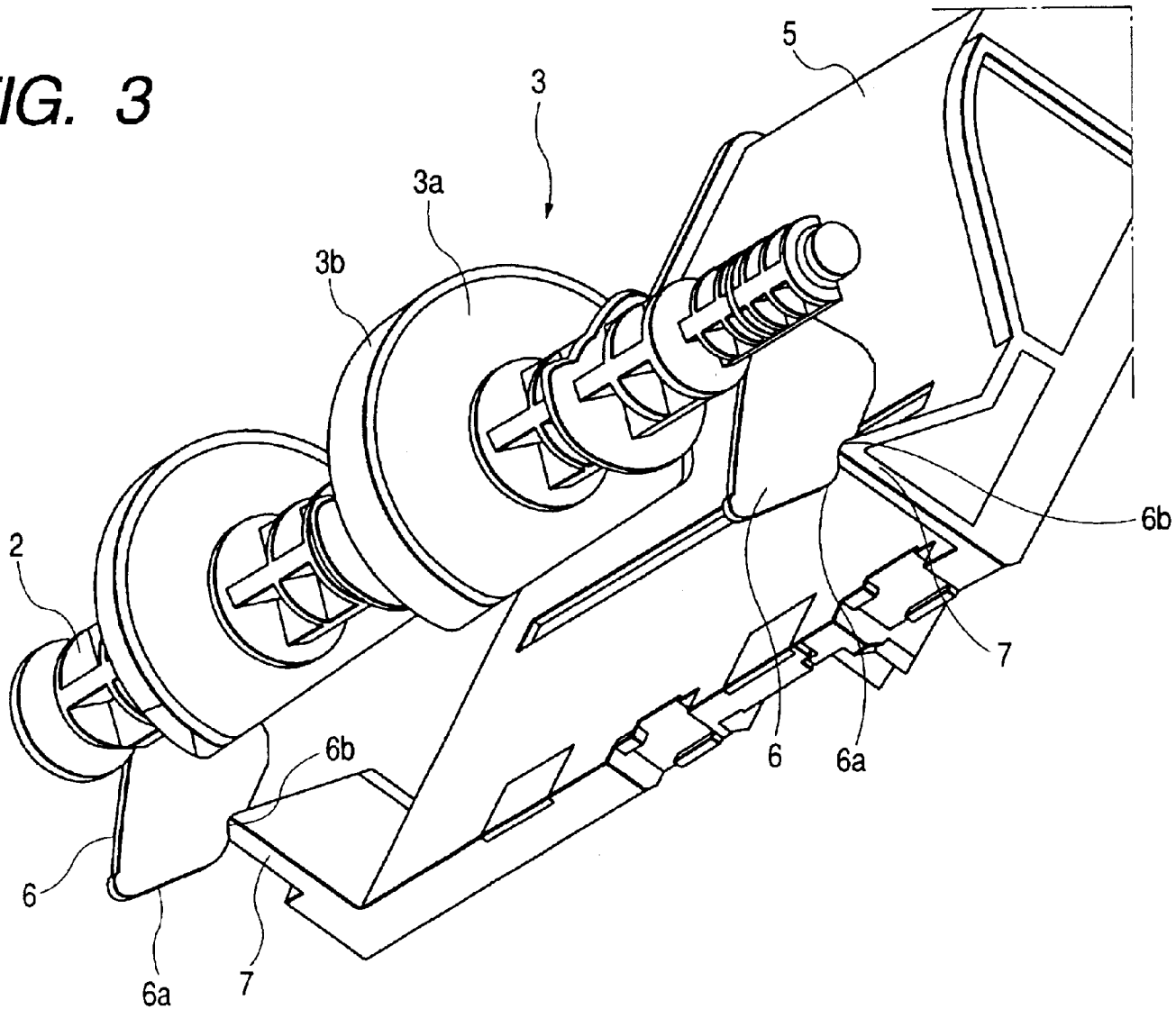
FIG. 3 is a perspective view of a sheet feeding roller and a hopper in the ink jet printer, viewed from a down side obliquely.
Figure 4:
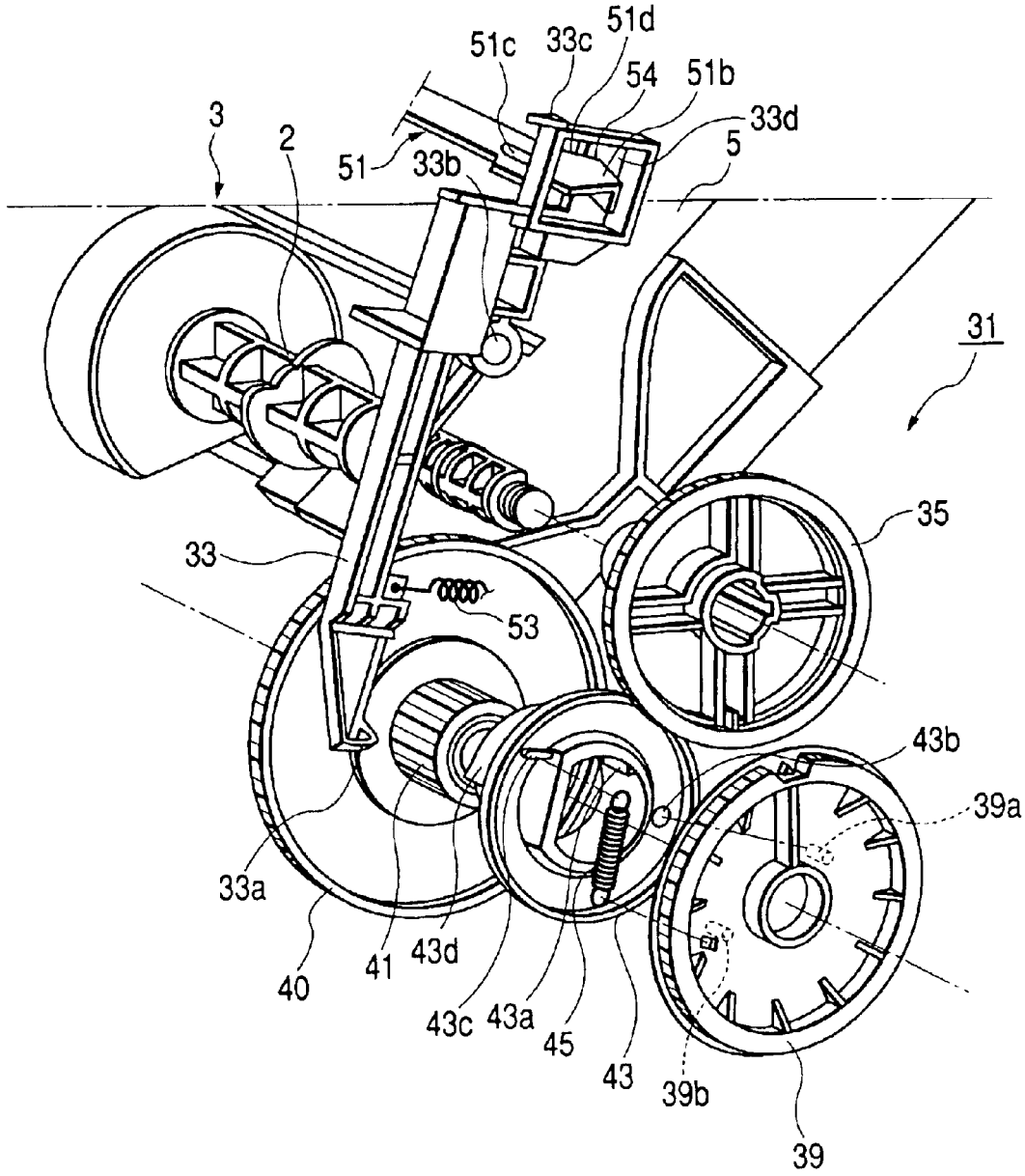
FIG. 4 is an exploded perspective view of a clutch device in the ink jet printer.
Figure 5:
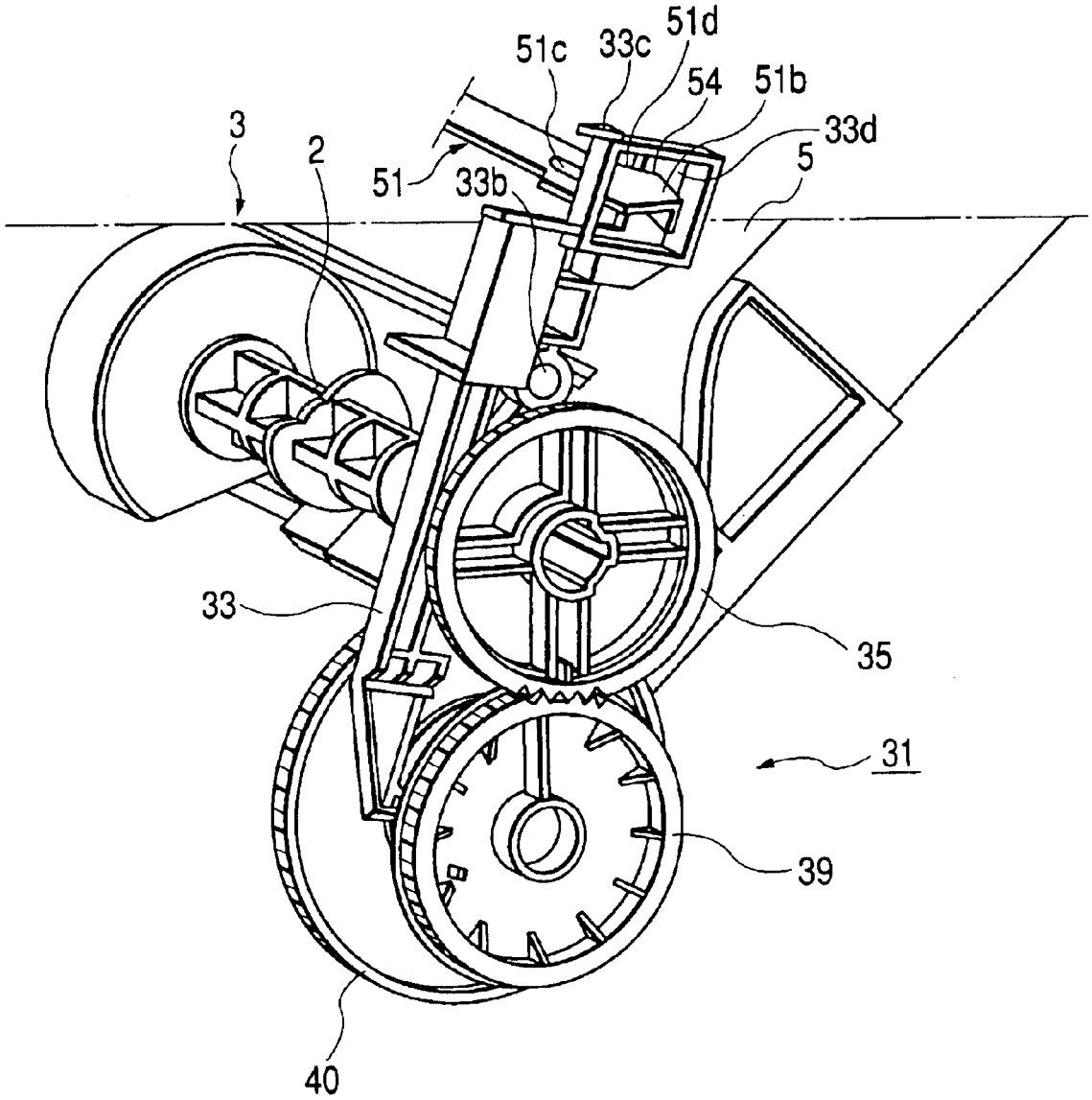
FIG. 5 is a perspective view showing an assembled state of the clutch device.
Figure 6A:
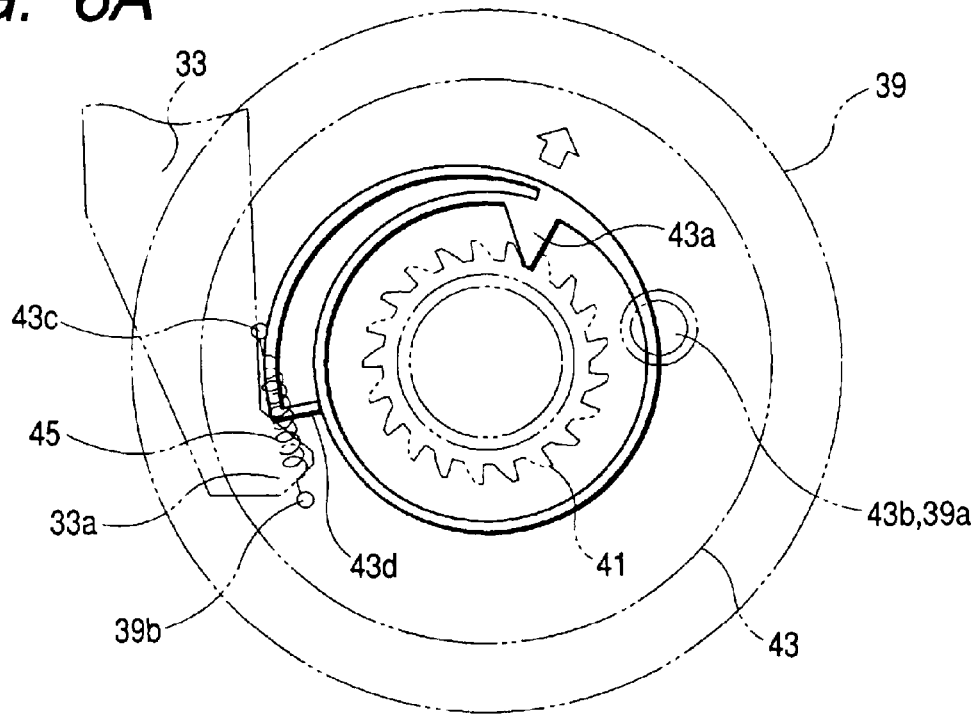
FIGS. 6A through 11 are views showing an operation principle of the clutch device.
Figure 6B:
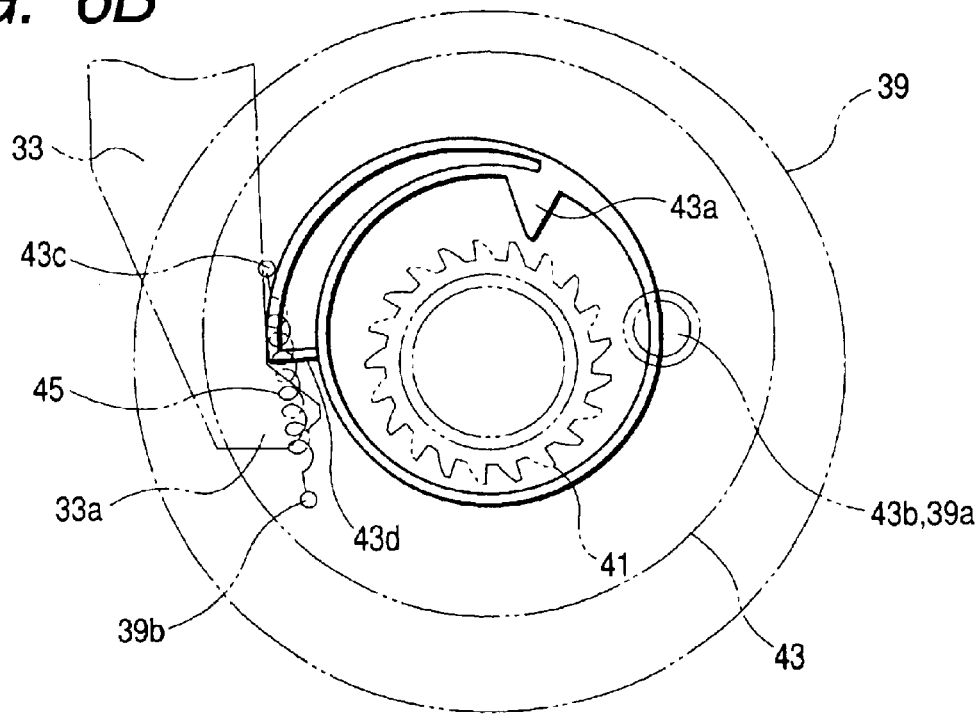

More detailed construction of the sheet feeder 1 will be described hereunder with reference to FIGS. 3 through 11. FIG. 3 is a perspective view showing a structure including a sheet feeding roller 3 and a hopper 5, when viewed obliquely from below. FIG. 4 is an exploded, perspective view showing a clutch device (gear device) 31 for permitting and inhibiting power transmission to the sheet feeding roller 3 (rotary shaft 2) which is provided on a side (right side in FIG. 1) of the sheet feeder 1. FIG. 5 is a perspective view showing an assembled state of the clutch device. FIGS. 6A and 6B are cross sectional views showing a clutch member 43 for explaining an operation principle of the clutch member 43. FIGS. 7 to 11 are front views (cross sectional views in part) showing an operation principle of a clutch device 31.

First, a cam mechanism for driving the hopper 5 to turn will be described with reference to FIG. 3. The hopper 5 includes cam followers 7 which are located at both side ends of a lower part of the hopper 5, and protrude toward the sheet feeding roller 3. Two cams 6 are provided at both ends of the rotary shaft 2, and integrally formed with the rotary shaft 2. The cams 6 each take a sector shape as viewed in the axial direction of the rotary shaft 2, and engage with the cam followers 7. A hopper spring 8 (see FIG. 2) is provided on the rear side of the hopper 5, so that the hopper 5 and the cam followers 7 are constantly urged toward the sheet feeding roller 3 or the cams 6. Through rotation of the sheet feeding roller 3 (rotary shaft 2), an engaged state and a disengaged state of the cams 6 with the cam followers 7 are switched. When an engaged state that the cams 6 press down the cam followers 7 (a state of FIG. 3) is established, the hopper 5 separates from the sheet feeding roller 3.

Construction of the clutch device 31 for permitting and inhibiting power transmission to the sheet feeding roller 3 (rotary shaft 2) will be described with reference to FIGS. 4 through 6B.

As shown in FIGS. 4 and 5, the clutch device 31 includes a spur gear 40 driven to rotate by a drive motor (not shown). The spur gear 40 serves as a power input part to the clutch device 31.

The spur gear 40 is integrally formed with a ratchet gear 41. An annular clutch member 43 is loosely fit to the ratchet gear 41. The clutch member 43 includes a gear part 43*a* to be in mesh with the ratchet gear 41 within an inner peripheral part. The clutch member 43 includes a receiving hole 43*b* located shifted from the center thereof. A protruded shaft 39*a* is fit into the receiving hole 43*b*. The protruded shaft 39*a* is located at a position shifted from a rotation center of a spur gear 39 as a "transmission gear", which is provided sandwiching the clutch member 43 between the spur gear 39 and the spur gear 40. When a gear part 43*a* of the clutch member 43 is in mesh with the ratchet gear 41, the clutch member 43 rotates together with the ratchet gear 41, and then the spur gear 39 also rotates.

A sheet feeding roller gear 35, which is provided at an end of the rotary shaft 2 of the sheet feeding roller 3, is in mesh with the spur gear 39. Accordingly, when the spur gear 40 rotates in a state that the gear part 43*a* of the clutch member 43 is in mesh with the ratchet gear 41, a rotational force is resultantly transmitted to the rotary shaft 2 and the sheet feeding roller 3 rotates.

As seen from the foregoing description, in a state that the gear part 43*a* of the clutch member 43 is not in mesh with the ratchet gear 41, the ratchet gear 41 merely idle-rotates within the annular inner part of the clutch member 43, so that a rotational force of the spur gear 40 is not transferred to the sheet feeding roller 3. In the clutch device 31, a shaft member, which is not shown in FIGS. 4 and 5, is inserted into the spur gear 40, the ratchet gear 41, the clutch member 43 and the spur gear 39. Accordingly, those four rotary bodies are rotated about one rotation center.

Description will now be given mainly about an operation principle of the clutch device 31, while referring mainly to FIGS. 4, 6A and 6B. FIG. 6A shows a state that as described above, the gear part 43*a* of the clutch member 43 comes in mesh with the ratchet gear 41 to transmit a rotational force to the sheet feeding roller 3. FIG. 6B shows a state that the gear part 43*a* of the clutch member 43 is not in mesh with the ratchet gear 41, and the rotational force is not transmitted to the sheet feeding roller 3.

In FIG. 6A, the protruded shaft 39*a* (FIG. 4) is fit into the receiving hole 43*b*, and the clutch member 43 is pivoted about the receiving hole 43*b* clockwise and counterclockwise in FIGS. 6A and 6B. With the pivoting of the clutch member, the gear part 43*a* engages with the ratchet gear 41 (gear engaged state) as shown in FIG. 6A, or disengages from the ratchet gear 41 (gear disengaged state) as shown in FIG. 6B.

A spring hooking part 43*c* is provided on the clutch member 43 (see also FIG. 4). A spring hooking part 39*b* is provided on the spur gear 39 (see also FIG. 4). A tension coiled spring 45 is stretched between those two spring hooking parts. The tension coiled spring 45 urges the clutch member 43 in a direction in which the gear part 43*a* comes into engagement with the ratchet gear 41 (a direction in which it is pressed against the ratchet gear 41). As a result, in a state that some force is not imparted from exterior to the clutch member 43, the gear part 43*a* firmly engages with the ratchet gear 41.

As seen from FIG. 6A, the teeth of the ratchet gear 41 are slanted in a counterclockwise direction in the figure. The gear part 43*a* is also formed so as to engage with the teeth of the ratchet gear 41 thus formed. Accordingly, when the ratchet gear 41 is pivoted counterclockwise shown in FIG. 6A, a rotational force is transmitted to the clutch member 43. And, the spur gear 39 is also pivoted counterclockwise in the figure, so that the sheet feeding roller 3 is rotated in a direction in which the sheet feeding roller 3 feeds the recording sheet P to the downstream side (clockwise direction in FIG. 2).

A clutch engaging part 43*d* is formed on an outer periphery of the clutch member 43. When the clutch member 43 is pivoted in a direction in which the clutch member 43 transmits a rotational force to the sheet feeding roller 3 (counterclockwise direction in FIG. 6A), the clutch engaging part 43*d* engages a hook part 33*a* which is positioned near the outer periphery of the clutch member 43.

The hook part 33*a* is formed at a lower part of a clutch lever 33 (FIG. 4). The clutch lever 33 is provided such that when it is pivoted about the center of a rotary shaft 33*b*, the hook part 33*a* in the lower part advances to and retracts from the outer periphery of the clutch member 43. The clutch lever 33 is provided with a spring 53 (FIG. 4) for urging and pressing the hook part 33*a* against the outer periphery of the clutch member 43. When the carriage 23 moves to a side (right side in FIG. 1) where the clutch device 31 is provided, an upper part of the rotary shaft 33*b* is allowed to engage with the carriage 23 (not specifically illustrated), whereby the pivoting operation of the clutch lever 33 (advancing and retracting operations of the hook part 33*a*) is performed. Through the pivoting operation, the clutch lever 33 selects a "clutch engaged state" in which the hook part 33*a* engages with the clutch engaging part 43*d* or a "clutch disengaged state" in which the hook part 33*a* does not engage with the clutch engaging part 43*d*.

Figure 10:
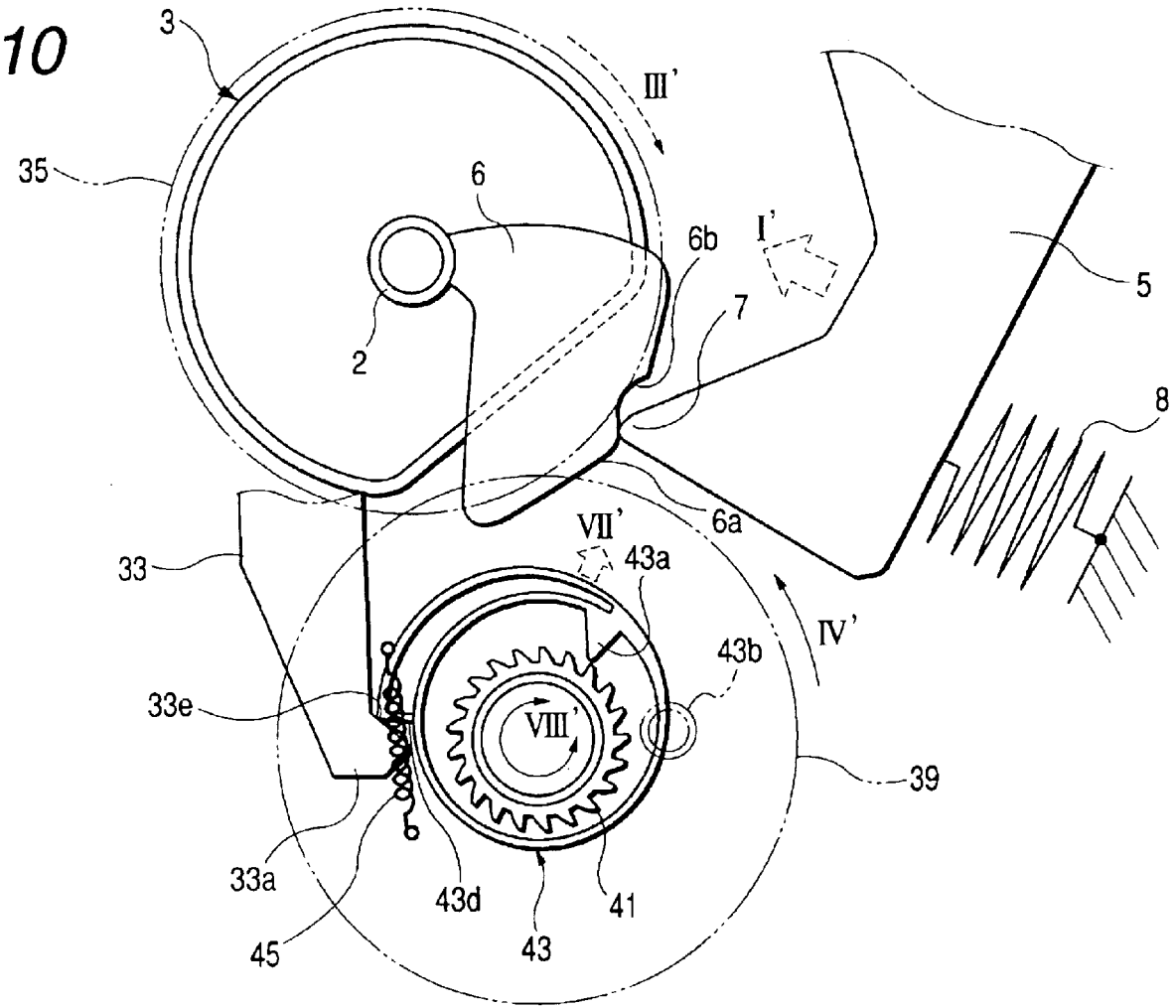
Figure 11:
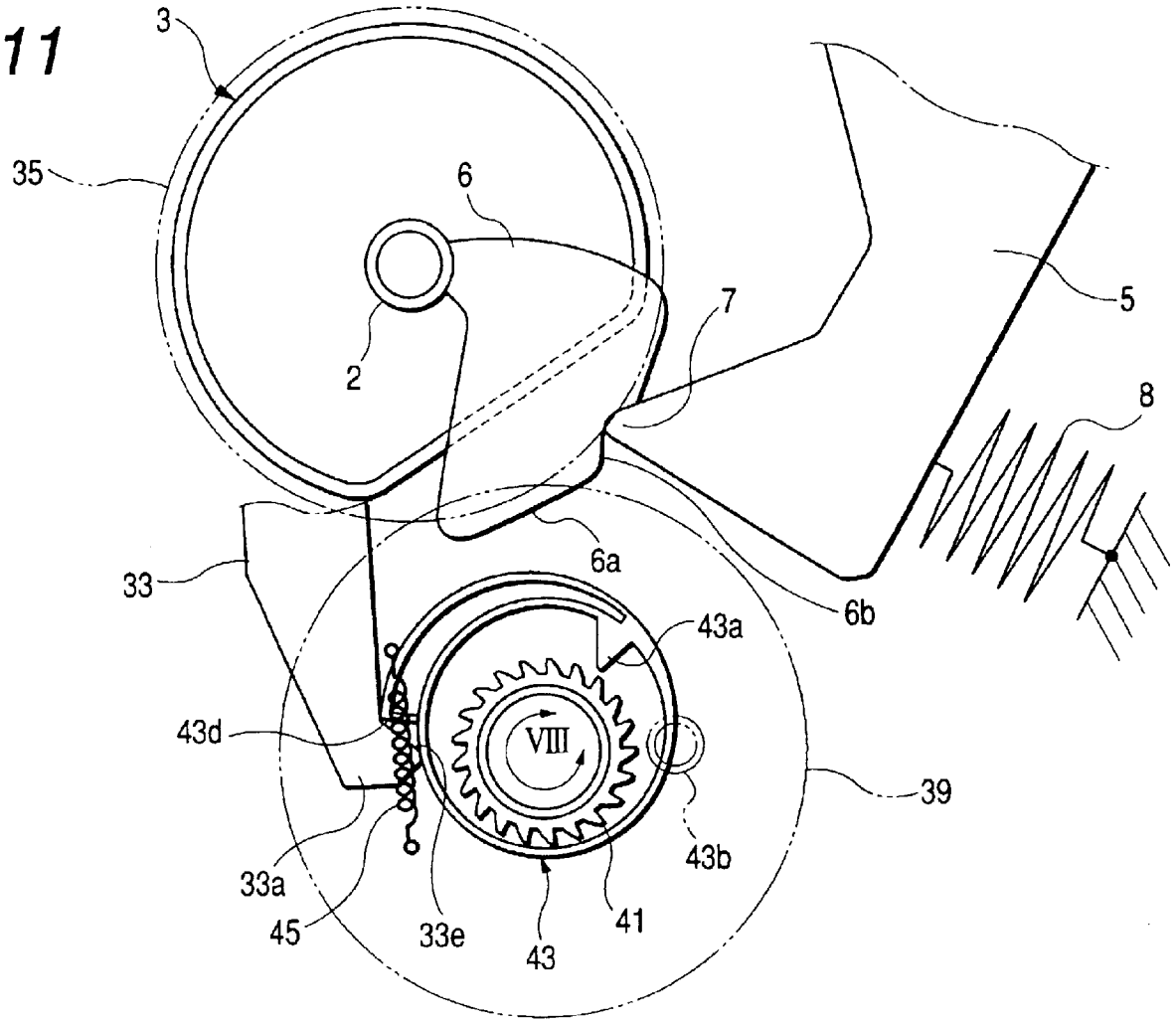

The hook part 33*a* of the clutch lever 33 includes a tapered part 33*e*, which is formed in a portion of the hook part where it comes in contact with the clutch engaging part 43*d* (FIGS. 10 and 11). Accordingly, when the hook part 33*a* advances in a direction in which the hook part 33*a* engages with the clutch engaging part 43*d* (it is pressed against the outer periphery of the clutch member 43), the clutch member 43 is pivoted, by the tapered part 33*e*, in a direction in which the gear part 43*a* of the clutch member 43 comes off from the ratchet gear 41, and the gear disengaged state is established quickly and reliably.

As shown in FIG. 6A, when the hook part 33*a* advances to the outer periphery of the clutch member 43 during the rotation of the ratchet gear 41 in a direction in which the rotational force is transferred to the sheet feeding roller 3 (counterclockwise in this figure), the hook part 33*a* engages with the clutch engaging part 43*d* to stop the rotation of the clutch member 43. However, the ratchet gear 41 will further rotate. Accordingly, the teeth of the ratchet gear 41 will push the gear part 43*a* in a direction of an arrow in FIG. 6A, so that the clutch member 43 is pivoted about the receiving hole 43*b* against the urging force of the tension coiled spring 45. A disengaged state of the gear part 43*a* from the ratchet gear 41 is established as shown in FIG. 6B.

Description will be given below about the operations of the sheet feeding roller 3 and the hopper 5 and an operation principle of the whole clutch device 31. In description to follow, a state that the ratchet gear 41 meshes with the gear part 43*a*, and a rotational force is transmitted from a drive motor (not shown) to the sheet feeding roller 3, will be referred to as an "active state" of the clutch device 31.

Figure 7:
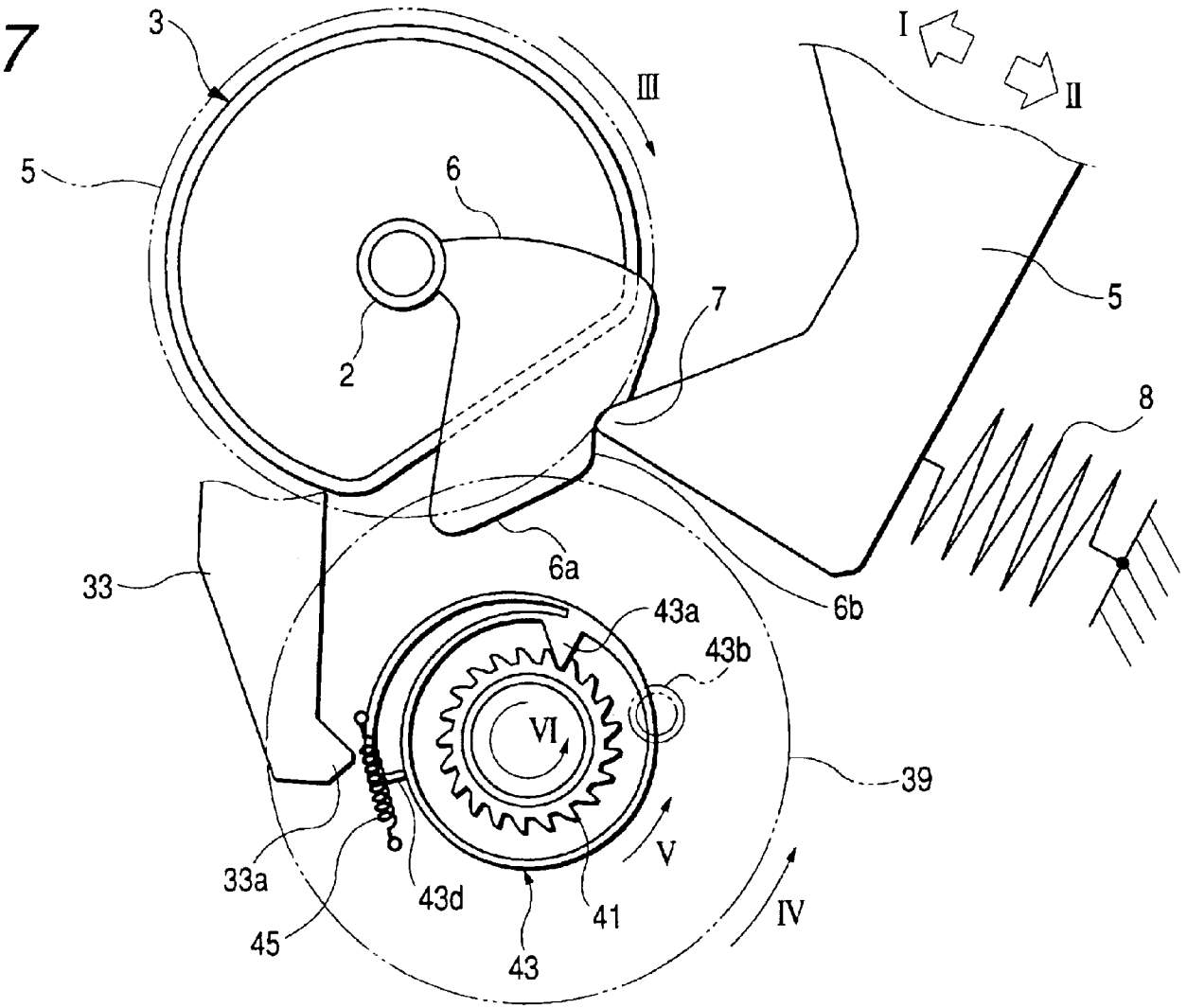

Firstly, FIG. 7 shows a state immediately after the sheet feeder 1 shifts from a stand-by state to a sheet feeding state. In this state, the flat part of the sheet feeding roller 3 which is shaped like D in side view is confronted with the hopper 5 (the state shown in FIG. 2). The hopper 5 has separated from the sheet feeding roller 3 against the urging force of the hopper spring 8. More specifically, the cams 6 and the cam followers 7 are in an engaged state as described referring to FIG. 3, and the cams 6 have pushed downward the hopper 5 through the cam followers 7. Accordingly, in this state, the recording sheet P set on the hopper 5 is not in pressing contact with the sheet feeding roller 3. In this state, the urging force does not act on between the sheet feeding roller 3 and the hopper 5, but acts on between the cams 6 and the cam followers 7.

Figure 8:
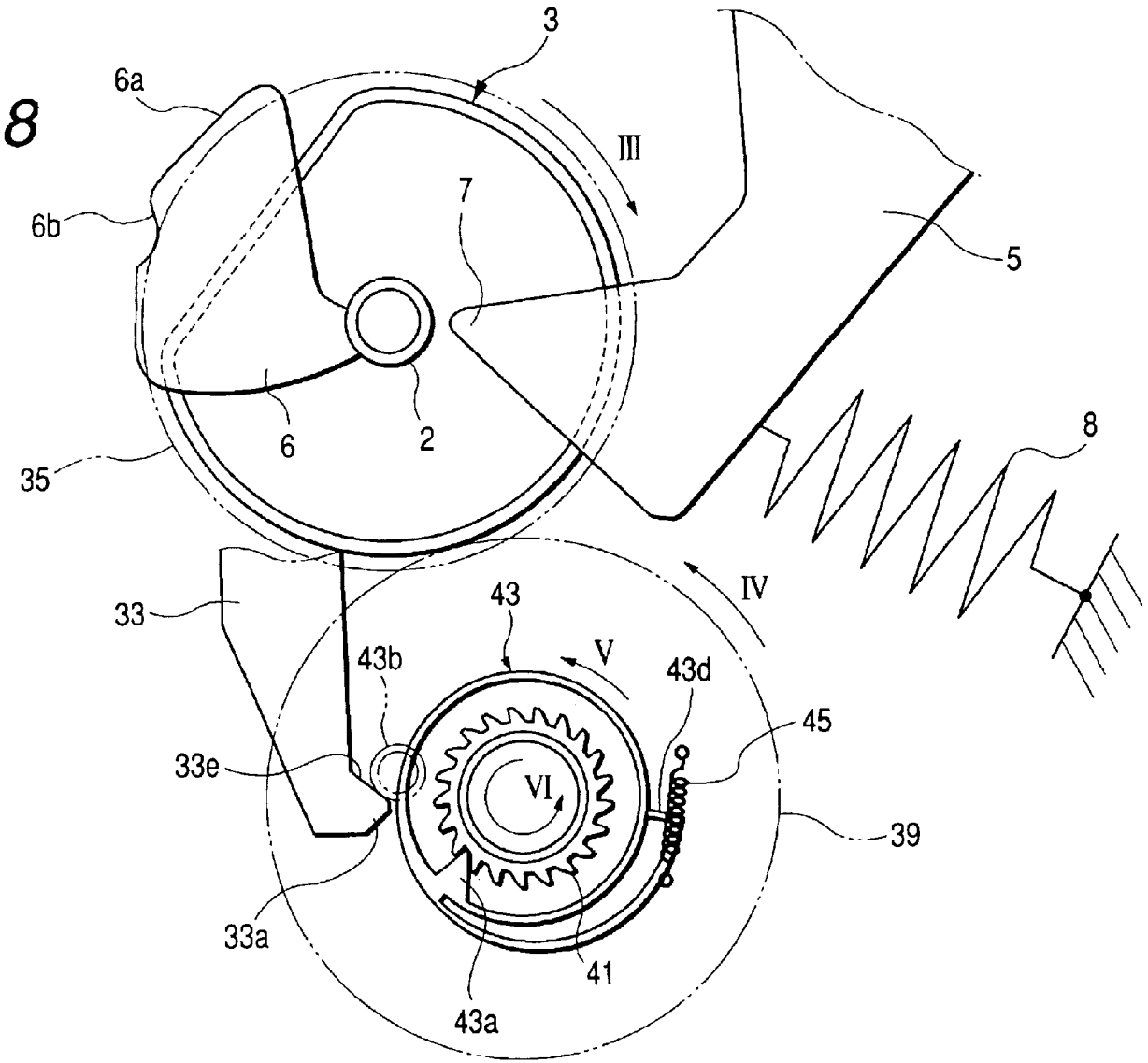
Figure 9:
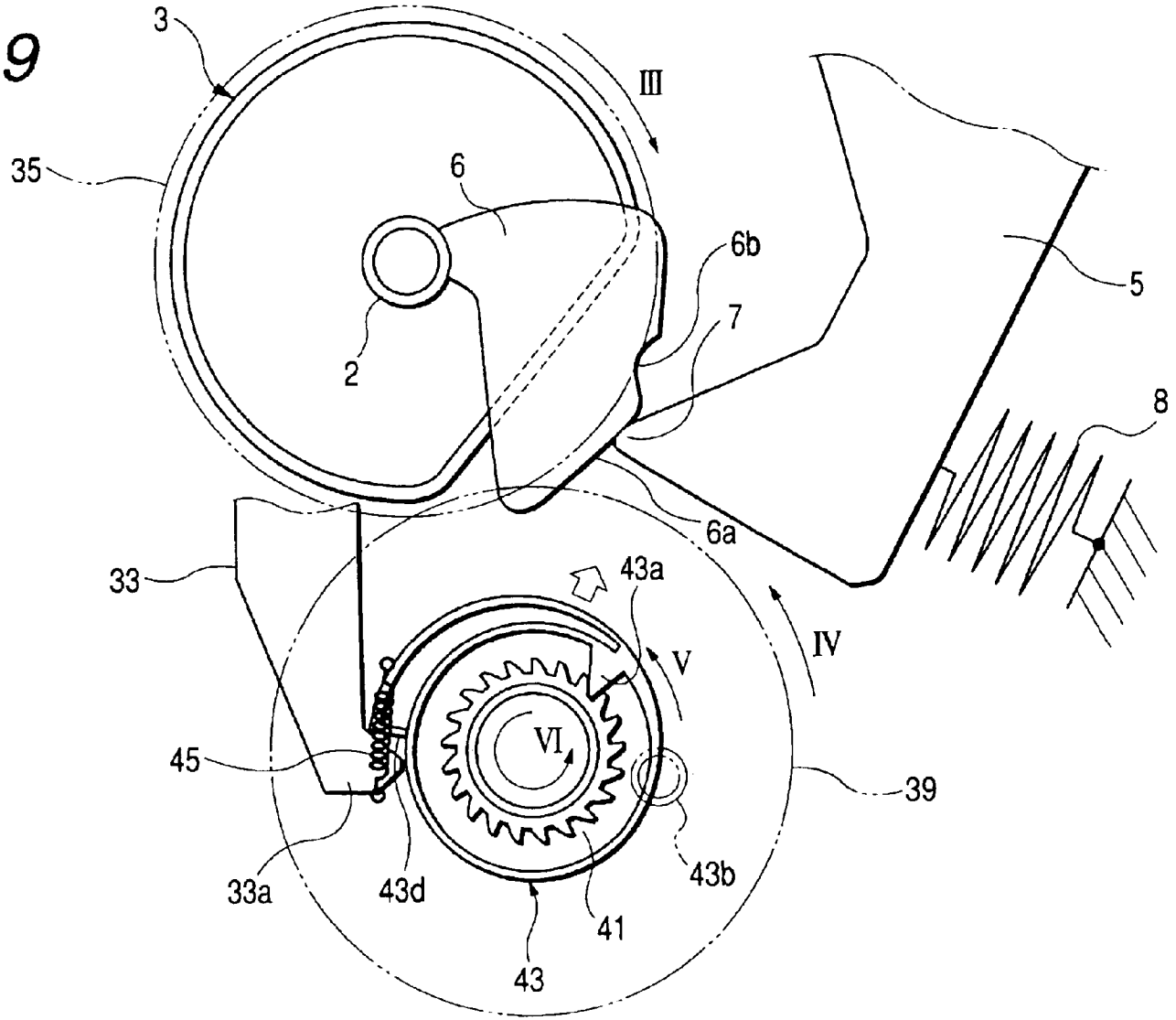

When the sheet feeding operation starts, the carriage 23 (FIG. 1) engages with the clutch lever 33, the hook part 33*a* retracts from the outer periphery of the clutch member 43 as shown in FIG. 7, the ratchet gear 41 is brought into engagement with the gear part 43*a* of the clutch member by an urging force of the tension coiled spring 45, and the clutch device 31 is put in an operation state. In FIGS. 7 to 9, arrows III to V indicated by solid lines designate the rotational directions of the sheet feeding roller 3 (i.e., the rotary shaft 2, the spur gear 35, and the cams 6), the spur gear 39, and the clutch member 43. Further, the solid lines indicate a state that the clutch device 31 is in the active state, and that those rotary bodies are rotated by a drive force of the not-shown drive motor. In FIG. 10, arrows indicated by dashed lines designate rotations of the rotary bodies by another drive force, not the drive force of the drive motor (described later). Arrows I and II indicate a direction in which the hopper 5 is pivotable.

When the ratchet gear 41 is pivoted in a direction indicated by an arrow VI from a state shown in FIG. 7, the engagement of the cams 6 with the cam followers 7 is removed as seen from a change from the state of FIG. 7 to a state of FIG. 8. The hopper 5 is swung in a direction in which it is pressed against the sheet feeding roller 3 by an urging force of the hopper spring 8 (a direction indicated by an arrow I in FIG. 7). That is, in this state, the urging force acts on between the sheet feeding roller 3 and the hopper 5, but does not act on between the cams 6 and the cam followers 7. As a result, the recording sheet P set on the hopper 5 is pressed on the sheet feeding roller 3, and the feeding of the uppermost recording sheet P starts with rotation of the sheet feeding roller 3. Also at this time, the carriage 23 (FIG. 1) disengages from the clutch lever 33, so that the hook part 33*a* advances again to the clutch member 43 by the urging force of the tension spring 53.

When the ratchet gear 41 is further rotated, the cams 6 and the cam followers 7 start to engage again as shown in FIG. 9, the hopper 5 is caused to be pivoted in a direction in which it separates from the sheet feeding roller 3 (a direction indicated by an arrow II in FIG. 7), and the clutch engaging part 43*d* engages with the hook part 33*a*. When the ratchet gear 41 is further rotated from a state shown in FIG. 9, the teeth of the ratchet gear 41 push aside the gear part 43*a*, so that the clutch member 43 is pivoted in a direction indicated by an arrow VII in FIG. 9. A recessed part 6*b* is formed on a cam surface (arcuate surface) 6*a* of the cam 6. At a time point where the engagement of the clutch engaging part 43*d* with the hook part 33*a* starts, the cam follower 7 is in pressing contact with the gentle arcuate surface of the cam surface 6*a*. In this sate, the urging force does not act on between the sheet feeding roller 3 and the hopper 5, but acts on between the cams 6 and the cam follower 7.

When the ratchet gear 41 is further rotated, and as shown in FIG. 10, the ratchet gear 41 and the gear part 43*a* are put in a disengaged state through the pivoting operation of the clutch member 43 at the same time that the cam follower 7 moves near the recessed part 6*b* of the cams 6, and the ratchet gear 41 is freely rotatable in either direction as indicated by arrows VIII. That is, the clutch device 31 is in an inactive state, and a rotational force of the ratchet gear 41 is not transferred to the clutch member 43, and hence, the sheet feeding roller 3 is not rotated. Accordingly, even if the transporting roller 17 (FIG. 2) having the same drive source (drive motor) as of the sheet feeding roller 3 is rotated in either direction, the sheet feeder 1 is not affected by its rotation.

Since the clutch device 31 is in an inactive state, the spur gear 39, the sheet feeding roller gear 35 and the rotary shaft 2 will not be rotated on and after this time point, in principle. In this state, the gear part 43*a* is pushed aside by the ratchet gear 41 and moved apart from the teeth of the ratchet gear 41. Accordingly, it is on the verge of contacting with the teeth of the ratchet gear 41, viz., it is located (at a position) very close to the teeth. In some case, a collision sound (abnormal noise) will be generated with the rotation of the ratchet gear 41.

As stated above, the recessed part 6*b* is formed on the cam surface of the cams 6, and the cam follower 7 is in pressing contact with the cams 6 under the urging force by the hopper spring 8. In the state shown in FIG. 10, the cam follower 7 is very close to the recessed part 6*b*. Accordingly, if the transmission force from the ratchet gear 41 is interrupted, the cam follower 7 moves into (fits into) the recessed part 6*b* as seen from a change from the state of FIG. 10 to the state of FIG. 11 to thereby turn the rotary shaft 2 by a predetermined angular quantity (slightly).

In turn, the sheet feeding roller gear 35 and the spur gear 39 are pivoted by a predetermined angular quantity (slightly). In FIG. 10, an arrow I' and arrows indicated by dashed lines indicate a direction in which the cam follower 7 fits into the recessed part 6*b* and the hopper 5 is slightly pivoted. Arrows III' and IV' and arrows of dashed lines indicate directions in which the cam follower 7 fits into the recessed part 6*b* and the sheet feeding roller gear 35 and the spur gear 39 are resultantly pivoted by a predetermined angular quantity (slightly).

As for the clutch member 43, when the spur gear 39 is slightly rotated, only the receiving hole 43*b* is slightly moved together with the spur gear 39 since the hook part 33*a* engages with the clutch engaging part 43*d*. Accordingly, the clutch member 43 is slightly pivoted in a direction of an arrow VII' indicated by dashed lines. In turn, as shown in FIG. 11, the gear part 43*a* further moves away from the ratchet gear 41, the state that the gear part 43*a* is on the verge of contacting with the teeth of the ratchet gear 41 is removed, and even if the ratchet gear 41 is pivoted, the collision sound (abnormal sound) is not generated.

That is, the clutch device 31 is constructed such that the recessed part 6*b* is formed on the cam 6, and the cam follower 7 fits into the recessed part 6*b* to thereby turn the rotary shaft 2 slightly. Therefore, the engaged state of the ratchet gear 41 and the gear part 43*a* is readily and reliably removed by utilizing the existing constituent elements, with a simple construction and no need of complicated controls. Therefore, when the clutch device 31 is in an inactive state, there is no chance that the ratchet gear 41 contacts with the gear part 43*a* to generate a collision sound (abnormal sound), even if the ratchet gear 41 is pivoted in either direction.

Figure 12:
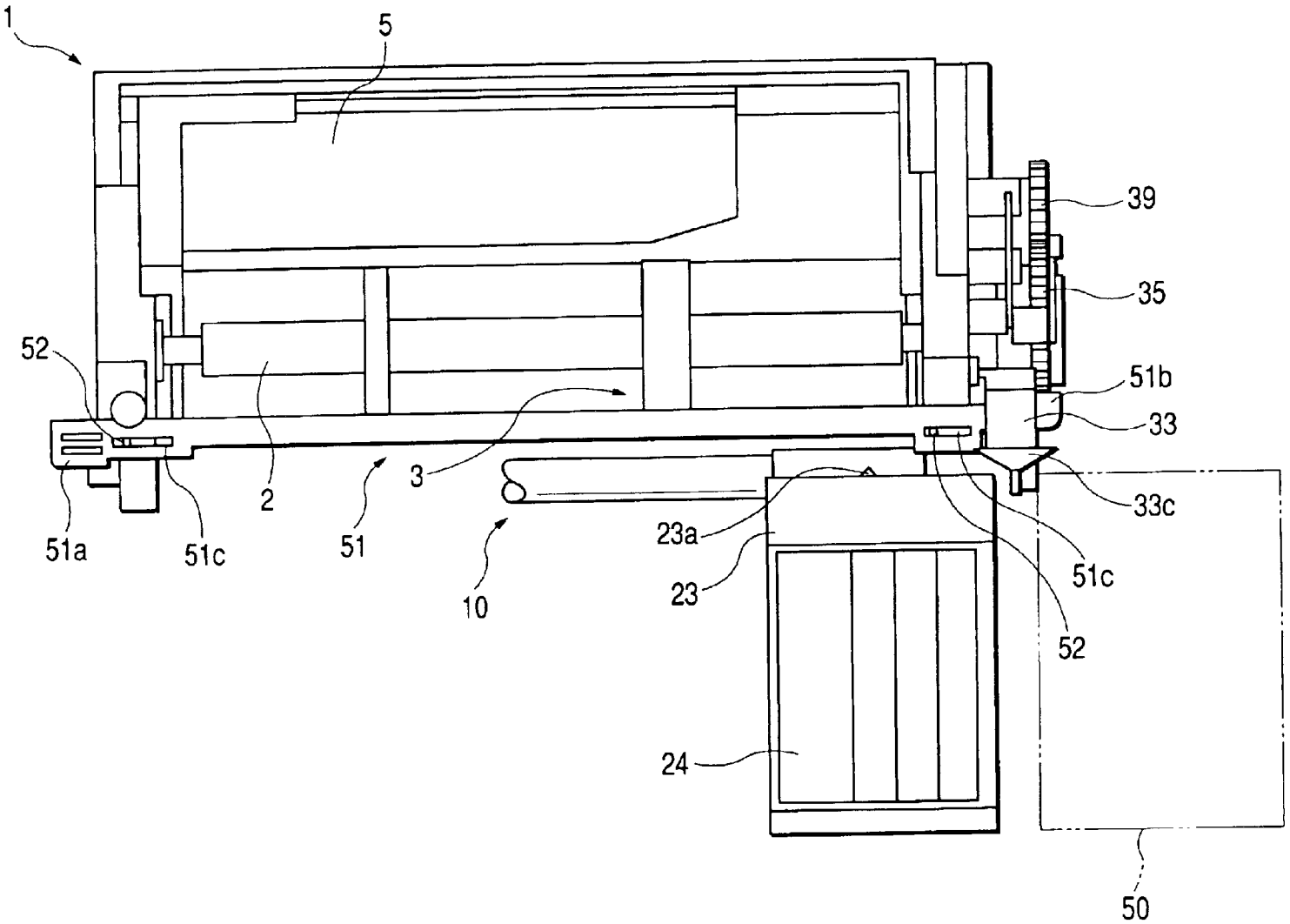
FIG. 12 is a plan view showing triggers disposed both sides of a recording region of the ink jet printer.
Figure 13:
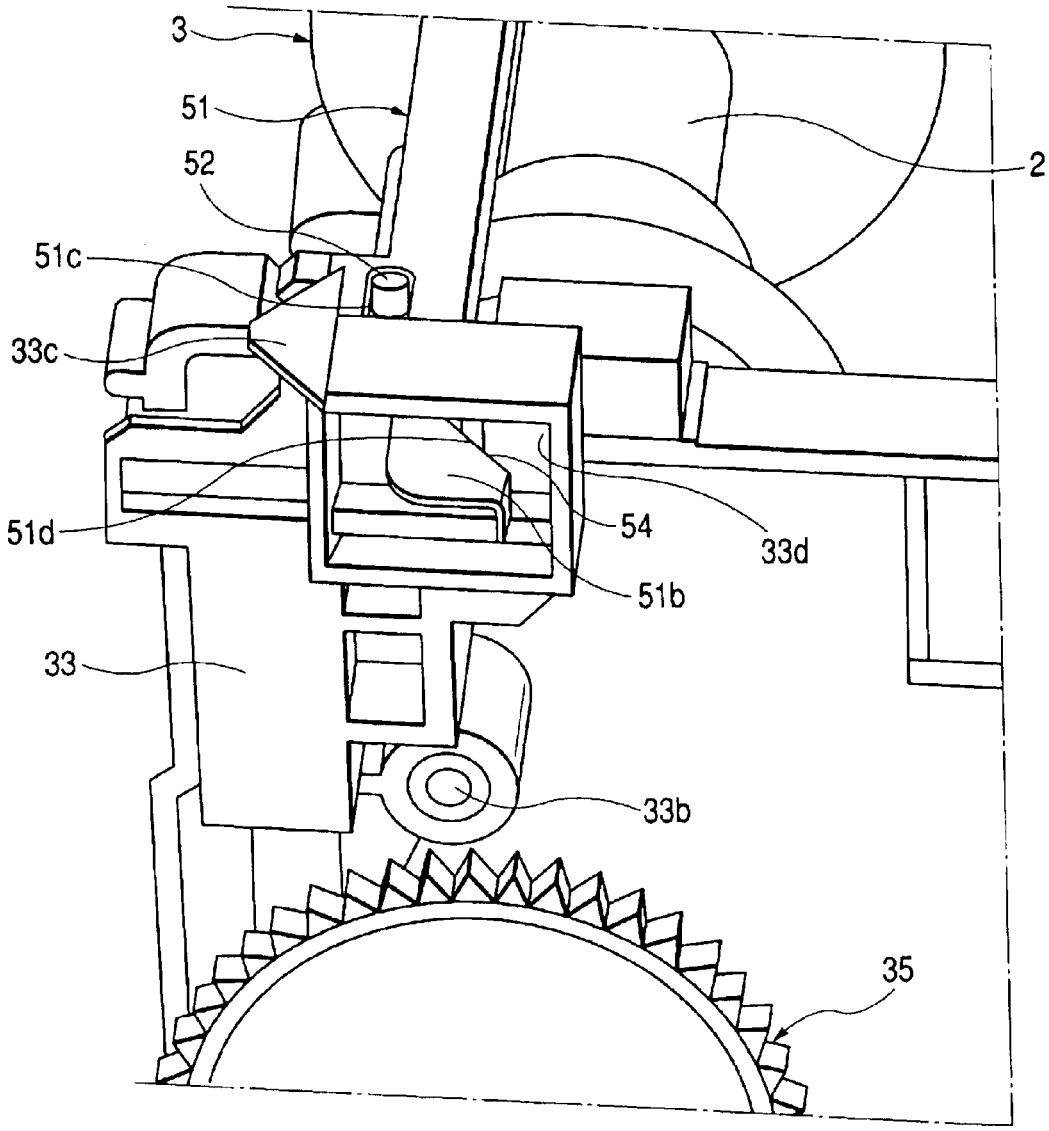
FIG. 13 is an enlarged view showing an engaging part of a clutch lever and a link member in the ink jet printer.
Figure 14:
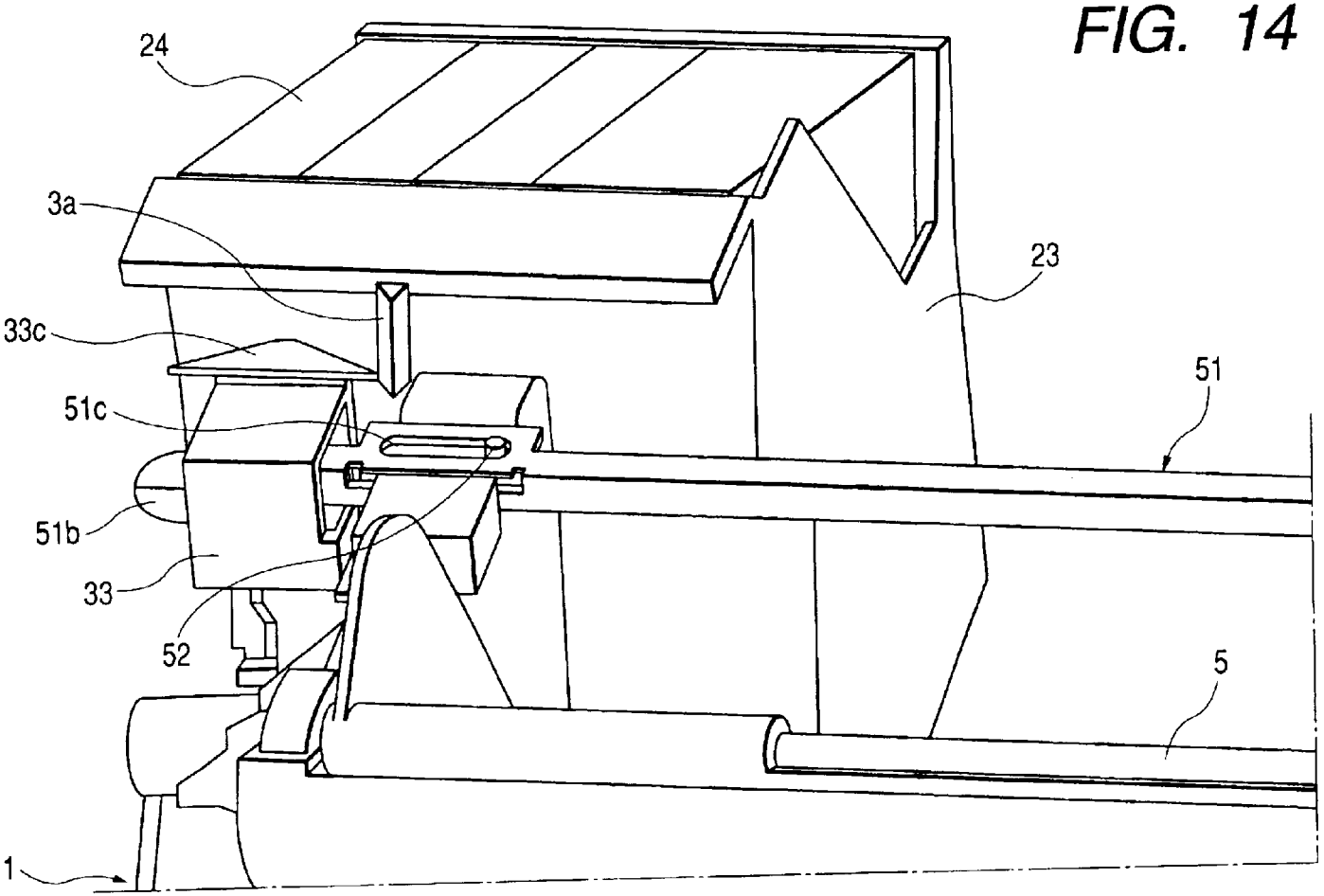
FIG. 14 is an enlarged view showing a carriage and a second trigger in the ink jet printer.
Figure 15:
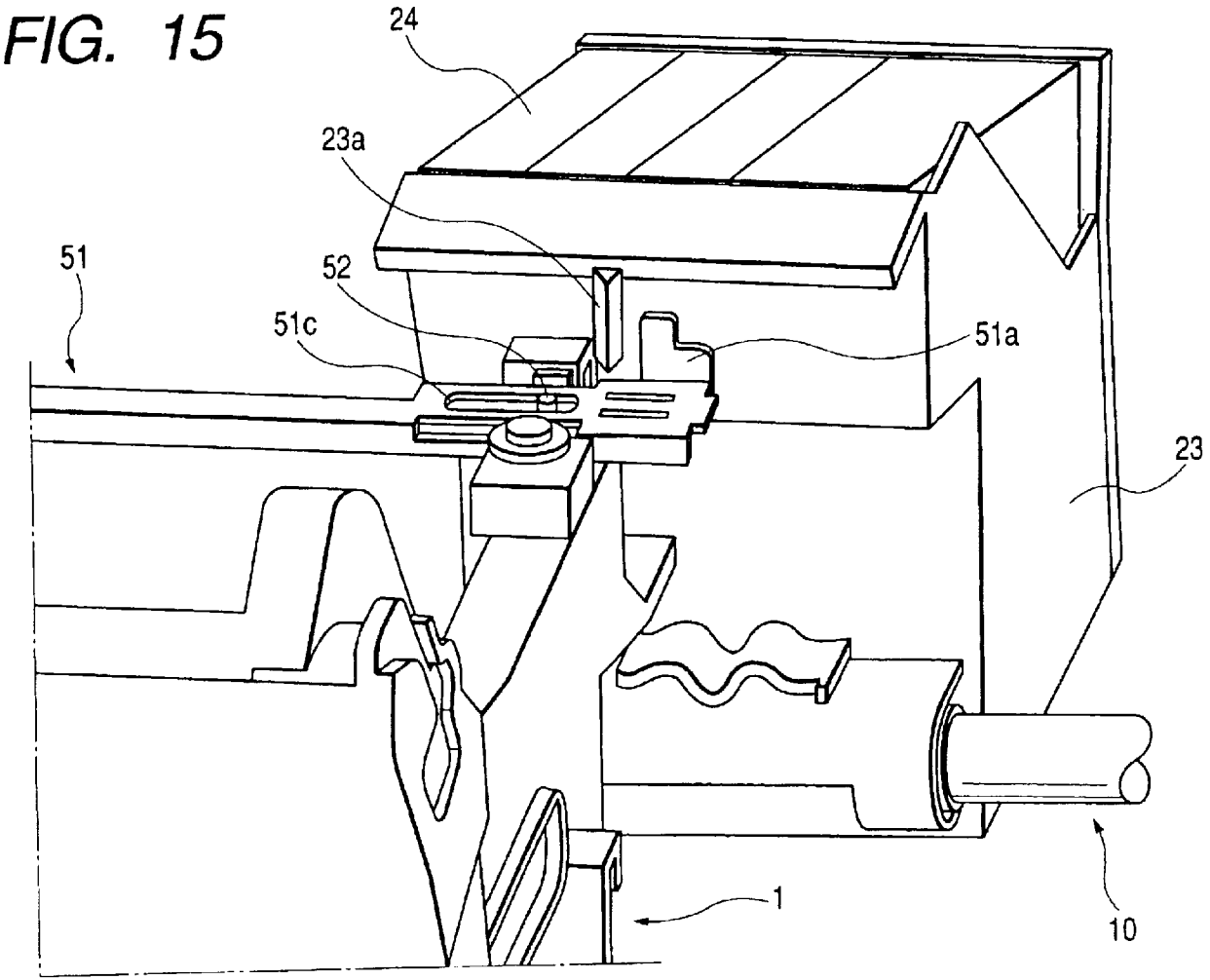
FIG. 15 is an enlarged view showing the carriage and a first trigger in the ink jet printer.

The construction and operation of the ink jet printer 100 when only the clutch lever 33 is used as a trigger to turn on and off the rotation drive of the sheet feeding roller 3 are as described above. A case where two triggers are provided on both sides of the recording region, will be described with reference to FIGS. 12 to 15. FIG. 12 is a plan view showing a recording apparatus having two triggers to turn on and off the rotation drive for the sheet feeder, which the two triggers are provided at both ends of the sheet feeder which are located outside the recording region. FIG. 13 is an enlarged perspective view showing an essential portion of the recording apparatus, that is, an engaging part of the clutch lever 33 and a link member. FIG. 14 is a perspective view showing an essential portion of the recording apparatus in which the carriage 23 is located at a position just before the carriage engages with one of those two triggers. FIG. 15 is a perspective view showing an essential portion of the recording apparatus in which the carriage is located at a position just before the carriage engages with the other one of those two triggers.

As shown in FIG. 12, the clutch lever 33 is located at one end of the sheet feeder in the main scanning direction (the home position, i.e., a reference position in the printing). And, a link member 51 extends to reach both sides of the sheet feeder in the main scanning direction. Specifically, the link member extends over the entire recording region in parallel with the carriage guide shaft 10, and may be interlocked with the clutch lever 33. In the embodiment, by the operation of the carriage 23, of the two triggers to turn on and off the rotation drive of the sheet feeding roller 3, a first trigger 51*a* which is positioned on the opposite side of the clutch lever 33, is provided at one end of the link member 51. The other trigger, or a second trigger 33*c*, which is located on the clutch lever 33 side, is provided at an upper part of the clutch lever 33.

Thus, the first trigger 51*a* located on the side opposite to the clutch lever 33 is provided on the link member 51 which may be interlocked with the clutch lever 33. The first trigger 51*a*, which is located remote from the clutch lever 33, may be provided with a simple construction, and an increase of the number of parts can be avoided. Further, the second trigger 33*c* is provided on the existing clutch lever 33 per se. Therefore, the second trigger 33*c* may be installed without increasing the number of parts. Since there is no necessity of providing the second trigger 33*c* on the link member 51, the function of the first trigger 51*a* may be realized with a simple structure.

In the specification, the word "interlock" involves the following two cases: a first case is that the link member 51 is integrally formed with the clutch lever 33 and those elements operate as a single member, and a second case is that both the members are separately formed, and operate in an interlocking manner by an interlocking mechanism as in the embodiment (described in detail later).

In the embodiment, the clutch lever 33 is pivoted about the rotary shaft 33*b*, so that the hook part 33*a* is movable with respect to the outer periphery of the clutch member 43, and an upper part of the clutch lever 33 serves as the second trigger 33*c*. The clutch lever 33 is provided with the tension spring 53 (FIGS. 4 and 16) for urging and pressing the hook part 33*a* against the outer periphery of the clutch member 43. The link member 51 is slidable in the main scanning direction. The carriage 23 moves to and abuts on the first trigger 51*a*, and the link member 51 moves in a direction opposite to the clutch lever 33. With the movement of the link member, the clutch lever 33 is pivoted, and the hook part 33*a* retracts from the clutch engaging part 43*d*.

A relationship among the clutch lever 33, the link member 51 and the tension spring 53 will be described in more detail. Sliding grooves 51*c* (a total of two grooves) are provided at both ends of the link member 51. Those grooves loosely receive projections 52 formed on the main body of the sheet feeder 1 so as to allow a sliding motion relative to the sheet feeder 1. The carriage 23 is provided with a protrusion 23*a* operable to engage with the first trigger 51*a* of the link member 51 and the second trigger 33*c* of the clutch lever 33.

As shown in FIG. 13, for a lever engaging part 51*b* as a part engaging with an upper part of the clutch lever 33, a tapered part 51*d* gradually increasing its width while being away from the recording region, comes in contact with a plate-shaped contact part 33*d* protruding to the tapered part 51*d* at a contact point 54, whereby force is mutually transmitted between them, so that the link member 51 and the clutch lever 33 move backward. In a state that the protrusion 23*a* of the carriage 23 does not engage with the first trigger 51*a* and the second trigger 33*c*, the hook part 33*a* of the clutch lever 33 is urged to the outer periphery of the clutch member 43 by the urging force of the tension spring 53.

In this state, the contact part 33*d* of the clutch lever 33 pushes the tapered part 51*d* of the link member 51. The link member 51 slides such that the lever engaging part 51*b* moves away from the recording region (to the right direction in FIG. 12), and the contact point 54 between the contact part 33*d* and the tapered part 51*d* is stably positioned at a portion where the tapered part 51*d* is narrowed.

By the moving operation of the carriage 23, the protrusion 23*a* pushes the first trigger 51*a* positioned at one end of the link member 51 in a direction in which it moves apart from the recording region (to the left in FIG. 12), to thereby slide the link member 51. At this time, the lever engaging part 51*b* provided at the other end of the link member 51 also moves together with the link member 51. Through the sliding operation, the tapered part 51*d* pushes the contact part 33*d* of the clutch lever 33, and the contact point 54 between the contact part 33*d* and the tapered part 51*d* displaces to a widened portion of the tapered part 51*d*, and the clutch lever 33 pivots about the rotary shaft 33*b* in a direction in which the hook part 33*a* retracts from the outer periphery of the clutch member 43.

That is, the protrusion 23*a* of the carriage 23 is pressingly abutted against either of the second trigger 33*c* of the clutch lever 33 or the first trigger 51*a* of the link member 51, whereby the rotation drive of the sheet feeding roller 3 may be turned on and off. Accordingly, both of them serve as triggers to turn on and off the rotation drive of the sheet feeding roller 3.

Since the first trigger 51*a* and the second trigger 33*c* are disposed on both sides of the recording region, a maximum distance of movement of the carriage 23 when it reaches the trigger to turn on and off the rotation drive of the sheet feeding roller 3, may be reduced half when comparing with a case where the trigger is disposed only on one side of the recording region. Accordingly, the throughput of the recording process including the sheet feeding process may be improved.

The link member 51 is slidable, and the carriage 23 is pressingly abutted against the first trigger 51*a*, whereby the clutch device is operated. At this time, a tension force act on the link member 51 in the longitudinal direction of the link member 51, and there is no need that it receives a force vertical to the tension force is present. Accordingly, a member of a relatively low stiffness may be used for the link member 51. A thin wire, for example, may be used if it is able to withstand the tension force applied.

An operation control when the carriage 23 passes a trigger position though there is no need of feeding sheets, will be described. When a stand-by position 50 of the carriage 23 is located outside the second trigger 33*c* as shown in FIG. 12, there is a case that the carriage 23 passes the trigger position through there is no need of sheet feeding, for example, when the carriage 23 is operated for its initializing, when the nozzle orifices are cleaned, and when the carriage 23 is merely returned to the stand-by position 50. In such a case, it is necessary to avoid unnecessary sheet feeding operation and to eliminate the useless sheet feeding process.

Figure 16:
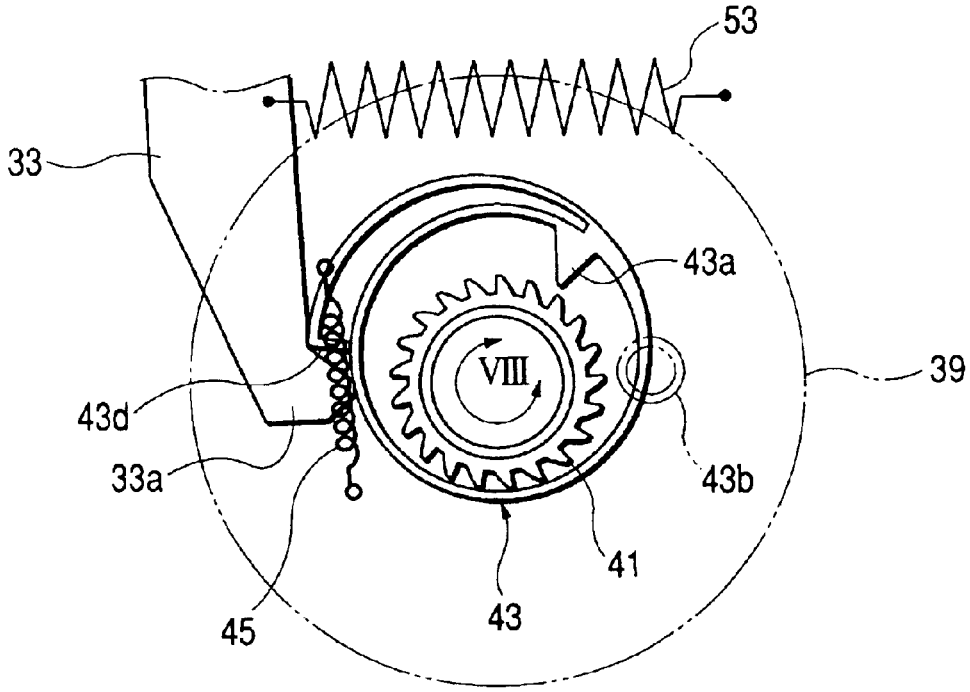
FIG. 16 is a view showing the clutch device in a clutch engaged state.
Figure 17:
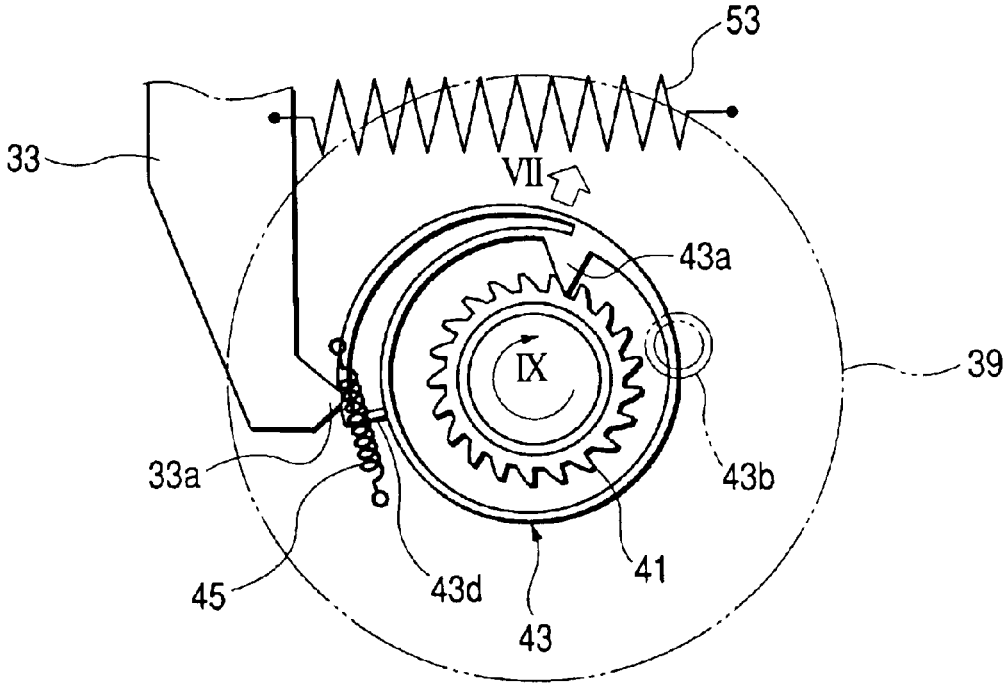
FIG. 17 is a view showing the clutch device in a clutch disengaged state.
Figure 18:
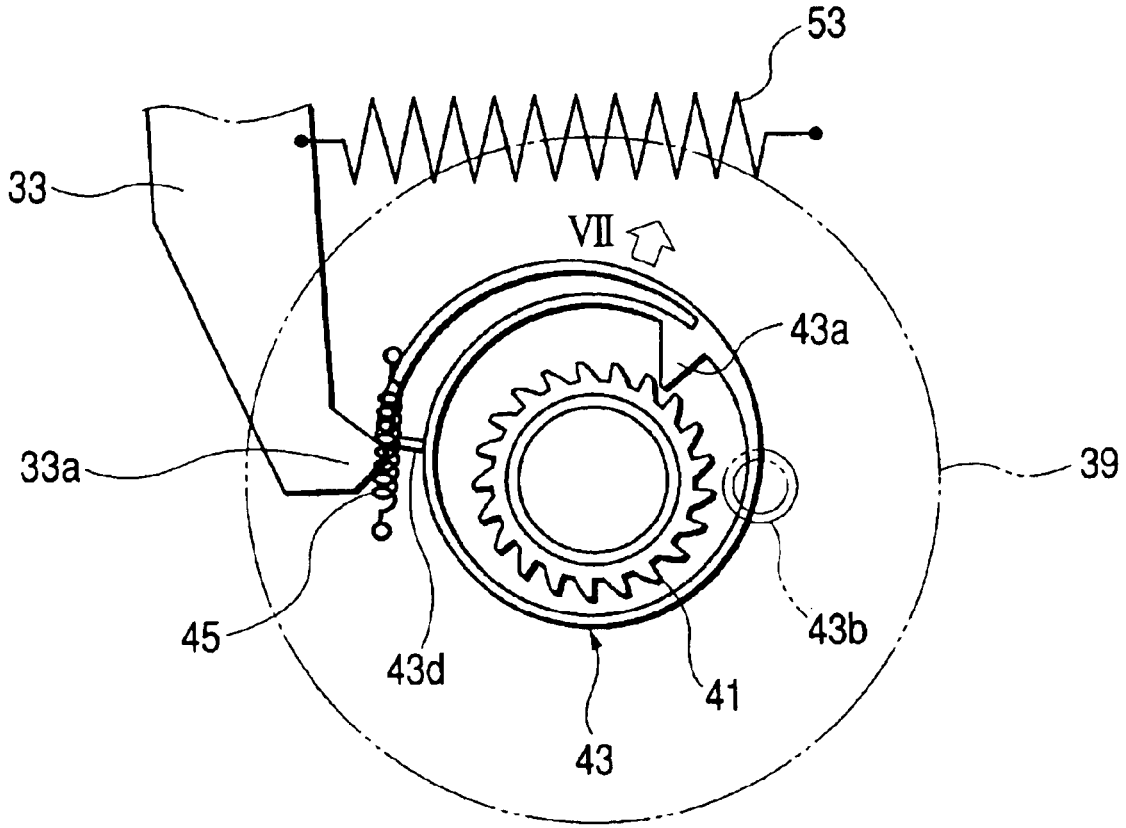
FIG. 18 is a view showing a state that the clutch lever lifts up a clutch member in the clutch device.

The operation control to avoid the execution of the sheet feeding process when the carriage 23 passes the trigger position though there is no need of sheet feeding, will be described with reference to FIGS. 16 to 18. FIG. 16 is a front view of the clutch device 31 showing a clutch engaged state of the clutch device (power transmission "off" state; the protrusion 23*a* of the carriage 23 is not in engagement with the triggers 33*c* and 51*a*). FIG. 17 is a front view of the clutch device 31 showing a state of the clutch device just after its state leaves the clutch engaged state (power transmission "on" state; the protrusion 23*a* of the carriage 23 is in engagement with the triggers 33*c* and 51*a*). FIG. 18 is a front view of the clutch device 31 showing a state that the clutch lever 33 of the clutch device 31 lifts up the clutch member 43.

In the state shown in FIG. 16, the sheet feeding process is finished, the carriage 23 is retracted from a position for engaging with the second trigger 33*c* of the clutch lever 33 or the first trigger 51*a* of the link member 51 for the sheet feeding operation, and the hook part 33*a* is urged to the clutch member 43 by the tension spring 53 provided in the lower part of the rotary shaft 33*b* of the clutch lever 33. The spring 53 is designed to be capable of storing a tension force high enough to disengage the gear part 43*a* of the clutch member 43 from the ratchet gear 41. Accordingly, by its urging force, the clutch engaging part 43*d* is lifted up to an upper part of the slanted surface of the hook part 33*a*.

At this time, when the carriage 23 is pressingly abutted again on either of the second trigger 33*c* or the first trigger 51*a* (the second trigger 33*c* in the case of FIG. 12), the clutch lever 33 is pivoted as shown in FIG. 17. Then, the hook part 33*a* of the clutch lever 33 disengages from the clutch engaging part 43*d* of the clutch member 43, and the gear part 43*a* of the clutch member 43 approaches the ratchet gear 41 and abuts on or comes in contact with the ratchet gear 41 by the tension force stored in the tension coiled spring 45.

Normally, as described above, the ratchet gear 41 is pivoted counterclockwise in FIG. 17 to execute the sheet feeding process. However, to avoid the sheet feeding process, in the invention, in such a case, the ratchet gear 41 is pivoted, by a predetermined angular quantity, clockwise (an arrow IX in FIG. 17), in response to a control signal from a controller (not shown). Resultantly, the clutch member 43 is pivoted about the receiving hole 43*b* in a direction of an arrow VII in FIG. 17, and the clutch engaging part 43*d* is lifted.

Where the carriage 23 having been pressed against the second trigger 33*c* or the first trigger 51*a* (the second trigger 33*c* in the example of FIG. 12) retracts to a position where it is not in engagement with the second trigger 33*c* or the sliding grooves 51*c*, the clutch lever 33 is pivoted by the tension force stored in the tension spring 53, the hook part 33*a* advances to the outer periphery of the clutch member 43, and the slanted surface provided on the hook part 33*a* abuts on the clutch engaging part 43*d* as shown in FIG. 18.

The spring 53 is designed to be capable of storing a spring force high enough to disengage the gear part 43*a* of the clutch member 43 from the ratchet gear 41. Accordingly, by its urging force, the slanted surface of the hook part 33*a* lifts up the clutch engaging part 43*d* to an upper part thereof so that the engaging state quickly returns to a clutch engaging state.

Through this sequence of operations, even if the hook part 33*a* and the clutch engaging part 43*d* are disengaged from each other, they are restored to the clutch engaging state without performing one rotation of the sheet feeding roller 3.

A second embodiment of the invention will be described below. The sheet feeding roller 3, which is driven to rotate by a drive motor 167 (FIG. 20, described layer), is shaped like D in side view, and includes a roller body 3*a* and a rubber material 3*b* wound on an outer peripheral surface of the roller body 3*a*. The sheet feeding roller 3 feeds a recording sheet P by use of its arcuate part, and allows the recording sheet P to pass there by use of its flat part to thereby impart no transport load to a downstream transporting roller 17 disposed in the downstream side when it is in a transporting operation.

The hopper 5 is formed with a plate-like member, and as shown, it is provided taking a slanted posture. Further, it may be pivoted about a rotary shaft 5*a* provided in an upper part, clockwise and counterclockwise in FIG. 19. When the hopper is pivoted by a cam mechanism to be described later, the lower end of the hopper is brought into pressing contact with the sheet feeding roller 3 and separated from the same. When the hopper 5 is pivoted in a direction in which the hopper is brought into pressing contact with the sheet feeding roller 3, a bundle of recording sheets P stacked on the hopper 5 is put in pressing contact with the sheet feeding roller 3. In this state, the uppermost recording sheet P of the sheet stack is fed to the downstream side by rotating the sheet feeding roller 3.

The separation pad 4 is made of a high friction material, and provided at a position where it faces the sheet feeding roller 3. When the sheet feeding roller 3 is rotated, the arcuate part of the sheet feeding roller 3 is brought into pressing contact with the separation pad 4 to thereby form a pressing contact part (nipping part). The uppermost recording sheet P that is fed out by the arcuate part of the sheet feeding roller 3 passes the pressing part and advances to the downstream side. The next recording sheet P and the subsequent ones, which will advance to the downstream while being taken by the uppermost recording sheet P, are blocked in their advancing by the pressing part, whereby the multi-feeding of the recording sheets P is prevented.

The separation pad 4 may be substituted by another multi-feed preventing member, such as a retard roller. When the retard roller is used, the sheet feeding roller 3 used may be circular in side view.

Figure 19:
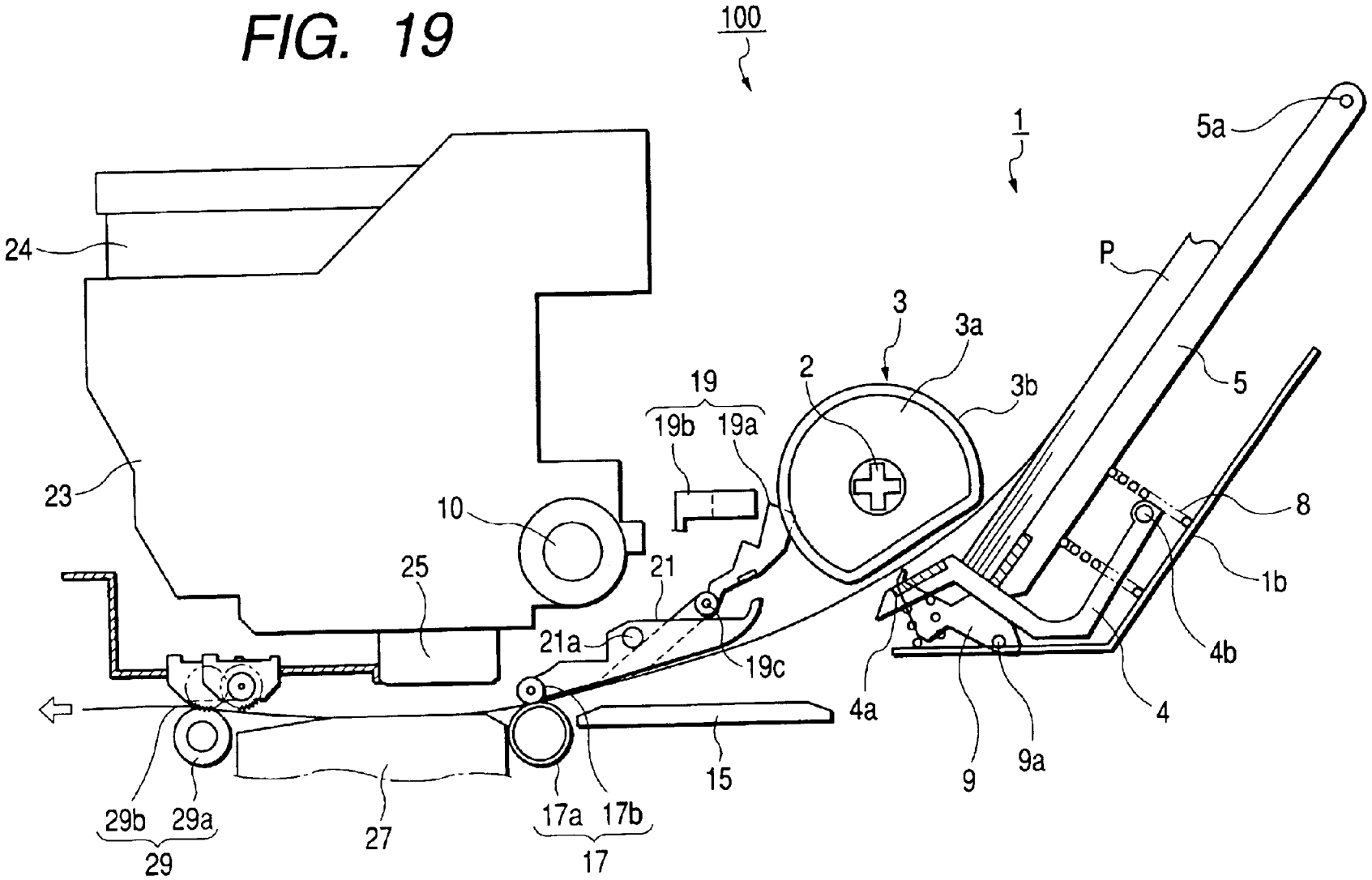
FIG. 19 is a schematic section view of an ink jet printer according to a second embodiment of the invention.

The sheet returning lever 9, which is shaped like a lever, and disposed near the lower end of the hopper 5, may be pivoted about a supporting point 9*a* by a drive mechanism (not shown), clockwise and counterclockwise in FIG. 19. In a feeding operation of the recording sheet P, the sheet returning lever 9 is pivoted to the downstream side as shown in FIG. 19, and does not hinder the feeding operation of the recording sheet P. When the feeding of the recording sheet P starts and the leading end of the recording sheet P advances to the downstream side of the sheet returning lever 9, the sheet returning lever 9 rises toward the upstream side, and pushes back to the upstream side the next recording sheets P and the subsequent ones, which are taken by the fed recording sheet P and on the verge of multi-feeding. With the pushing back action, the multi-feeding of the recording sheets P is more securely prevented. More detailed operations of the sheet feeding roller 3, the hopper 5 and the sheet returning lever 9 will be described later.

Other members shown in FIG. 19, which are designated by like reference numerals used in FIG. 2, are substantially the same as those described referring to FIG. 2, and hence, no further description of them will be given here.

Figure 20:
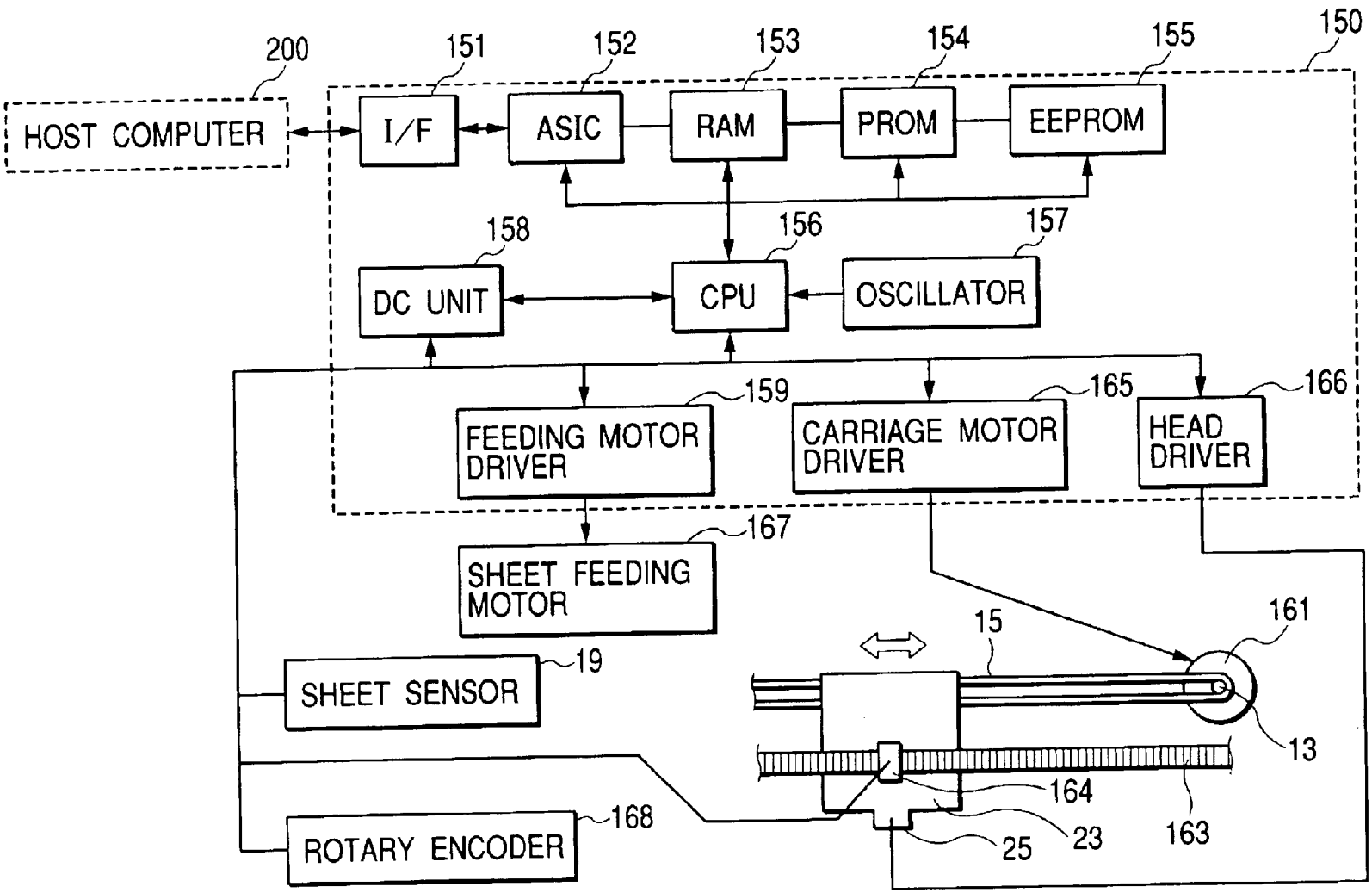
FIG. 20 is a block diagram of a controller in the ink jet printer of FIG. 19.

An arrangement of a controller 150 of the printer 100 will be described below with reference to FIG. 20. The controller 150 is able to communicate data with a host computer 200 for transmitting print information to the printer 100. The controller is made up of an interface part (abbreviated as "I/F") 151 which is an interface between the controller 150 and the host computer 200, an ASIC 152, a RAM 153, a PROM 154, an EEPROM 155, a CPU 156, oscillator 157, a DC unit 158, a feeding motor driver 159, a carriage motor driver 165, and a head driver 166.

The CPU 156 performs arithmetic operations for executing a control program for the printer 100 and other necessary arithmetic operations. The oscillator 157 generates periodical interrupt signals necessary for various processing for transmission to the CPU 156. The ASIC 152 controls print resolutions, drive waveforms for the recording head 25 or the like in accordance with print data coming from the host computer 200 via the I/F 151. The RAM 153 is used for work areas by the ASIC 152 and the CPU 156, and a primary storage area for other data. A control program (firmware) necessary for controlling the printer 100 and data necessary for processing are stored in the PROM 154 and the EEPROM 155.

The feeding motor driver 159 drives and controls the sheet feeding motor 167 under control by the DC unit 158, and rotates a plurality of objects to be driven to rotate, i.e., the sheet feeding roller 3, the drive roller 17*a* and the drive roller 29*a*. The carriage motor driver 165 drives and controls a carriage motor 161 under control of the DC unit 158, and reciprocatively moves the carriage 23 in the main scanning direction, and stops and holds the carriage. The head driver 166 drives and controls the ink jet recording head 25 in accordance with print data from the host computer 200, under control of the CPU 156.

The CPU 156 and the DC unit 158 receive a detect signal from the sheet sensor 19 for detecting the leasing and trailing ends or edges of a sheet P under transportation, an output signal from a rotary encoder 168 for detecting a rotation quantity of the drive roller 17*a* to be described in detail later, and an output signal from a linear encoder 164 for detecting an absolute position of the carriage 23 in the main scanning direction. The linear encoder 164 includes a code plate 163 extending in the main scanning direction, a light emitting part (not shown) for emitting light to a plurality of translucent parts arrayed in the main scanning direction in the code plate 163, and a light receiving part (not shown) for receiving light as passed through the translucent parts. The linear encoder outputs leading edge signals and trailing edge signals, which are formed by light passing through the translucent parts, and detects an absolute position of the carriage 23 in the main scanning direction. The rotary encoder 168 is mounted on a shaft end of the drive roller 17*a* (see FIG. 19), and thereby detects a rotation quantity (rotation angle) of the drive roller 17*a*. The controller 150 receives an output signal from the rotary encoder 168, computes a rotation quantity and a rotational speed of the drive roller 17*a*, and executes appropriate sheet-feeding controls in accordance with the computation results. Incidentally, the drive roller 17*a* is constantly driven and rotated by the sheet feeding motor 167, and this sheet feeding motor 167 also transmits power to the rotary shaft 2 (sheet feeding roller 3) shown in FIG. 19, through the clutch device 31 to be described later.

Mechanical arrangements of the sheet feeder 1 and the clutch device 31 for transmitting power of the sheet feeding motor 167 to the sheet feeder 1 will be described in detail with reference to FIGS. 21 through 37.

Figure 21:
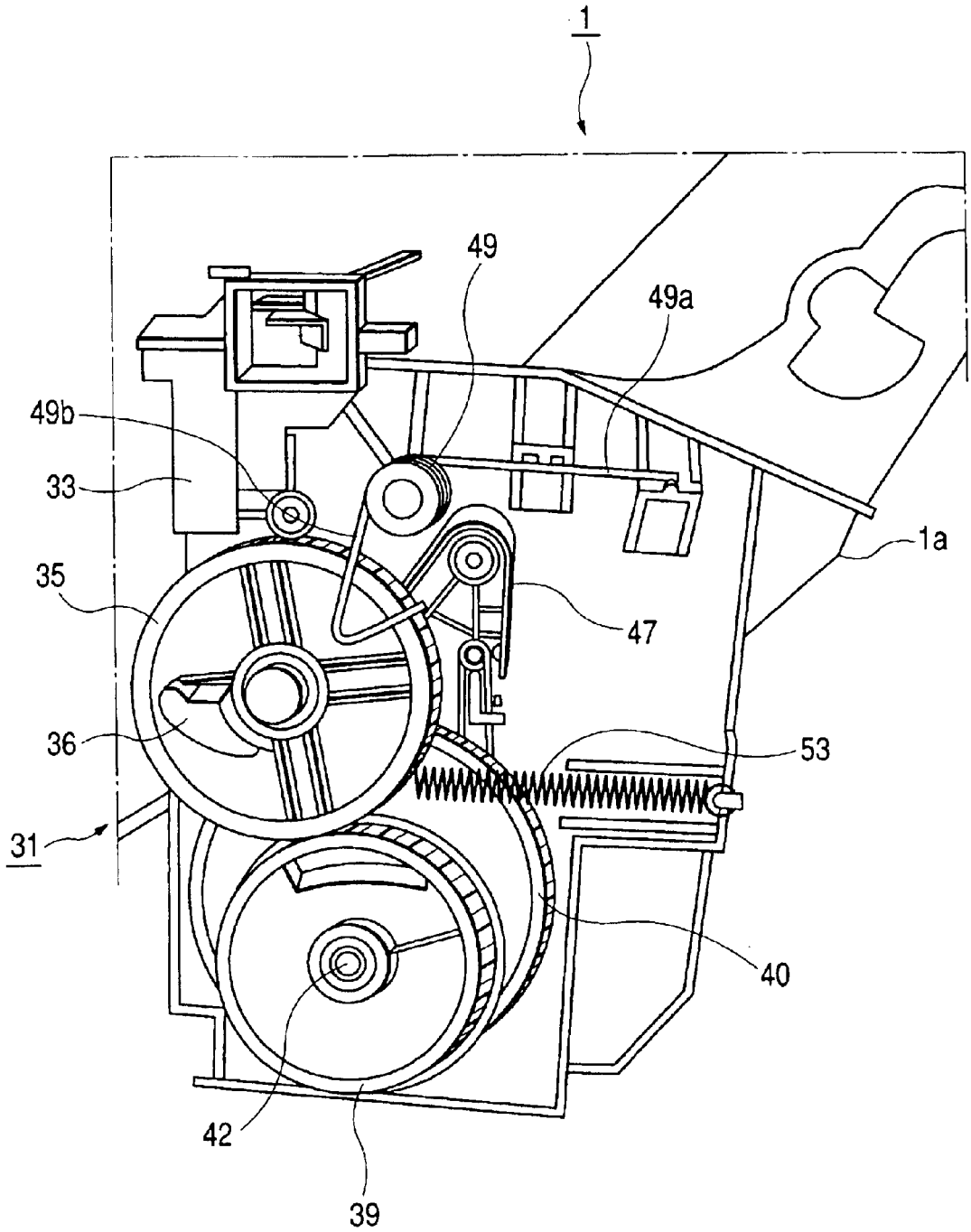
FIG. 21 is a side view showing a clutch device in the ink jet printer of FIG. 19.
Figure 22A:
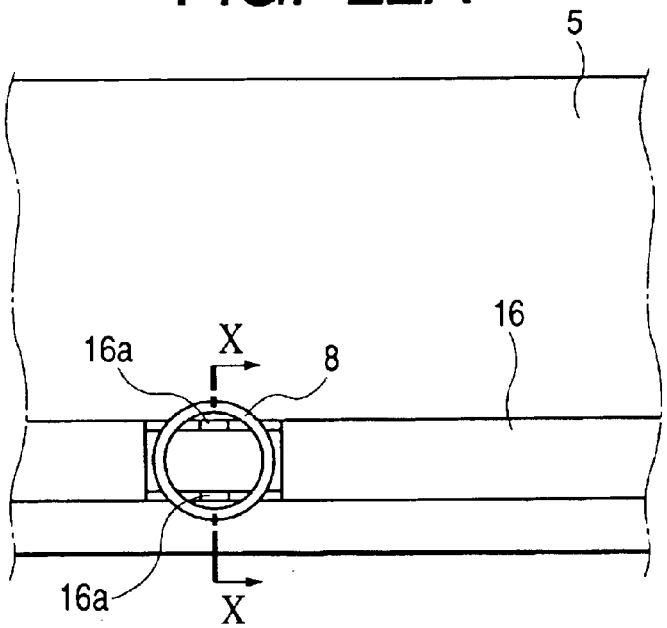
FIG. 22A is a rear view of a hopper provided with a reinforcing plate in the ink jet printer of FIG. 19.
Figure 22B:
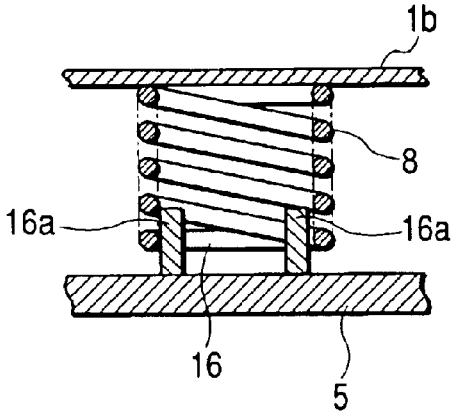
FIG. 22B is a section view taken along X—X line of FIG. 22A.

Firstly, a detailed mechanical arrangement of the sheet feeder 1 will be described hereunder with reference to FIGS. 21 through 22C. FIG. 21 is a side view of the sheet feeder 1 (front view of the clutch device 31), and FIGS. 22A to 22C are explanatory diagrams for explaining a reinforcing plate 16 provided on the hopper 5.

The sheet feeder 1, as shown in FIG. 21, includes the clutch device 31 on the right side thereof (in the home position of the printer 100: right side in FIG. 1). The clutch device 31 selects permission or prohibition of power transmission to the rotary shaft 2. The clutch device 31 transmits power from the sheet feeding motor 167 installed in the main body of the printer 100 to the rotary shaft 2. When power is transmitted to the rotary shaft 2, the sheet feeding roller 3, the hopper 5 and the sheet returning lever 9, which are shown in FIG. 19, operate with rotation of the rotary shaft 2.

A cam mechanism is similar to that as already described referring to FIG. 3. In this instance, the cams 6 and the followers 7 are operable to separate the hopper 5 from the sheet feeding roller.

The followers 7 are provided so as to press down both ends of the hopper 5. The hopper spring 8 for urging the hopper 5 toward the sheet feeding roller 3 and the cams 6 is located slight shifted to the home position (right side in FIG. 3) as shown in FIG. 22C. FIG. 22A is a rear view showing the hopper 5 when it is viewed from its rear side. FIG. 22B is a cross sectional view taken on line X—X in FIG. 22A. FIG. 22C is a schematic diagram showing positions of external forces acting on the hopper 5 when the hopper 5 is viewed from top. In FIG. 22C, reference numeral 8' indicates a position on the hopper 5 on which an urging force of the hopper spring 8 acts. Reference numeral 7' indicates positions on the hopper 5 on which depressing forces by the cams 6 acts.

Figure 22C:
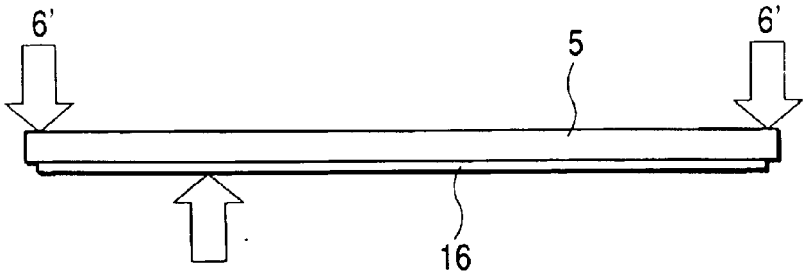
FIG. 22C is a diagram showing external forces applied on the hopper of FIG. 22A.

As shown in FIG. 22C, depressing forces 6' by the cams 6 act on both ends of the hopper 5. An urging force by the hopper spring 8 acts on a position on the hopper 5, which is slightly shifted from the center to the home position. In other words, the hopper 5 has a beam structure, and bending moments act on the hopper 5 by the hopper spring 8 and the cams 6. As a result, the hopper 5 would be gradually bent (deformed) with time passes.

To cope with this, in the embodiment, the reinforcing plate 16 is disposed on a portion of the rear side of the hopper 5 on which a spring force of the hopper spring 8 acts. The reinforcing plate 16, as shown in FIG. 22C, is a plate member extending over the entire width of the hopper 5 in the lower part thereof as shown in FIG. 22A. The reinforcing plate 16, as shown in FIG. 22B, is bent to have a shape like U to receive the bending moments. Pawls 16*a* for holding the hopper spring 8 are provided on a portion of the hopper 5 in which the hopper spring 8 is disposed. The hopper spring 8 does not directly urge the hopper 5, but indirectly urges it through the reinforcing plate 16. With this, the reinforcing plate 16 is able to receive the bending moments and hence to prevent the bending (deformation) of the hopper 5.

Subsequently, a mechanical arrangement and operation of the clutch device 31 will be described with reference to FIGS. 23 through 26B.

Figure 23:
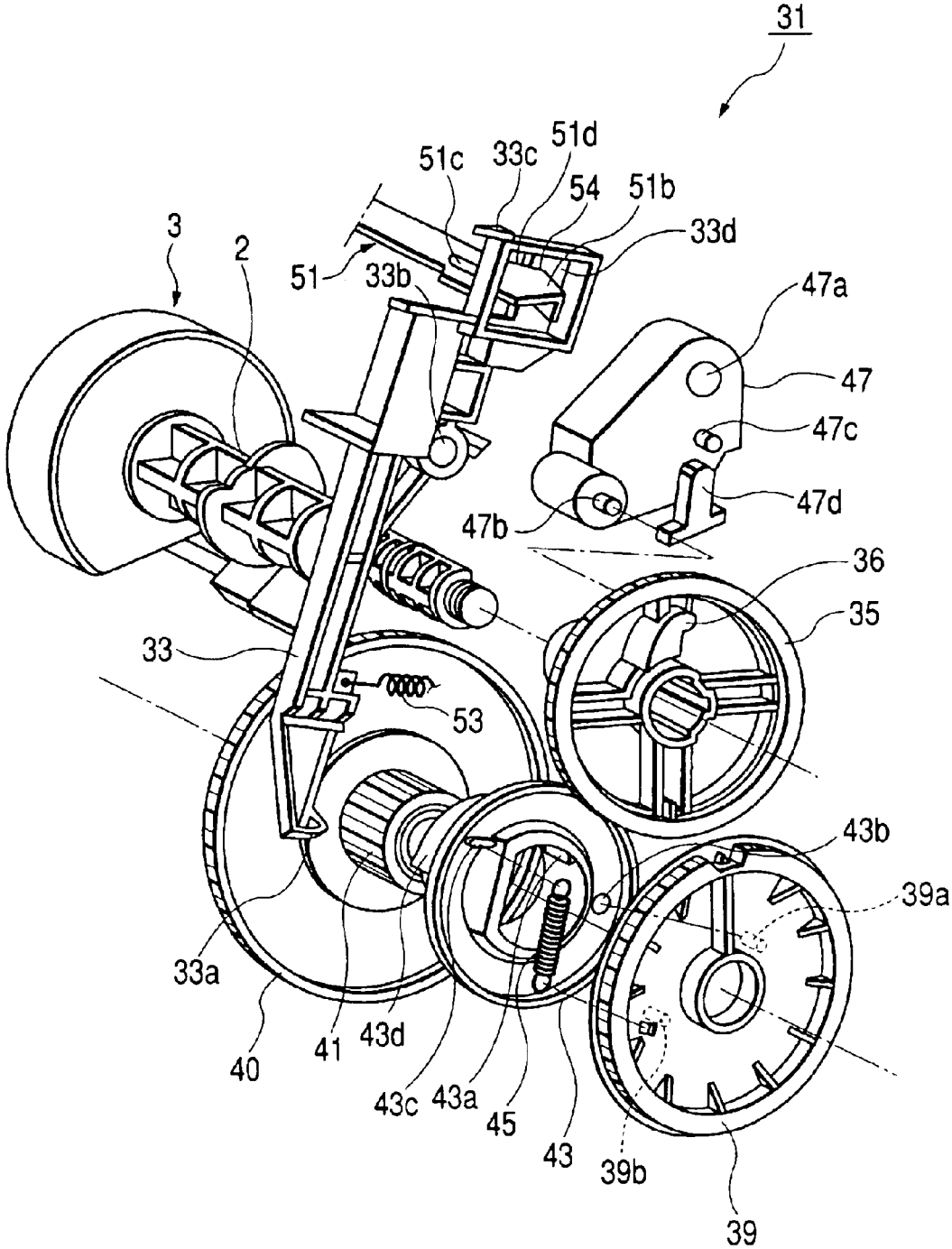
FIG. 23 is an exploded perspective view showing the clutch device of FIG. 21.

FIG. 23 is an exploded, perspective view showing the clutch device 31. As shown in this figure, the clutch device 31 includes the spur gear 40. When the sheet feeder 1 is installed to the main body of the printer 100, the spur gear 40 comes in engagement with a transmission gear (not shown) which is provided in the main body of the printer 100, and is constantly driven to rotate by the sheet feeding motor 167. Specifically, the spur gear 40 serves as an input part of inputting power to the clutch device 31. The spur gear 40 and its peripheral structure were already described referring to FIG. 4, and no further description will be given.

In the embodiment, a state that the ratchet gear 41 is in mesh with the gear part 43*a*, and resultantly a rotational force is transmitted from the sheet feeding motor 167 (see FIG. 20) to the rotary shaft 2 (state of FIG. 6A) will be referred to as an "active state" of the clutch device 31. A state that the rotational force is not transferred to the rotary shaft (state of FIG. 6B) will be referred to as an "inactive state".

Figure 24:
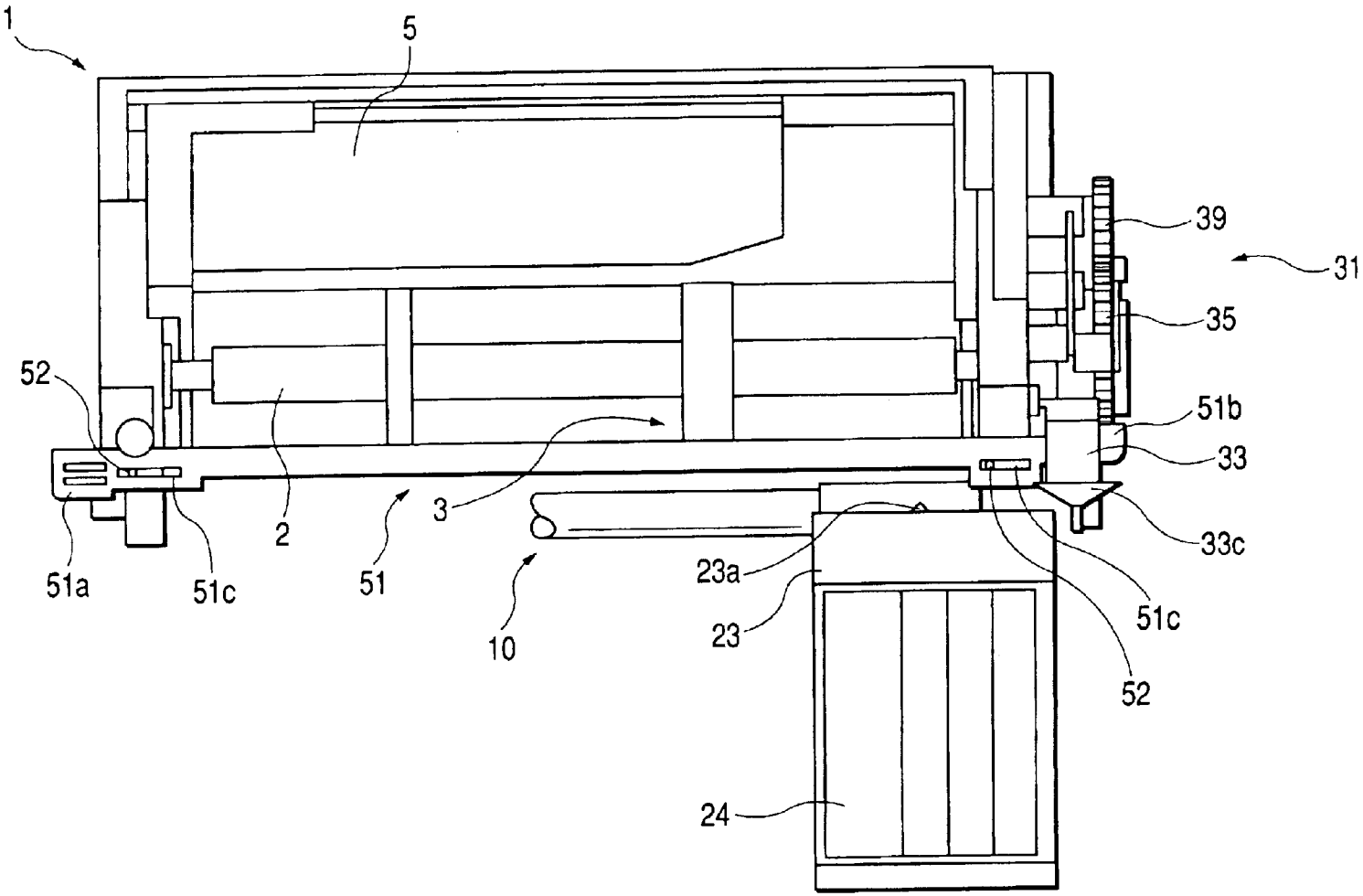
FIG. 24 is a plan view showing triggers in the ink jet printer of FIG. 19.
Figure 25:
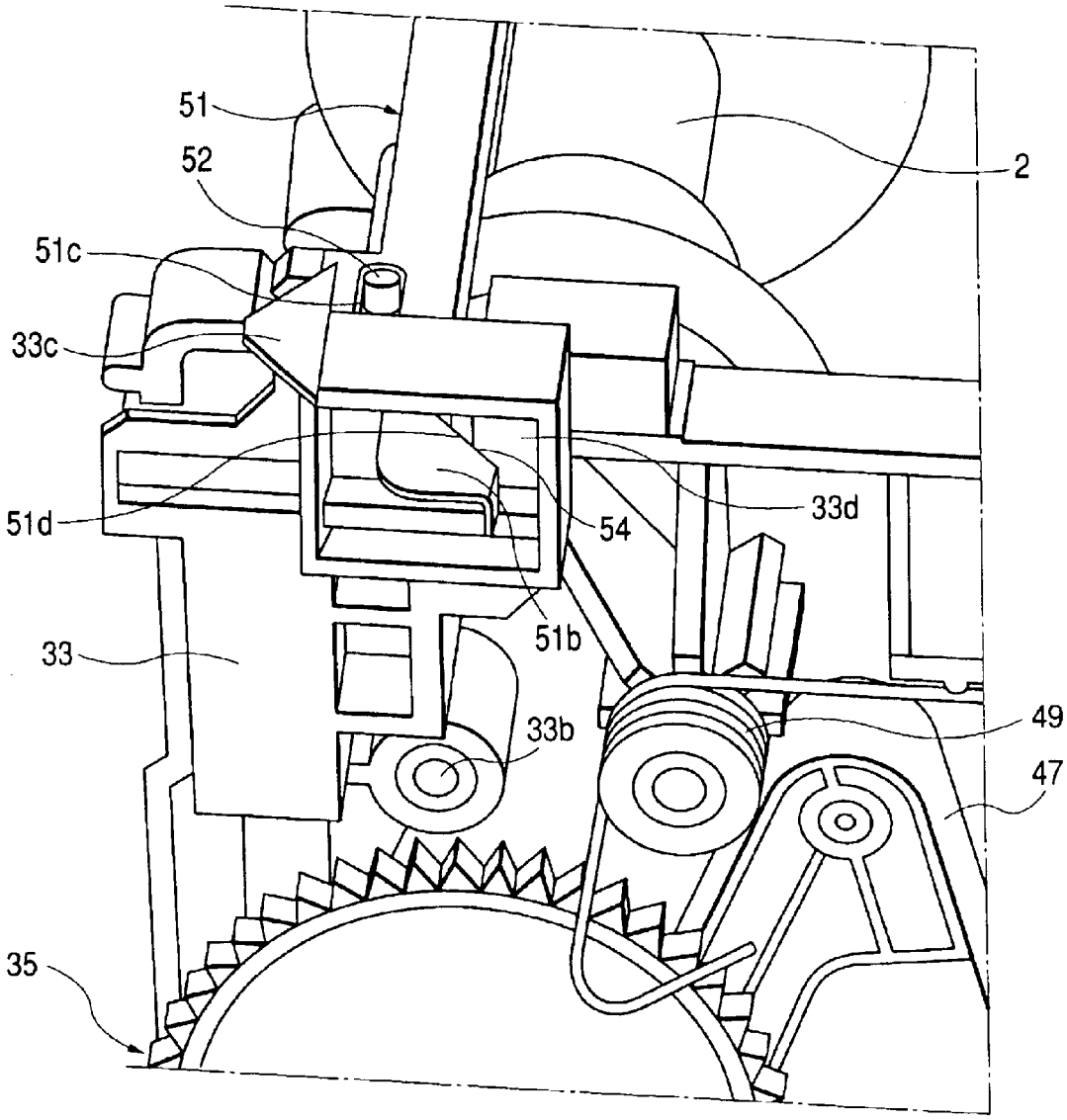
FIG. 25 is an enlarged view showing an engaging part of a clutch lever and a link member in the ink jet printer of FIG. 19.

FIG. 24 is a plan view showing the sheet feeder 1 including the carriage 23, and FIG. 25 is a partially enlarged, perspective view showing the sheet feeder 1 when it is viewed from side.

First, when the clutch device 31 is triggered by the carriage 23, it selects permission or prohibition of power transmission to the rotary shaft 2 (selects the active state or the inactive state).

More specifically, as shown in detail in FIGS. 25 and 14, the second trigger 33*c* which engages with the carriage 23 is provide at an upper part of the clutch lever 33 described above. The second trigger 33*c* is trapezoidal when viewed in plan view, and a trapezoidal slanted surface of it is directed to the carriage 23. A protrusion 23*a*, triangular in plan view, is provided on the carriage 23, while being opposed to the second trigger 33*c*. With movement of the carriage 23, the protrusion may engage with the second trigger 33*c*.

The clutch lever 33 may be pivoted about the second trigger 33*c* oriented parallel to the main scanning direction, as described above. By the tension spring 53 shown in FIG. 21, the second trigger 33*c* is urged toward the carriage 23. When the carriage 23 moves to the home position, the protrusion 23*a* pushes aside the second trigger 33*c* against an urging force of the tension spring 53 so that the clutch lever 33 (gradually) pivots. With the pivot of the clutch lever 33, the clutch device 31 shifts its state from the inactive state to the active state as already described referring to FIG. 6. That is, a rotational force is transmitted to the rotary shaft 2.

The carriage 23 is able to trigger the clutch device 31 also at a side opposite to the home position with regard to the recording region (hereinafter, referred as "away position"). As shown in FIG. 24, the link member 51 extending in the main scanning direction is provided at the upper part of the sheet feeder 1, while being slidable in the main scanning direction.

More specifically, protrusions 52 are provided on both sides of a frame 1*a* of the sheet feeder 1, as shown in FIGS. 24, 25 and 15. Elongated grooves 51*c* extending in the main scanning direction are provided on both sides of the link member 51. The protrusions 52 are loosely put in the grooves 51*c*. With this, the link member 51 is slidable in the main scanning direction.

A lever engaging part 51*b* protruding to the rear side of the sheet feeder 1 is formed at the home position side end of the link member 51 at which the clutch device 31 is provided. A window hole through which the lever engaging part 51*b* is inserted is formed in an upper part of the clutch lever 33. A plate-shaped, contact part 33*d*, which is substantially orthogonal to the sliding direction of the link member 51, is formed within the window hole. A side of the lever engaging part 51*b*, which faces the contact part 33*d*, is tapered to form a tapered part 51*d*. As seen from FIG. 25, when the link member 51 slides to the away position side (upper direction in FIG. 25), the lever engaging part 51*b* comes in contact with the tapered part 51*d* to form a contact point 54. As the link member 51 slides to the away position side, the clutch lever 33 gradually pivots. The pivot motion of the clutch lever 33 has a direction in which the second trigger 33*c* moves apart from the carriage 23 against the urging force of the tension spring 53 shown in FIG. 21. Accordingly, the link member 51 is put in an active state. That is, a rotation force is transmitted to the rotary shaft 2.

The sliding operation of the link member 51 to the away position side is performed by the carriage 23. Specifically, as shown in FIG. 15, the first trigger 51*a* is formed at the away position side end of the link member 51. The first trigger protrudes upward from the link member 51, and to the side of the carriage 23. When the carriage 23 moves to the away position side, the protrusion 23*a* engages with the link member 51, and the link member 51 is slid to the away position side.

In the mechanism described above, the carriage 23 (protrusion 23*a*) is pressingly abutted against either of the second trigger 33*c* and the first trigger 51*a*, which are provided on both sides of the recording region, whereby the active state or the inactive state of the clutch device 31 is selected, viz., permission or prohibition of power transmission to the rotary shaft 2 is selected. With this feature, time taken for the carriage 23 to move is reduced when comparing with a case where the carriage engaging part is provided on one side of the recording region. Accordingly, the throughput of the printing process including the sheet feeding process may be improved.

Details of the sheet feed control when the sheet P is fed will now be described with reference to FIGS. 26A through 42.

Figure 26A:
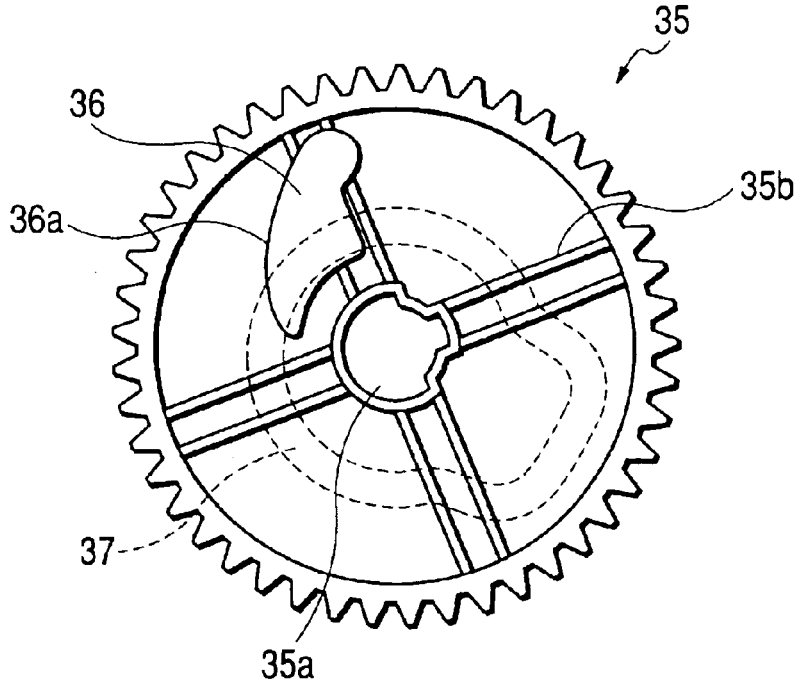
FIGS. 26A and 26B are side views of a sheet feeding roller gear in the ink jet printer of FIG. 19.
Figure 26B:
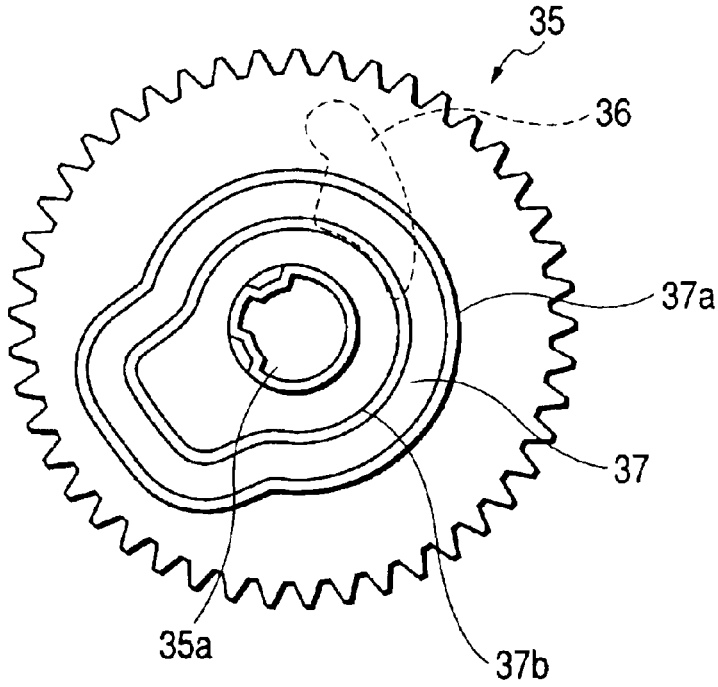
Figure 27A:
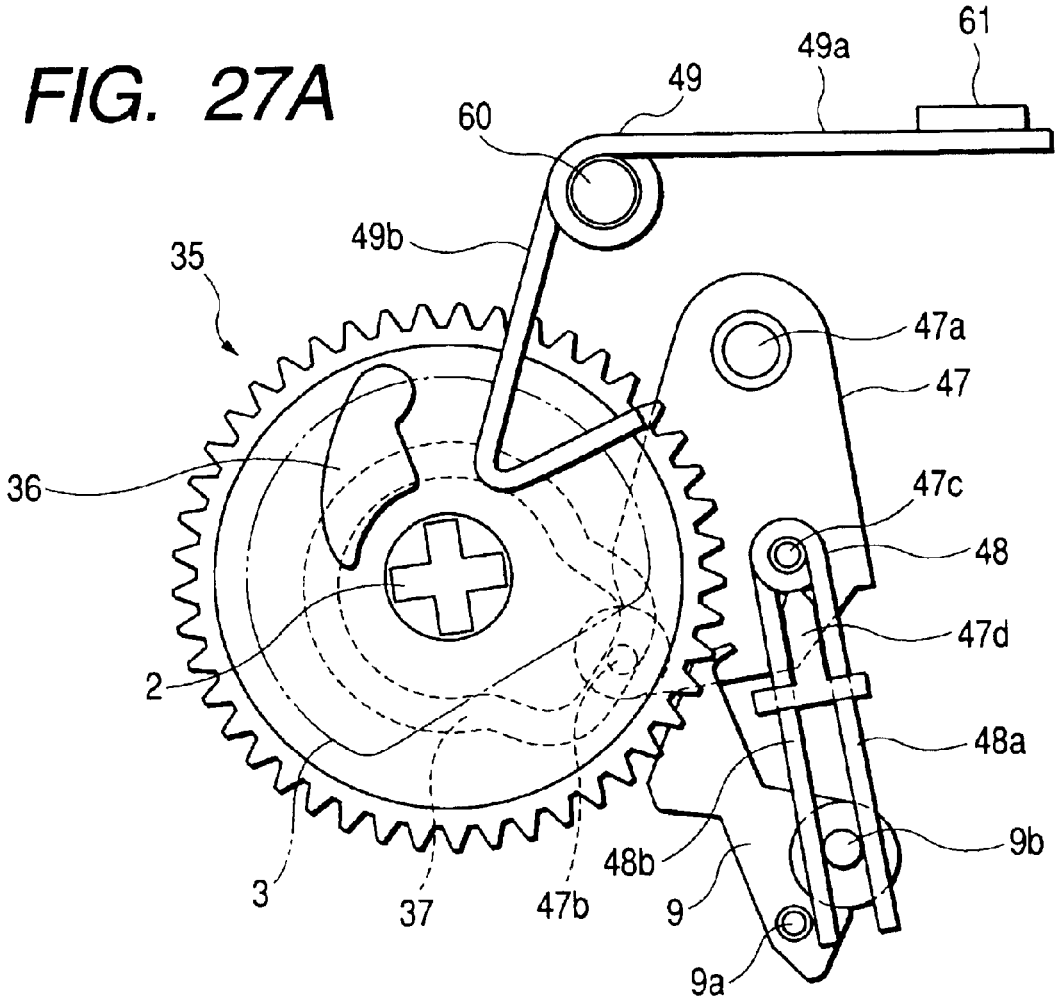
FIGS. 27A through 29B are views showing operations of the sheet feeding roller gear, a sheet feeding roller, the hopper and the sheet returning lever in the ink jet printer of FIG. 19.
Figure 27B:
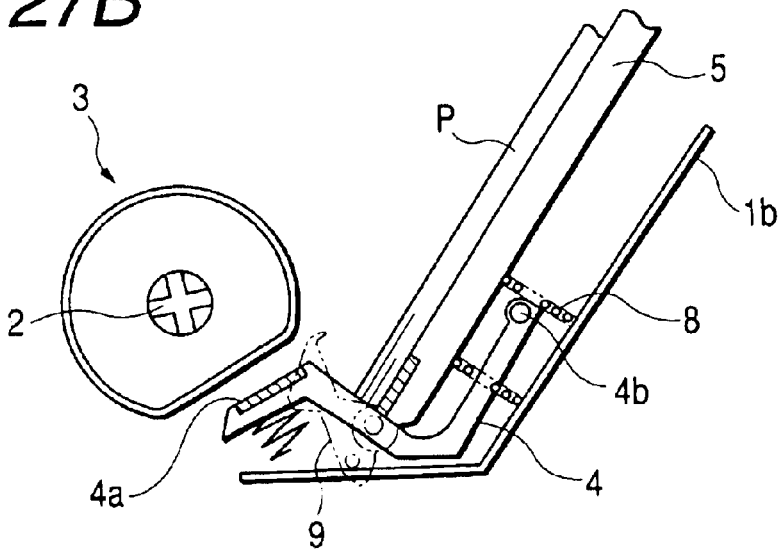

A relationship between the sheet feeding roller gear 35 shown in FIG. 23 and the sheet returning lever 9 will be described with reference to FIGS. 26A through 31. FIG. 26A is a side view showing the sheet feeding roller gear 35, and FIG. 26B is a view showing the sheet feeding roller gear 35 shown in FIG. 26A when viewed from its rear side. FIGS. 27A through 29B show diagrams for showing a transition of operation of the sheet feeding roller gear 35 and the sheet returning lever 9. FIG. 27A is a side view showing a mechanism including the sheet feeding roller gear 35 and the sheet returning lever 9, and FIG. 27B is a side view showing a state of the sheet feeding roller 3 and the hopper 5, which corresponds to a state shown in FIG. 27A.

The sheet feeding roller gear 35 will first be described. As shown in FIG. 26A, a hole 35*a* through which the rotary shaft 2 is inserted is formed at the center of the sheet feeding roller gear 35. Ribs 35*b* are crosswise disposed on a disc-like surface of the sheet feeding roller gear. A cam 36 is formed on the disk-like surface of the sheet feeding roller gear 35. The cam takes a sector shape as viewed in plan view. The cam 26 and the sheet feeding roller gear 35 are integrally formed by resin molding.

As shown in FIG. 26B, a cam groove 37 is formed in the rear side of the sheet feeding roller gear 35. A boss part 47*b* (see FIG. 23) provided on a pivot member 47 to be described later is loosely put in the cam groove 37. More specifically, the cam groove 37 is defined by an endless (loop like) inner wall 37*b* surrounding the hole 35*a* and an outer wall 37*a* formed on the radially outer side of the hole 35*a* so as to include an arcuate part which is spaced from the hole 35*a* by a fixed distance, and a non-arcuate part located radially apart from the arcuate part. Accordingly, when the sheet feeding roller gear 35 is rotated, the boss part 47*b* which is loosely put in the cam groove 37 cyclically moves to and from the hole 35*a* (the rotary shaft 2).

Subsequently, the pivot member 47 is provided near the sheet feeding roller gear 35 mounted on the clutch device 31 as shown in FIG. 27A (also see FIGS. 21 and 23). The pivot member 47 is pivotable about a pivot shaft 47*a* clockwise and counterclockwise in FIG. 27A. The pivot member 47 includes the boss part 47*b* at a position located apart from the pivot shaft 47*a*. Accordingly, when the sheet feeding roller gear 35 is rotated, the boss part 47*b* moves along the cam groove 37 and the pivot member pivots clockwise and counterclockwise in FIG. 27A. As seen from the figures, the boss part 47*b* is restricted in its movement by the cam groove 37. When the sheet feeding roller gear 35 is rotated, the pivot member 47 pivots accordingly.

A protruding, spring holder 47*c* is formed at a position located apart from the pivot shaft 47*a*. A spring retainer 47*d* is formed at a position slight lower than the spring holder 47*c*. A twist spring 48 is provided at the spring holder 47*c* such that its twist part is fit into the spring holder 47*c* and the spring compresses the spring retainer 47*d* from both sides thereof by its spring force. The twist spring 48 is also mounted on the pivot member 47 such that an operating part 9*b* located at a position shifted from the supporting point 9*a* of the sheet returning lever 9 is put between steel wires 48*a* and 48*b*.

Figure 28A:
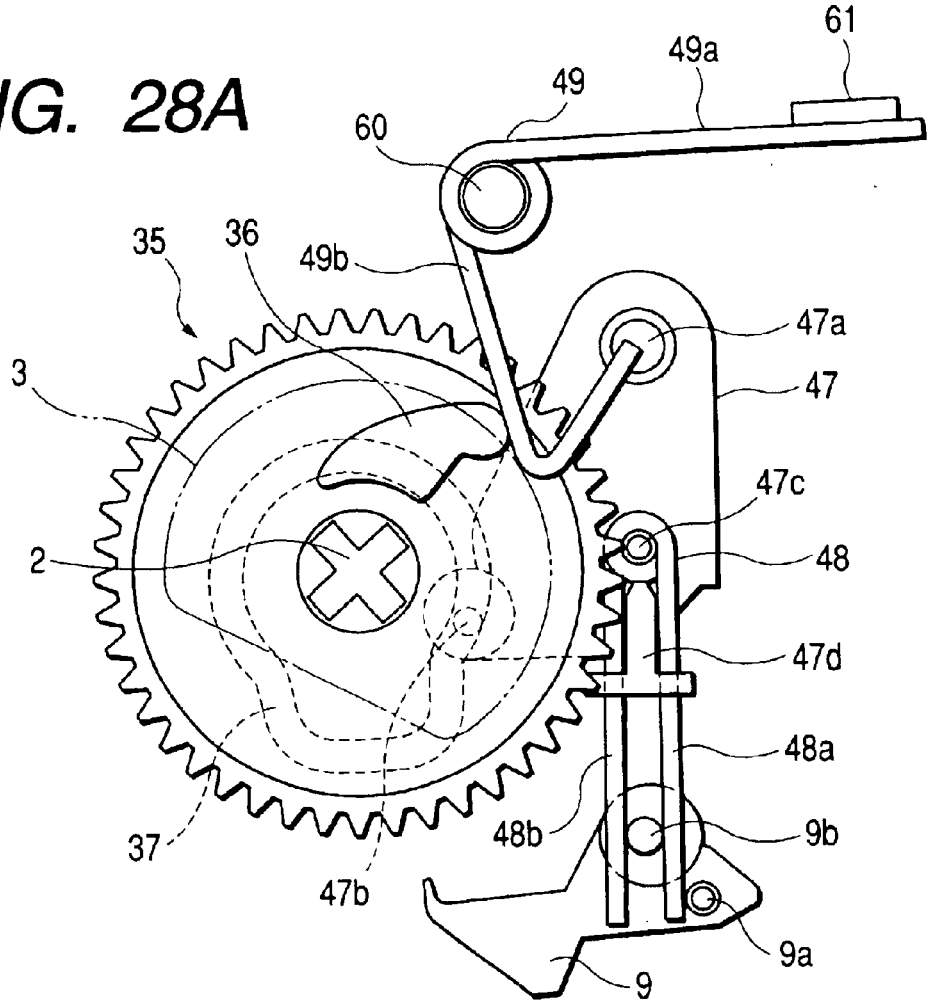

As seen from a state change shown in FIGS. 27A and 28A, when the sheet feeding roller gear 35 rotates with rotation of the rotary shaft 2, the boss part 47*b* relatively moves within the cam groove 37 as described above, so that the pivot member 47 pivots about the pivot shaft 47*a* clockwise and counterclockwise in FIG. 27A. In turn, with this pivot, the twist spring 48 also pivots. Then, the sheet returning lever 9 which receives external forces from the steel wires 48*a* and 48*b* through the operating part 9*b* is pivoted about the supporting point 9*a* clockwise and counterclockwise in FIG. 27A, as seen from a state change from the state of FIG. 27A to the state of FIG. 28A.

Figure 28B:
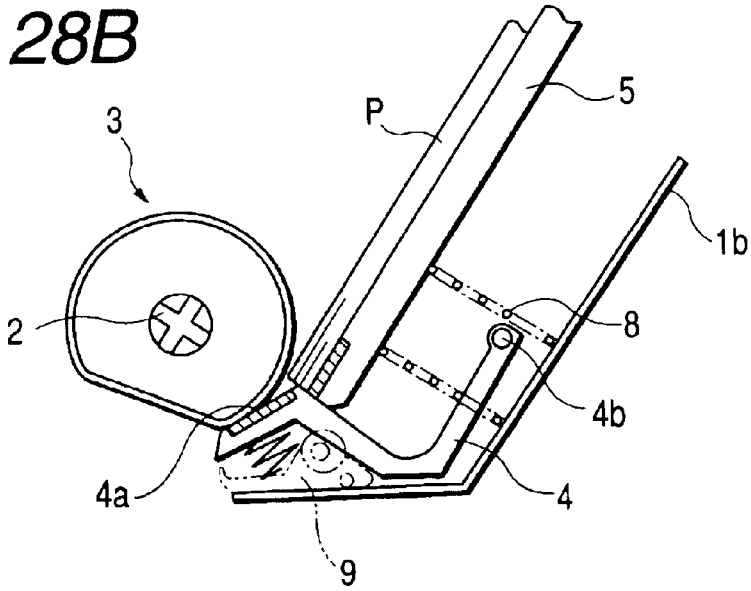
Figure 29A:
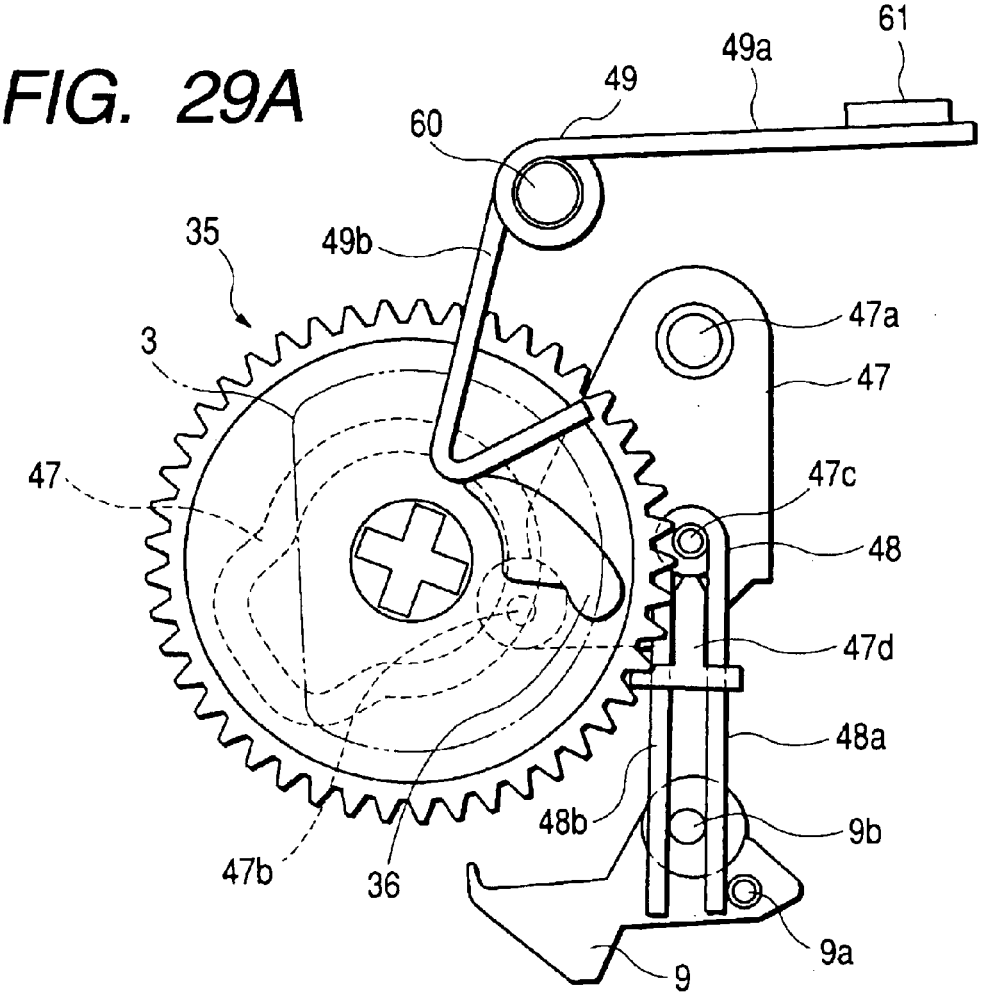
Figure 29B:
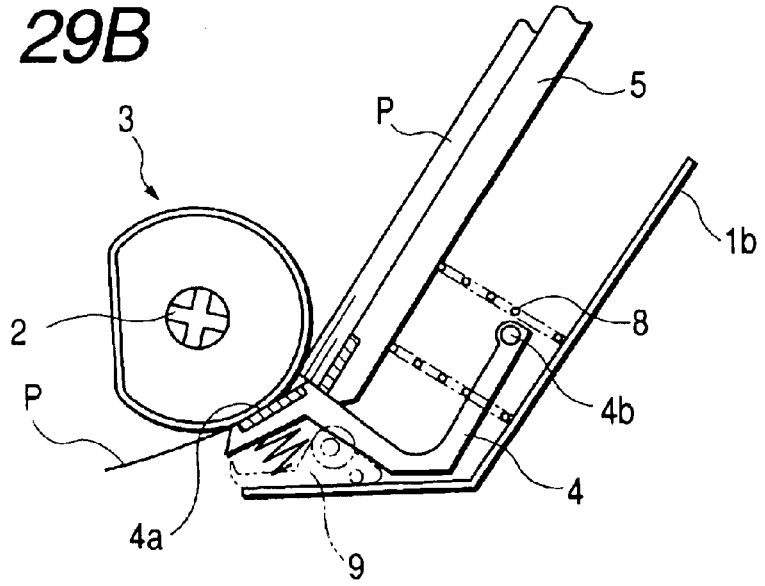

FIG. 27B shows a state that the sheet returning lever 9 extends across the sheet feeding path of the sheet P to close the entrance of the sheet feeding path. FIGS. 28B and 29B show a state that the sheet returning lever 9 retracts from the sheet feeding path to open the entrance the sheet feeding path. In this way, the sheet returning lever 9 selects the state shown in FIG. 27B or the state shown in FIG. 28B (FIG. 29B) through the rotation of the sheet feeding roller gear 35. On the other hand, it is pivoted so as to change the state from the state shown in FIG. 28B (FIG. 29B) to the state shown in FIG. 27B, to thereby push back and upward the sheets P to be multi-fed.

As described above, the spring force of the twist spring 48 is selected such that in a normal load condition, for example, when the sheet returning lever 9 in a state that no load is applied thereto is pivoted, or when the sheet returning lever 9 is pivoted when the sheets P to be multi-fed are pushed back, either of the steel wire 48*a* or 48*b* separate from the spring retainer 47*d* and the twist spring 48 is not expanded, and the sheet returning lever 9 is allowed to pivot.

Figure 30:
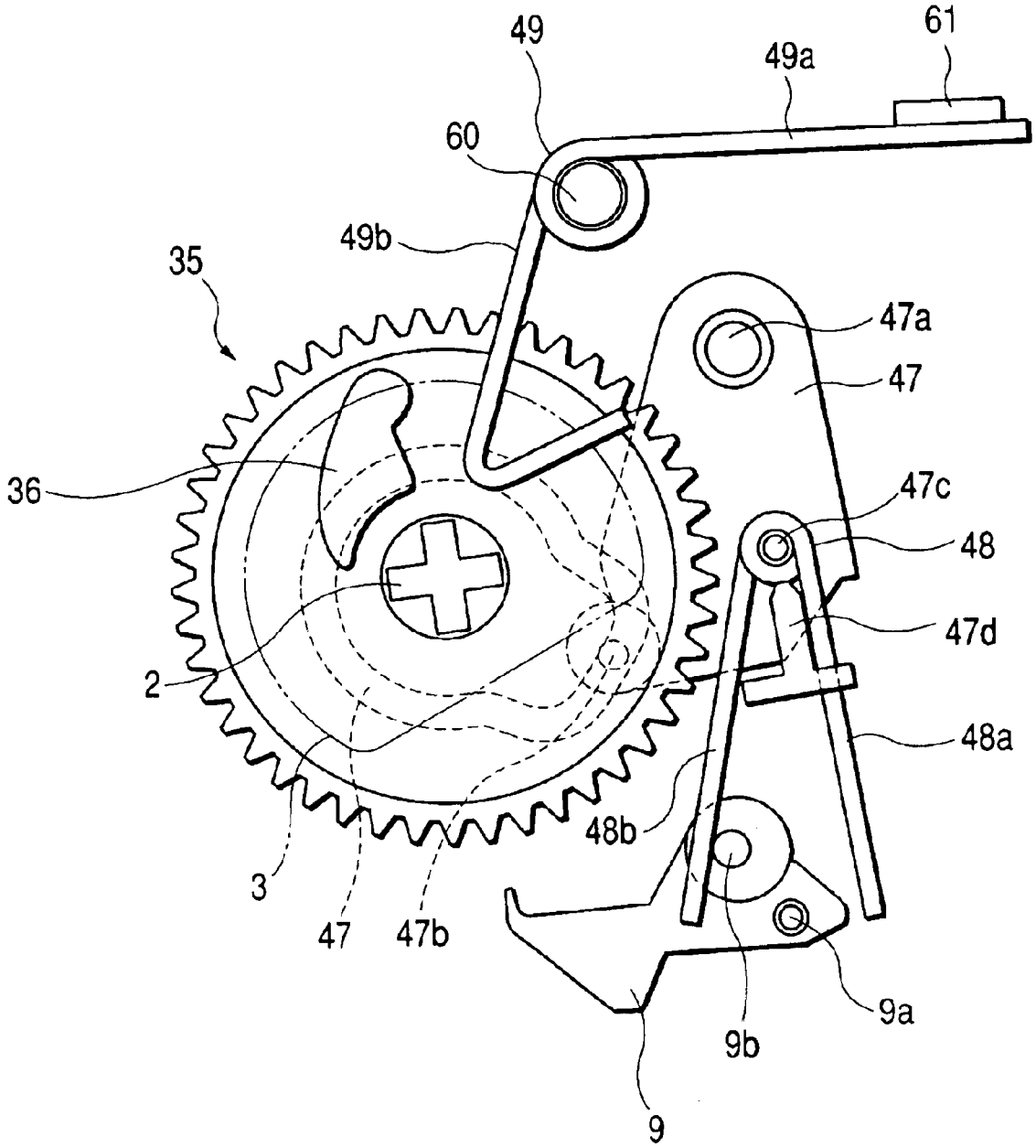
FIGS. 30 and 31 are views showing operations of the sheet feeding roller gear and the sheet returning lever.

FIG. 30 shows a state that in a sheet-feed stand-by state shown in FIG. 27, the sheet returning lever 9 is pivoted by directly applying an external force thereto, not by the rotation of the sheet feeding roller gear 35 (rotary shaft 2). Specifically, not only in a case the sheet returning lever 9 is pivoted with rotation of the sheet feeding roller gear 35, it may be pivoted by directly applying an external force to the sheet returning lever 9. Such a situation will occur, for example, when the user thrusts the sheet P in the sheet feeding direction.

In a case where the twist spring 48 is a simple rigid body, if such an excessive external force as just mentioned (i.e., an abnormal load) is applied to the sheet returning lever 9, there is a danger that the solid body may be broken by the external force or that the operating part 9*b* of the sheet returning lever 9, the spring holder 47*c* of the clutch member 43 or the like may be broken.

In the embodiment, if the excessive external force is applied to the sheet returning lever 9, the twist spring 48 expands against its spring force as shown in FIG. 30. In turn, the pivoting operation of the sheet returning lever 9 is allowed to thereby prevent the breakage problem as described above. In other words, the twist spring does not put the sheet returning lever 9 in completely constrained state because of its elasticity. Therefore, even if an irregular operation occurs, the breakage problem in the cam mechanism does not arise.

Figure 31:
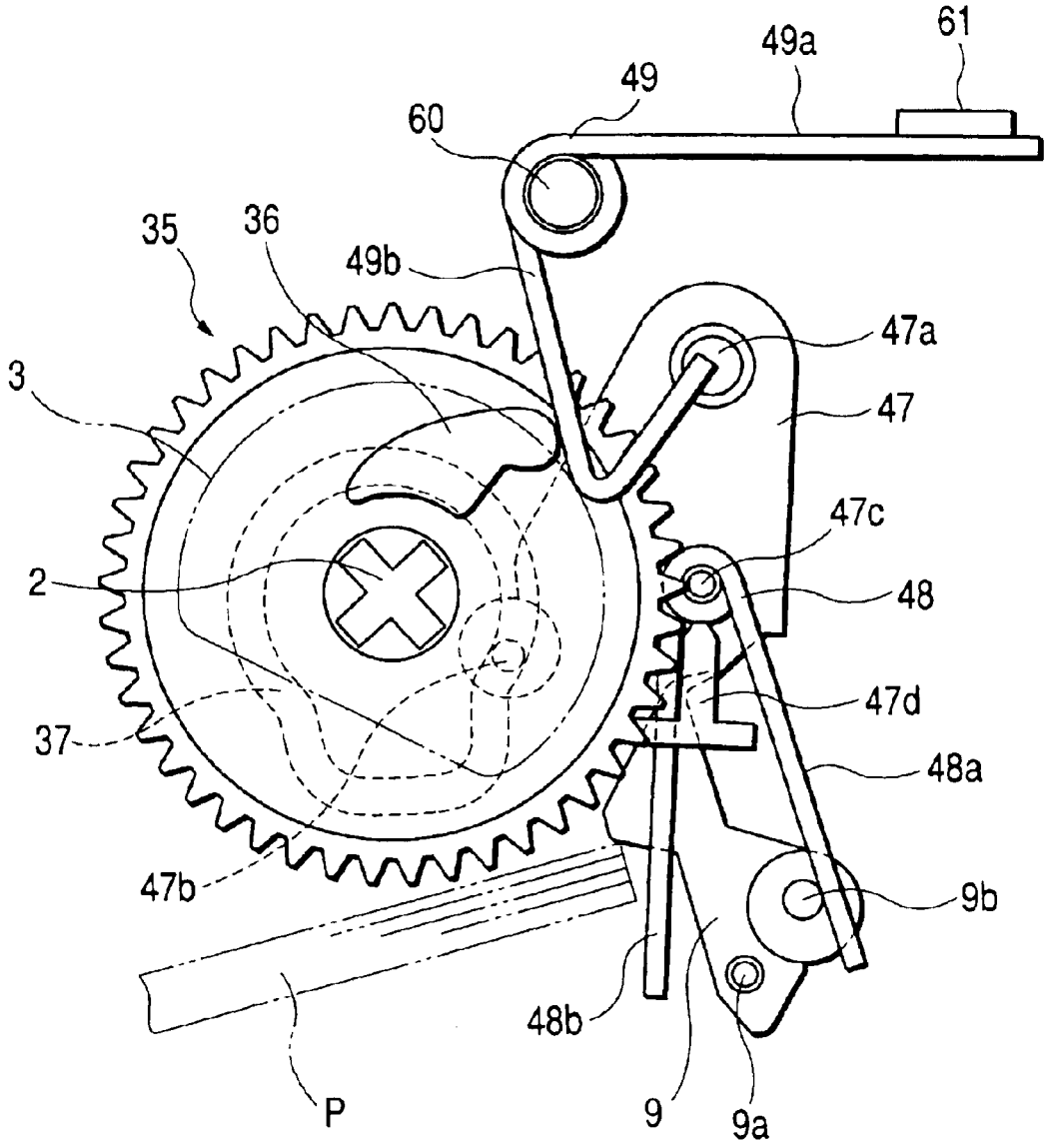

FIG. 31 shows a state that in a sheet-feedable state, paper jamming, for example, occurs under the sheet returning lever 9, and the sheets P stay there. When the sheets P thus stay under the sheet returning lever 9, the sheets P hinders the pivoting operation of the sheet returning lever 9. Accordingly, if in this state, the sheet feeding roller gear 35 (rotary shaft 2) is rotated by a state change from the state of FIG. 27A to the state of FIG. 31, the cam mechanism will be broken as in the above case.

The twist spring 48 expands against its spring force as shown by a state change from the state of FIG. 27A to the state of FIG. 31. As a result, the sheet returning lever 9 is caught by the sheets P and left not rotated, and permits the rotation of the sheet feeding roller gear 35, whereby the breaking of the cam mechanism is prevented. Specifically, also in this case, the twist spring 48 does not put the sheet feeding roller gear 35 (sheet returning lever 9) in a completely constrained state because its elasticity. Therefore, even if an irregular operation occurs, the breakage problem in the cam mechanism does not arise.

Relationship among the sheet feeding roller 3, the cam 6 provided on the rotary shaft 2, the cam follower 7 (hopper 5) engaging with the cam 6, the sheet feeding roller gear 35 and a twist coiled spring 49 will be described with reference to FIGS. 32 through 36.

Figure 32:
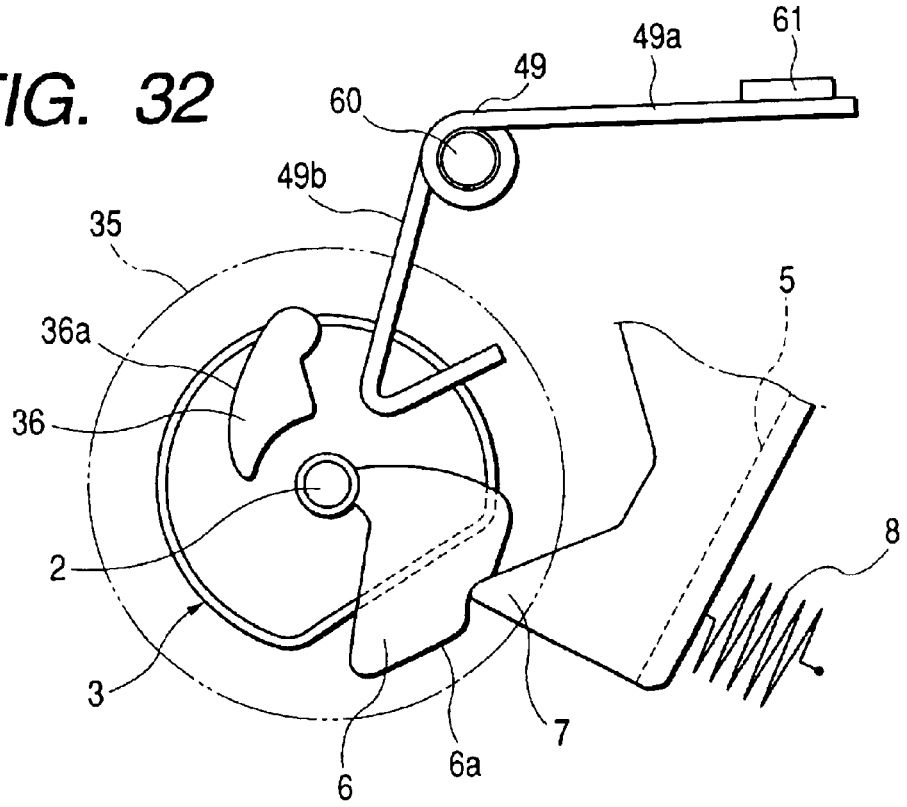
FIGS. 32 through 36 are views showing operations of a sheet feeder in the ink jet printer of FIG. 19.

First, FIG. 32 shows a state before a sheet feeding operation starts. An annular part of the twist coiled spring 49 is supported by a protrusion 60 formed on the frame 1*b*. A steel wire 49*a* extending from the annular part to the rear side of the sheet feeder 1 may engage with a spring engaging part 61 formed on the frame 1*b*. A steel wire 49*b* which extends from the annular part obliquely downward while taking a V-shape, is put in a free state, and may engage with the cam 36 provided on the sheet feeding roller gear 35.

Figure 33:
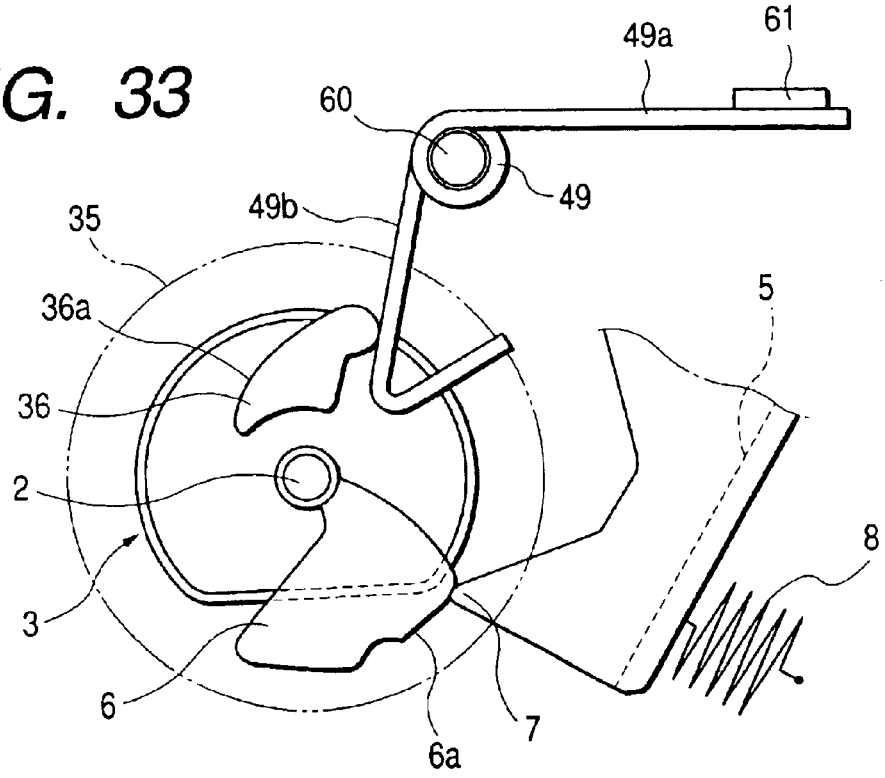
Figure 34:
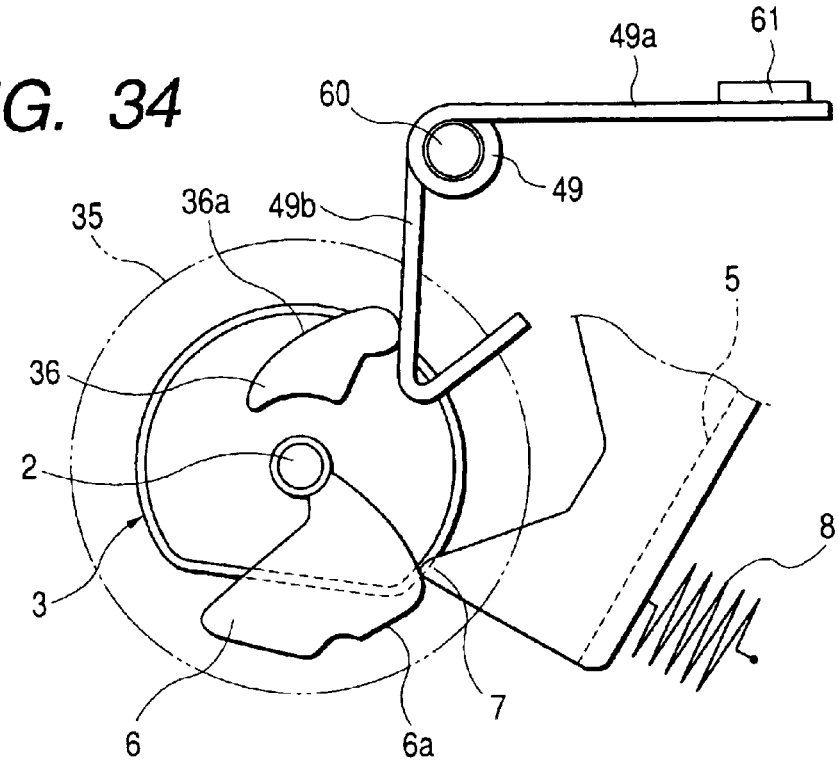
Figure 35:
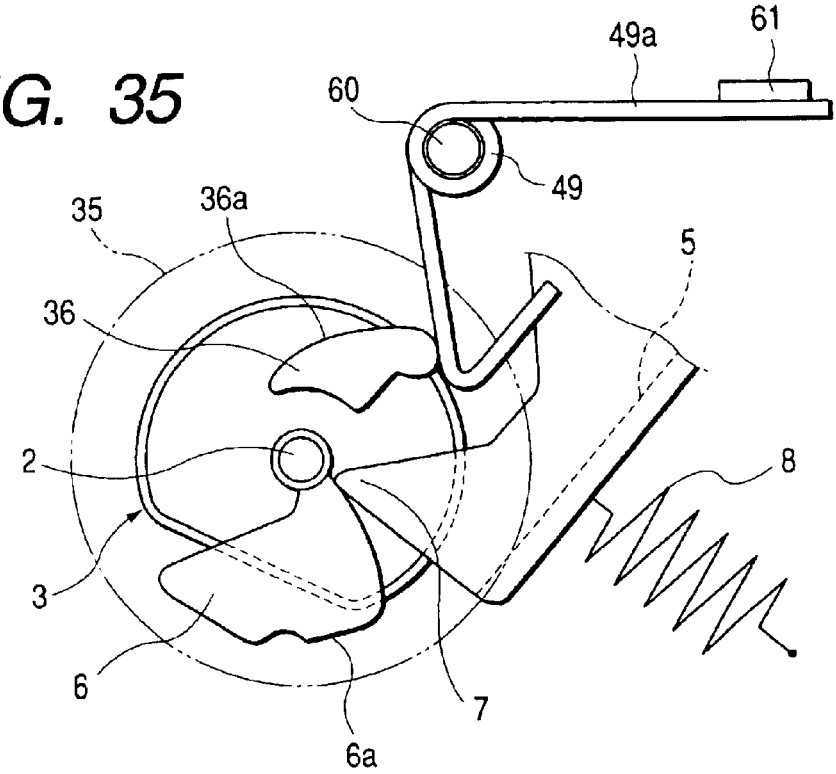
Figure 36:
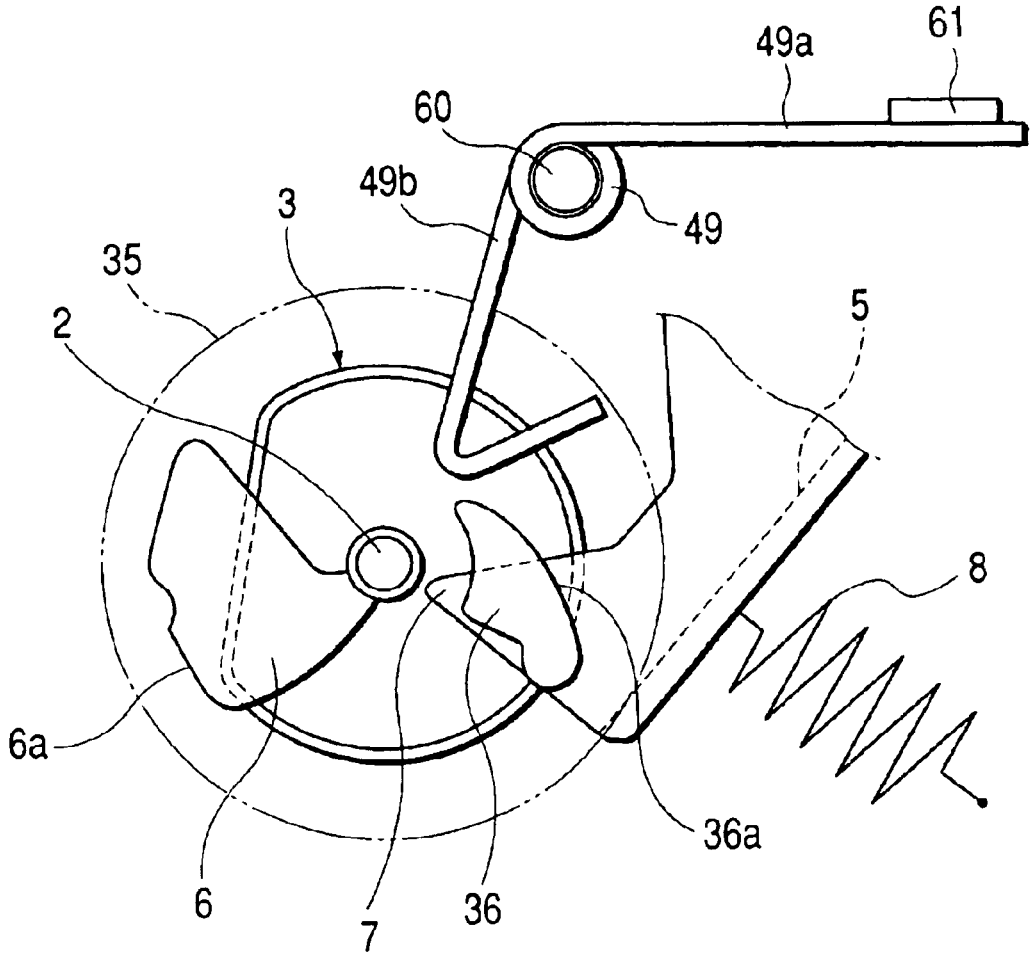

In a state shown in FIG. 32, the cam 6 mounted on the rotary shaft 2 completely engages with the cam follower 7 provided on the hopper 5, so that the hopper 5 is separated from the sheet feeding roller 3. When the sheet feeding roller 3 is rotated clockwise in the figure from this state, the cam 36 provided on the sheet feeding roller gear 35 starts to engage with the steel wire 49*b* of the twist coiled spring 49, as shown in FIG. 33. At this time, the cam follower 7 is at a position near the end of the cam surface 6*a* of the sector-shaped cam 6. When the sheet feeding roller 3 is rotated from this state, the cam follower 7 comes off from the cam surface 6*a* of the cam 6 as shown in FIGS. 34 and 35, and hence, the hopper 5 is urged toward the sheet feeding roller 3 by an urging force of the hopper spring 8.

If the twist coiled spring 49 is not provided, the hopper 5 is swiftly abutted against the sheet feeding roller 3 by the urging force of the hopper spring 8. In the embodiment, the twist coiled spring 49 is provided, the cam 36 provided on the sheet feeding roller gear 35 may engage with the steel wire 49*b* of the twist coiled spring 49. If the cam follower 7 comes off from the arcuate part 6*a*, it does not happen that the cam 6 is pressed by the cam follower 7, and the rotary shaft 2 is rapidly rotated. Accordingly, the hopper 5 is not swiftly abutted on the sheet feeding roller 3 by the urging force of the hopper spring 8, and is braked.

When the sheets P stacked on the hopper 5 is abutted against the sheet feeding roller 3, the cam 36 and the twist coiled spring 49 serve to apply to the hopper 5 a braking force having a direction opposed to that of the urging force of the hopper spring 8. By the cam/spring combination, a speed of the hopper 5 approaching the sheet feeding roller 3 is reduced, so that an impact sound generated when the sheet P supported on the hopper 5 is abutted against the sheet feeding roller 3 is effectively reduced.

Incidentally, there may be configured that the load is applied to the rotation of the cam 6 through the sheet feeding roller gear 35 to cause the cam 6 to gently rotate, whereby the braking force is indirectly applied to the hopper 5. If required, the braking force may directly be applied to the hopper 5. For example, when the hopper 5 moves to the sheet feeding roller 3 a fixed distance, a spring force may directly be applied to the hopper 5.

In the embodiment, the brake is not arranged such that it produces a braking force over the entire period of one rotation of the sheet feeding roller 3. Exactly, the cam 36 is provided at a part of the disc-like surface of the sheet feeding roller gear 35. After the depressing state of the hopper 5 by cooperation of the cam 6 and the cam follower 7 is removed, the braking force is applied only for a segment of the one rotation period till the hopper 5 (the sheet P supported on the hopper 5) is abutted against the sheet feeding roller 3 (see FIG. 36). In other words, the braking force is applied only for a necessary minimum time period. Therefore, excessive load is not applied to the sheet feeding motor 167.

In addition, as seen from FIGS. 34 and 35, after the engagement of the cam 6 and the cam follower 7 is removed, a spring force of the twist coiled spring 49 increases as the hopper 5 moves to the sheet feeding roller 3. That is, since the braking force increases, the braking force reaches a maximum value at an instant that is most important in reducing the collision sound, viz., an instant that the sheet P supported on the hopper 5 abuts on the sheet feeding roller 3, whereby the collision sound is reliably reduced.

Figure 37A:
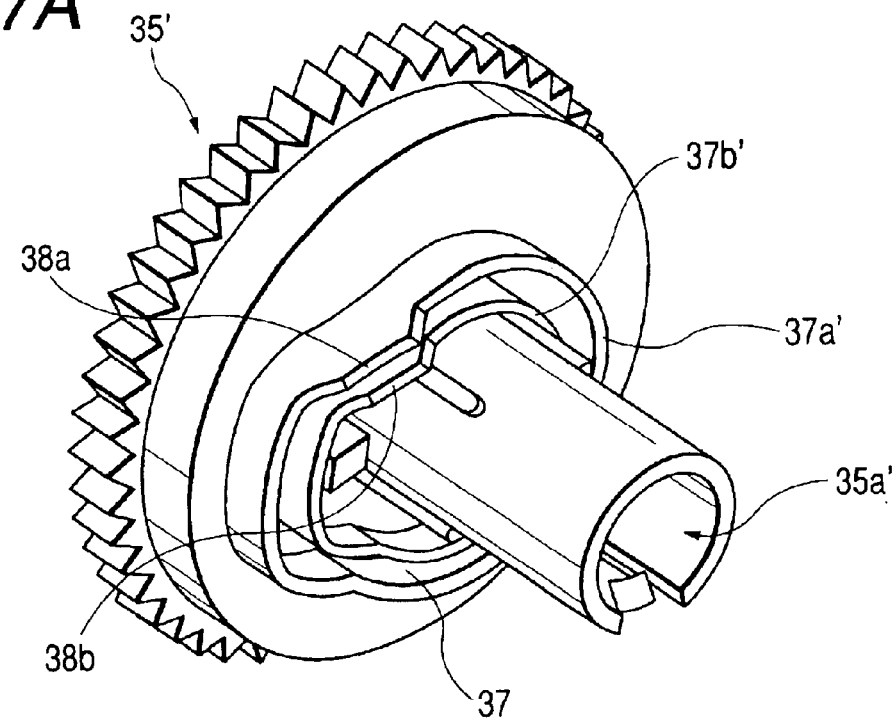
FIGS. 37A and 37B are views showing a modified example of the sheet feeding roller gear.
Figure 37B:
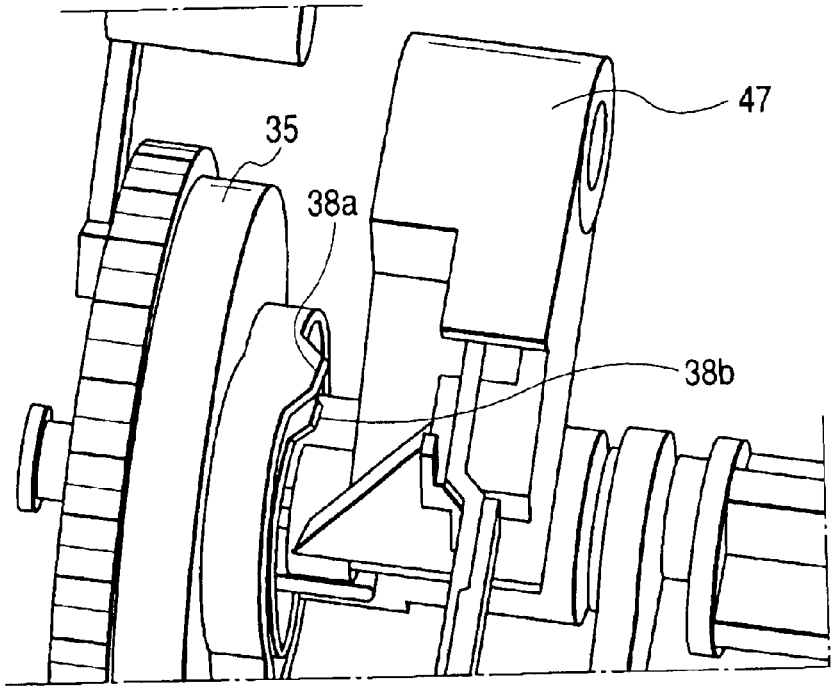

In the embodiment, the braking force is produced by the spring force of the twist coiled spring 49. However, as a third embodiment of the invention, the braking force may also be produced by forming the cam groove 37 formed in the sheet feeding roller gear 35 as shown in FIGS. 37A and 37B. FIG. 37A is a perspective view showing a sheet feeding roller gear 35'. FIG. 35B is a perspective view showing the pivot member 47 and the sheet feeding roller gear 35'.

As shown in FIG. 37A, a cam groove 37', like the cam groove 37 shown in FIG. 26B, includes an endless inner wall 37*b*' surrounding the hole 35*a*' through which the rotary shaft 2 is passed, and an outer wall 37*a*' formed on the radially outer side of the inner wall 37*b*'. As shown in FIGS. 37A and 37B, a widened portion 38*a* is formed at a part of the outer wall 37*a*', and a widened portion 38*b* is formed at a part of the inner wall 37*b*'. Those widened portions may be brought into pressing contact with a portion of the pivot member 47 where the boss part 47*b* is formed. After the cam follower 7 come off from the arcuate part of the cam 6 as shown in FIGS. 34 and 35, the widened portions 38*a* and 38*b* may be brought into pressing contact with the portion of the pivot member 47 where the boss part 47*b* is formed, in a segment where the sheet P supported on the hopper 5 abuts on the sheet feeding roller 3. Accordingly, the braking force is produced to lessen a collision sound generated when the sheets P collide the sheet feeding roller 3.

Figure 38:
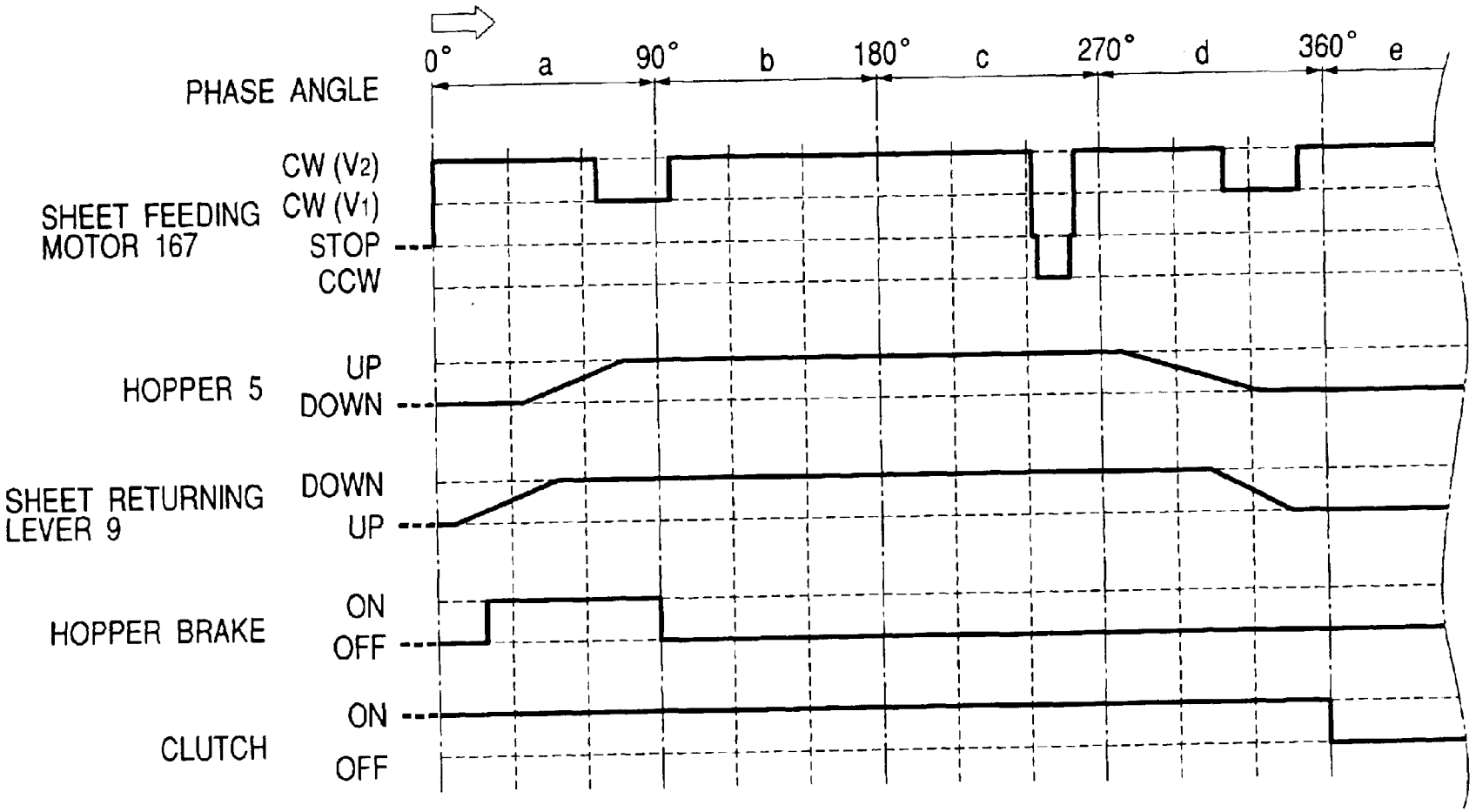
FIGS. 38 and 39 are timing charts showing sheet feeding control performed in the ink jet printer of FIG. 19.
Figure 39:
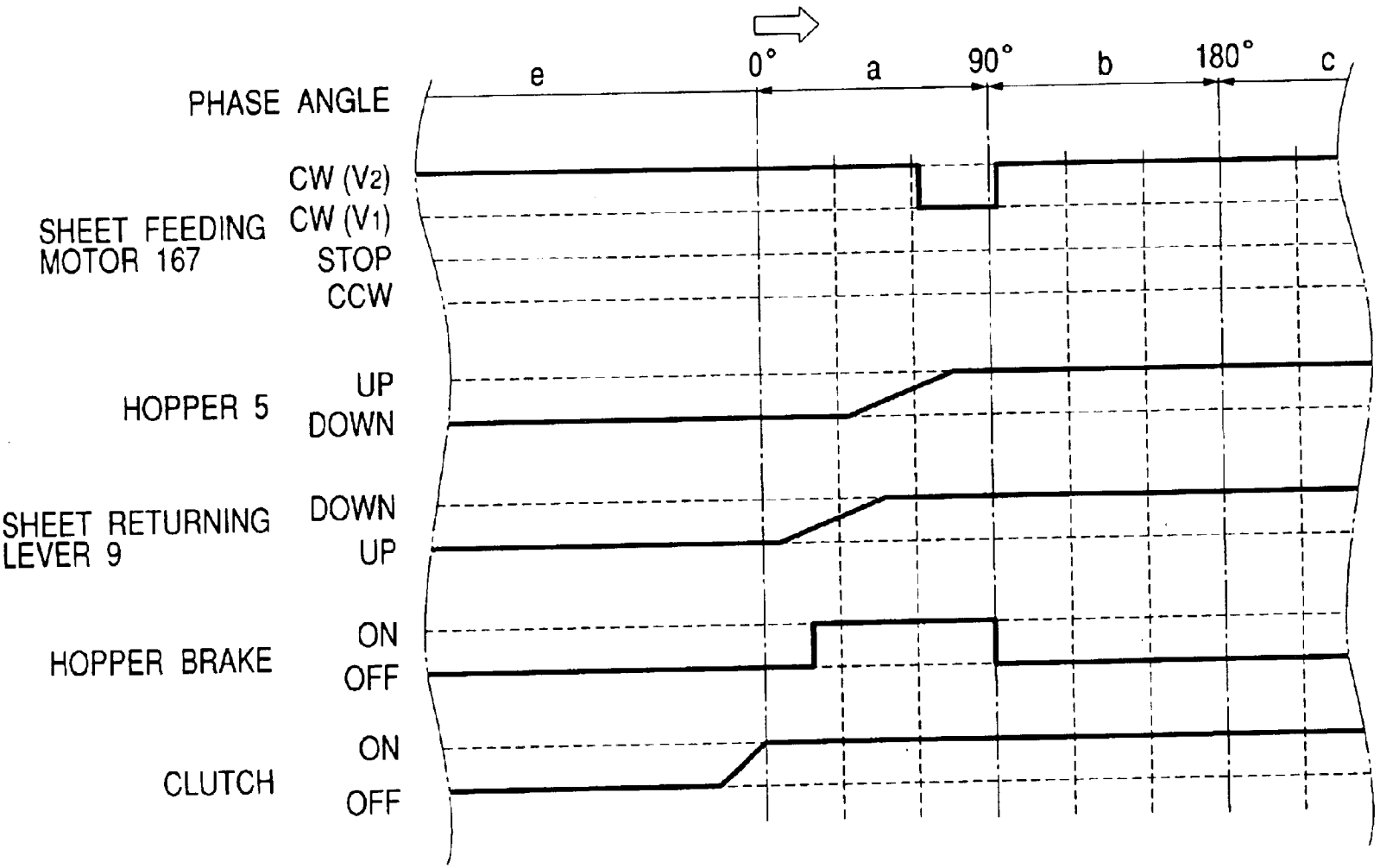
Figure 40A:
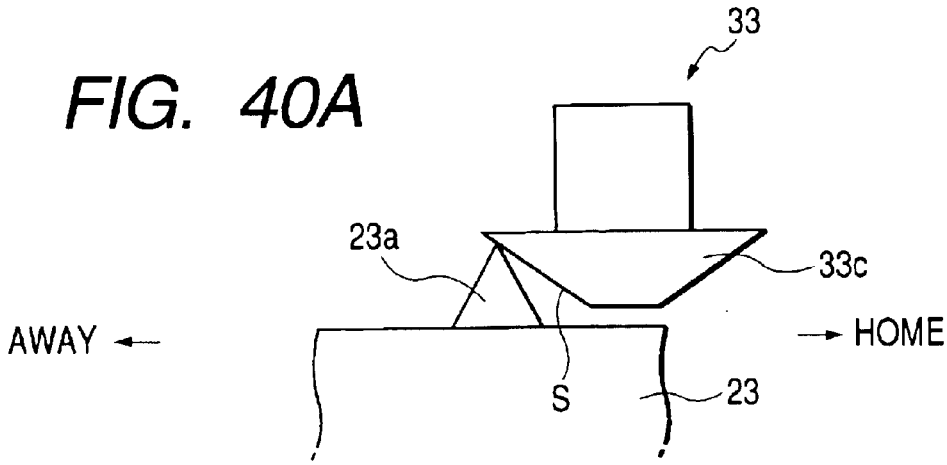
FIGS. 40A to 40C are schematic plan view showing positions between a carriage and the clutch lever in the ink jet printer of FIG. 19.
Figure 40B:
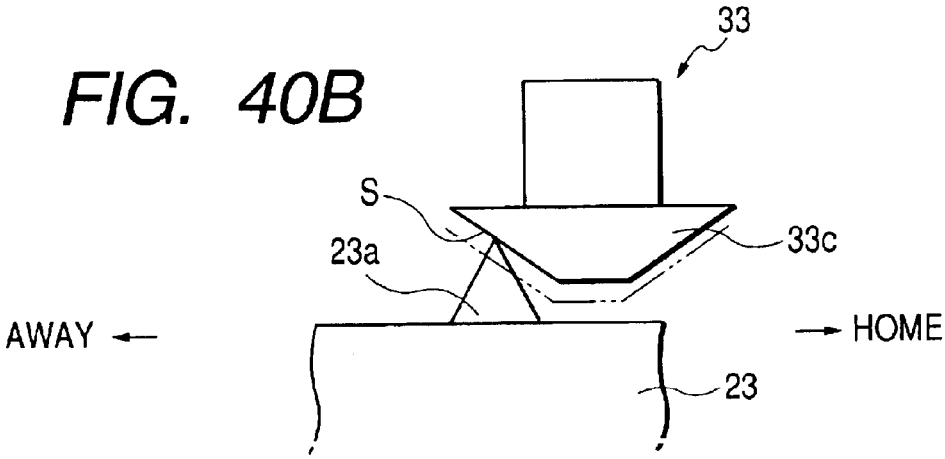
Figure 40C:
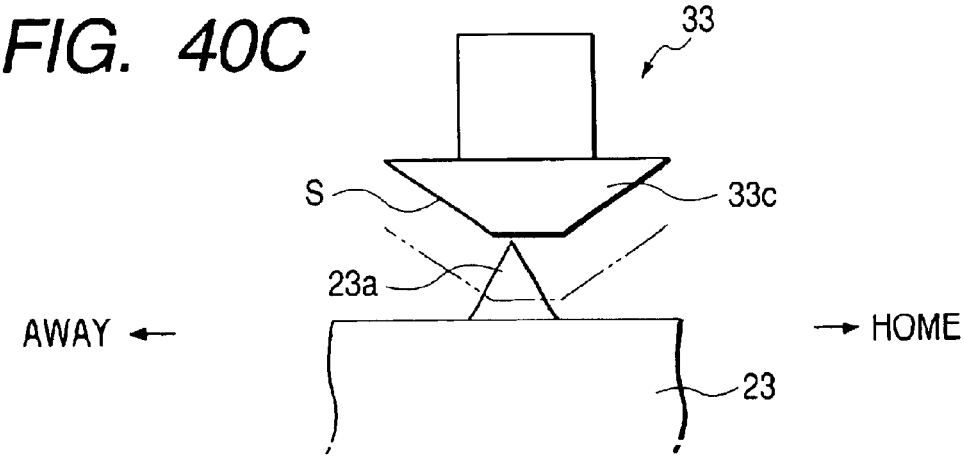
Figure 41:
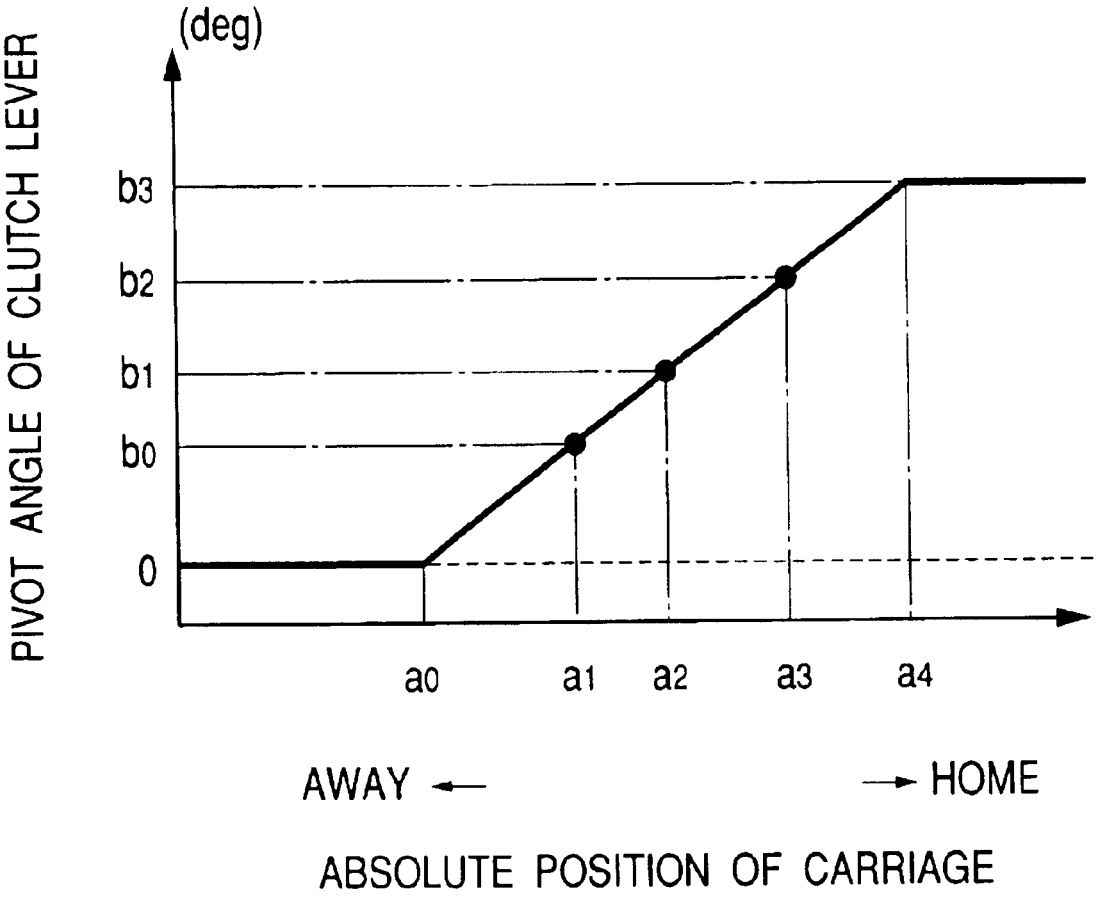
FIG. 41 is a graph showing a relationship between an absolute position of the carriage and a pivot angle of the clutch lever.
Figure 42:
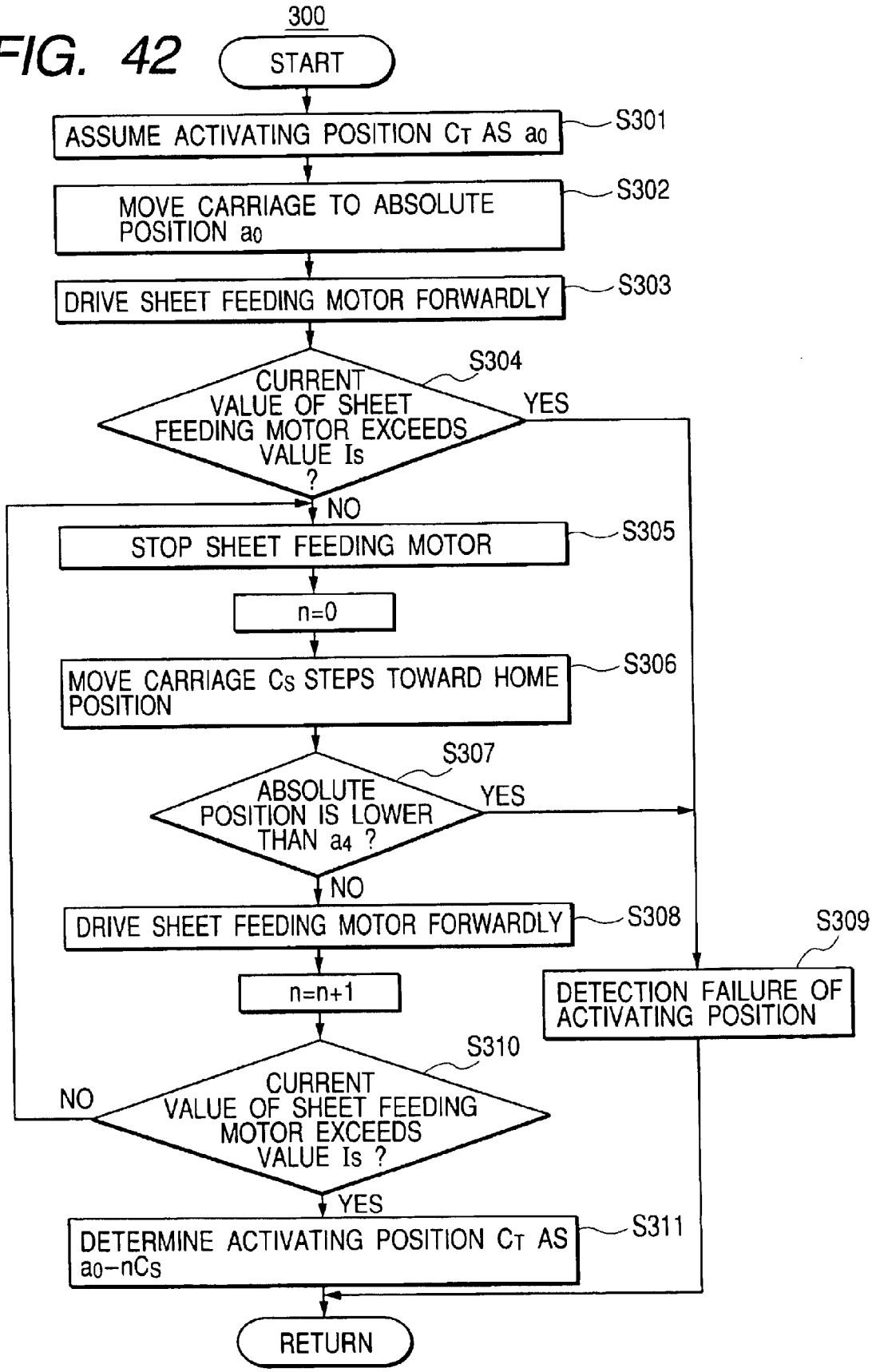
FIG. 42 is a flow chart showing an operation for identifying a position at which the carriage activates the clutch device.

Details of the sheet feed control will be described with reference to FIGS. 38 through 42. FIGS. 38 and 39 are timing charts showing operations of related components in the sheet feed control. FIGS. 40A, 40B and 40C are partially enlarged plan views showing a positional relationship between the clutch lever 33 and the carriage 23. FIG. 41 is a graph showing an pivot angle of the clutch lever 33 with respect to an absolute position of the carriage 23 when the clutch device 31 becomes active. FIG. 42 is a flow chart showing an operation for obtaining a position (activating position) of the carriage 23 for switching a state of the clutch device 31 from the inactive state to the active state.

First, an overall flow of the sheet feed control will be described with reference to FIGS. 38 and 39. "A phase angle" depicted in the uppermost location in each of FIGS. 38 and 39 indicates a rotational angle of the sheet feeding roller 3 when it is rotated from the sheet-feed stand-by state as shown in FIG. 32.

FIG. 38 shows a timing chart when the printer 100 does not perform yet a sheet feeding job and a print job, and starts the sheet feeding of the first sheet in a perfect stand-by state. At the time of starting such a sheet feeding job of the first sheet, the carriage 23 has been moved to the home position side in advance, and resultantly the clutch device 31 has been in an active state (ON).

To start, the sheet feeding motor 167 forwardly rotates (speed $V_2$) and the sheet feed control of the first sheet starts. Since the clutch device 31 is already in an active state (ON), the sheet feeding roller 3 immediately starts to rotate, the hopper 5 rises (UP) in a segment "a" in the figure, and the sheet returning lever 9 retracts (DOWN) (state shown in FIG. 28). "Hopper brake" in the figure means a brake by the hopper brake (the cam 36 and the twist coiled spring 49), and "ON" state means a state that the cam 36 engages with the twist coiled spring 49 as shown in FIGS. 33 to 35.

Subsequently, in the segment "a", the speed of the sheet feeding motor 167 is decreased from $V_2$ to $V_1$ ($V_2>V_1$) during the rising of the hopper 5. After the rising operation of the hopper 5 is completed, the speed of the sheet feeding motor 167 is increased from $V_1$ to $V_2$. The reason for this is as follows. Thus, the hopper brake decreases a speed of the hopper 5 when the sheets P supported on the hopper 5 collide the sheet feeding roller 3, to thereby prevent generation of the collision sound. When the speed $V_2$ of the sheet feeding motor 167 is increased to perform a high speed sheet feeding operation, there is an anxiety that use of only the hopper brake fails to reduce the collision sound to a desired level. To cope with this, in the embodiment, when the sheet P supported on the hopper 5 abuts on (hits) the sheet feeding roller 3 (when the hopper 5 rises), the rotational speed of the sheet feeding motor 167 is decreased from the speed $V_2$ to the speed $V_1$, to thereby effectively reduce the collision sound.

Subsequently, the sheet feeding roller 3 is further rotated, and the stop and reverse turn control of the sheet feeding motor 167 is performed. This control is used for removing a skew of the sheet P such that once the sheet P reaches the transporting roller 17 (see FIG. 19), and its leading end is nipped by the roller, the transporting roller 17 is reversely turned to release the leading edge of the sheet P from the roller.

Subsequently, the sheet feeding roller 3 is rotated and descending (DOWN) of the hopper 5 starts in a segment "d", and then the sheet return operation (UP) of the sheet returning lever 9 starts (state change from a state of FIG. 29 to a state of FIG. 27A). At this time, the speed of the sheet feeding motor 167 is decreased again from $V_2$ to $V_1$. This is done for the following reason. Recently, there is a strong demand of high throughput of the printer. To meet the demand, it is desired to perform the sheet feed transportation (sheet feeding) and the sheet discharging of the sheet P at high speed by rotating the sheet feeding motor 167 at high speed. With this, the sheet returning lever 9 is also driven at high speed, however. When the sheet P is swiftly returned to the upstream side, so that a called "hopping phenomenon" of the sheet P occurs. When such a phenomenon occurs, the sheets P are not neatly stacked subsequently. As a result, the sheets are undesirably skewed. Further, when the sheet pops and drops, the leading end of the sheet collides the separation pad 4, for example (FIG. 19) to sometime generate noisy collision sounds.

However, in the embodiment, the speed decreasing control of the sheet feeding motor 167 for driving and rotating the sheet returning lever 9 is carried out when the sheet is returned. Accordingly, even during the sheet feeding operation at high speed, the rotational speed of the sheet returning lever 9 is curbed. As a result, the hopping of the sheet P is reduced in level or prevented during the sheet returning operation. Therefore, the sheet is properly fed at high speed.

In the embodiment, the sheet returning lever 9 is pivoted with the rotation of the rotary shaft 2 (sheet feeding roller 3). However, the sheet returning lever 9 is separated from the rotary shaft 2 (sheet feeding roller 3) so as to have no relation to the rotating operation of the rotary shaft 2, and pivots in accordance with only the rotating operation of the transporting roller 17 (see FIG. 19). Also in this case, if the transporting roller 17 is driven to rotate at low speed only in the sheet returning operation by the sheet returning lever 9, the popping of the sheet P is prevented and an appropriate sheet feeding operation is secured even under high speed sheet feeding.

Subsequently, in a segment "d" the sheet returning lever 9 completes the sheet returning operation, and the hopper 5 descends (DOWN). In turn, the speed of the sheet feeding motor 167 is increased again from the speed $V_1$ to the speed $V_2$, and one turn rotation of the sheet feeding roller 3 ends (phase angle 360°). When the one rotation of the sheet feeding roller 3 ends, the carriage 23 moves apart from the clutch device 31 (home position) side, and the clutch device 31 is put in the inactive state (OFF). Subsequently, only the transporting roller 17 is driven to rotate, and the printing on the sheet P is carried out (segment "e" in FIG. 38).

When the printing on the sheet P ends, the sheet feeding control for a second sheet P starts as shown in FIG. 39. Incidentally, in the embodiment, when the sheet feeding control for the second sheet P shown in FIG. 39 is carried out, the trailing end of the first sheet P is still nipped by the discharging roller 29 (see FIG. 19). Accordingly, the sheet feeding of the first sheet P and the sheet feeding of the second sheet P are concurrently carried out, whereby the throughput of the recording process is further improved.

At the start of the sheet feeding control for the second sheet P, the sheet feeding motor 167 is being rotated at the speed $V_2$ as shown in a segment "e" in FIG. 39, unlike the start of the sheet feeding control for the first sheet P. The clutch device 31 is in the inactive state, unlike the start of the sheet feeding control for the first sheet P. To start, it is necessary to put the clutch device 31 in the active state, and to make the sheet feeding roller ready for its rotation drive. Accordingly, even when the sheet feeding motor 167 is being rotated, it is necessary to move the carriage 23 to the clutch device 31 (home position side) and to resultantly put the clutch device 31 in the active state.

As described referring to FIG. 14, the clutch device 31 is put in the active state when the protrusion 23*a* provided on the carriage 23 pushes aside the second trigger 33*c* provided on the clutch lever 33. Since the second trigger 33*c* is trapezoidal in shape, an absolute position (referred to as a "activating position") of the carriage 23 when the clutch device 31 is switched from the inactive state to the active state, varies depending on part accuracy and assembling accuracy. If the activating position is offset, the timings of the speed decreasing control or the speed increasing control for the sheet feeding motor 167 is also offset, as seen from a timing chart shown in FIG. 38. As a result, a proper sheet feeding operation is not secured.

FIGS. 40A through 41 are presented for describing this in detail. FIG. 40A shows an instant that the protrusion 23*a* provided on the carriage 23 comes in contact with the slanted surface S of the second trigger 33*c*. At this time, the absolute position of the carriage 23 is a position $a_0$ in FIG. 41. The carriage 23 further moves to the home position, and with the movement, the protrusion 23*a* pushes aside the second trigger 33*c* while being in contact with the slanted surface S, as shown in FIG. 40B. In turn, the clutch lever 33 gradually pivots about the rotary shaft 33*b* (see FIG. 23). An ordinate in the graph of FIG. 41 represents a pivot angle when the clutch lever 33 pivots. As seen from the graph, when the carriage 23 moves from the position $a_0$ to a position $a_4$, the clutch lever pivots over an angular range from 0 to $b_3$ degrees.

As shown in FIGS. 40B and 40C, when the protrusion 23*a* moves in contact with the slanted surface S, for example, a pivot angle of the clutch lever 33 is $b_1$ degrees when the carriage 23 is at the position $a_2$, as shown in FIG. 41. At this time, the clutch device 31 is switched from the inactive state to the active state. However, a pivot angle of the clutch lever 33 necessary for the switching of the clutch device 31 from the inactive state to the active state or the active state to the inactive state, varies depending on part accuracy or assembly accuracy. In some cases, the clutch device is switched from the inactive state to the active state at the pivot angle $b_0$ degrees, and in some cases, the clutch device 31 is switched from the inactive state to the active state at the pivot angle $b_2$ degrees. The activating position of the carriage 23 takes any of various positions such as the positions $a_1$, $a_2$, and $a_3$ depending on dimensional or assembling accuracy of the elements, and it is not definitely determined.

For this reason, in this embodiment, the activating position of the carriage 23 is found in advance, and the sheet feeding control of the second and subsequent sheets shown in FIG. 39 is performed on the assumption that the phase angle of the sheet feeding roller 3 when the carriage 23 reaches the activating position is assumed as 0 degrees. FIG. 42 is a flowchart showing an operation of finding the activating position of the carriage 23 in advance in this manner.

In the flow 300, the activating position $C_T$ is set to the position $a_0$ shown in FIG. 41 first (Step S301), then the carriage 23 is moved to the position $C_T$ (Step S302), and the sheet feeding motor 167 is driven in the forward direction (Step S303). When the clutch device 31 is in the active state in this instance, it can be judged that the load (current value) of the sheet feeding motor 167 has exceeded the predetermined value Is. However, because the position $a_0$ is not the position that should be the activating position, the occurrence of an error is judged in this case. In other words, whether the current value of the sheet feeding motor 167 has exceeded the predetermined value is judged (Step S304), and if so (YES at Step S304), the control is returned to the upper control routine due to "detection failure of the activating position" (Step S309).

In a case where the current value of the sheet feeding motor 167 has not exceeded the predetermined value (Is)

when the carriage 23 is at the position $a_0$, the sheet feeding motor 167 is suspended (Step S305), and the carriage 23 is moved to the home position side by Cs (step) (Step S306), then the sheet feeding motor 167 is rotated again (Step S308), and whether the current value of the sheet feeding motor 167 has exceeded the predetermined value (Is) is judged (Step S310).

Herein, Cs (step) is the number of steps obtained by equally dividing a distance between the position $a_0$ and $a_4$ shown in FIG. 41. In other words, the operation of judging whether the current value of the sheet feeding motor 167 has exceeded the predetermined value (Is) after the carriage 23 is moved slightly toward the home position side is repeated until the carriage 23 reaches the position $a_4$. Hence, in Step S307, whether the absolute position of the carriage 23 is closer to the home position side than the position $a_4$ ($a_0>a_4$) is judged, and in a case where the current value of the sheet feeding motor 167 will not exceed the predetermined value (Is) even when the aforementioned moving operation of the carriage 23 and the work of confirming the absence or presence of a variance in load of the sheet feeding motor 167 are repeated and the absolute position of the carriage 23 is closer to the home position side than the position $a_4$, the control is returned to the upper control routine due to "detection failure of the activating position (the occurrence of error)" (Step S309).

On the other hand, when the current value of the sheet feeding motor 167 has exceeded the predetermined value (Is) (YES at Step S310), it is judged that the clutch device 31 is switched to the active state from the inactive state. Hence, the control is returned to the upper control routine as deeming this position as the activation position of the carriage 23 (Step S311). In other words, the activating position $C_T$ is $a_0-n\cdot C_s$ (step) (Step S311).

As has been described, the absolute position (the activating position) of the carriage 23 in the main scanning direction when the clutch device 31 is switched to the active state from the inactive state (the instance the switching takes place) is found, and the sheet feeding control of the second and subsequent sheets shown in FIG. 39 is performed using this activating position as the reference position. Hence, even in a case where the clutch device 31 is switched to the active state to the inactive state while the sheet feeding motor 167 is rotating, it is possible to perform precise sheet feeding control regardless of the dimensional or assembling accuracy of the elements.

An embodiment capable of performing the phase matching effectively when the sheet feeding roller gear 35 and the spur gear 39 are engaged (assembled) will now be explained. The spur gear 39 transmits power to the sheet feeding roller 3 through the sheet feeding roller gear 35. However, in terms of the ON/OFF timing of the power transmission to the sheet feeding roller 3, the power transmission has to be turned OFF while the flat portion of the sheet feeding roller 3 shaped like a capital D when viewed from the side opposes the hopper 5 (the state of FIG. 2), and the cam 6 described with reference to FIG. 3 pushes up the follower 7, which keeps the hopper 5 to be spaced apart from the sheet feeding roller 3.

Because the spur gear 39 includes the protruded shaft 39*a* to be used as the supporting point of the pivotal movement of the clutch member 43 that turns ON and OFF the power transmission to the clutch device 31, it is necessary to match the phases of the spur gear 39 and the sheet feeding roller gear 35 when assembled (when engaged). When the phases of the sheet feeding roller gear 35 and the spur gear 39 are not matched accurately, for example, the flat portion of the sheet feeding roller 3 does not oppose the hopper 5 and the power transmission is turned OFF while the hopper 5 is not spaced apart from the sheet feeding roller 3, which makes it impossible to perform the normal sheet feeding operation thereafter.

Figure 43:
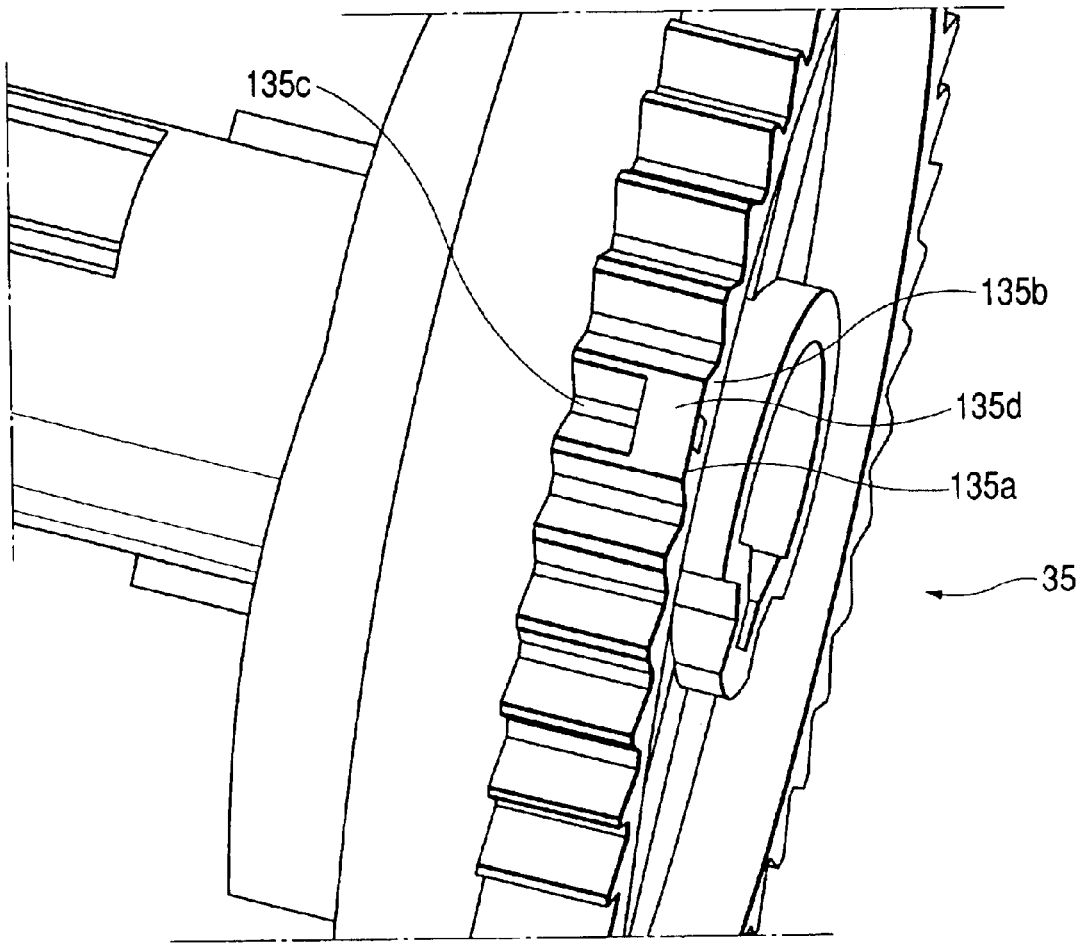
FIG. 43 is an enlarged perspective view of a modified example of the sheet feeding roller gear.
Figure 44:
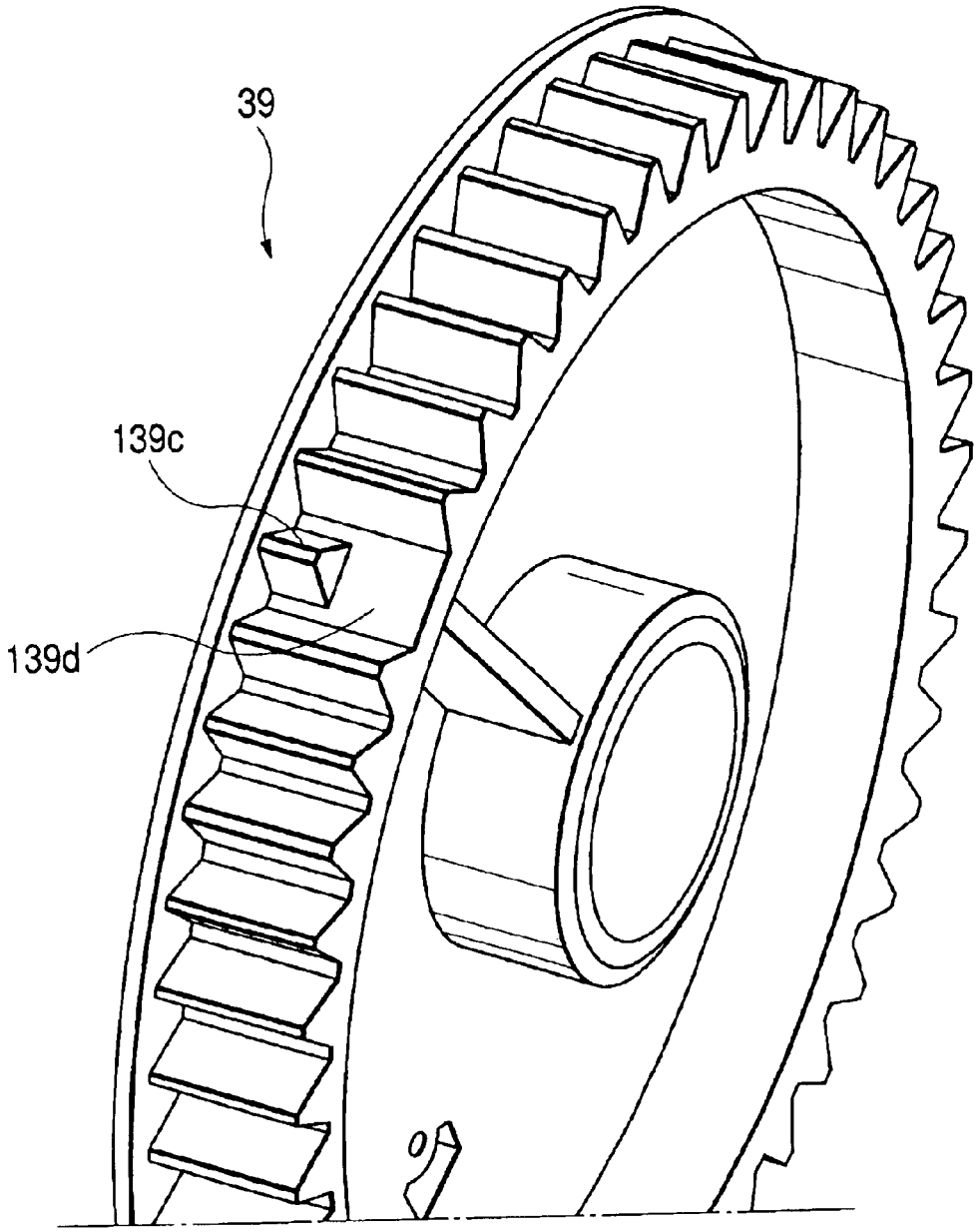
FIG. 44 is an enlarged perspective view of a modified example of a spur gear in the clutch device.
Figure 45:
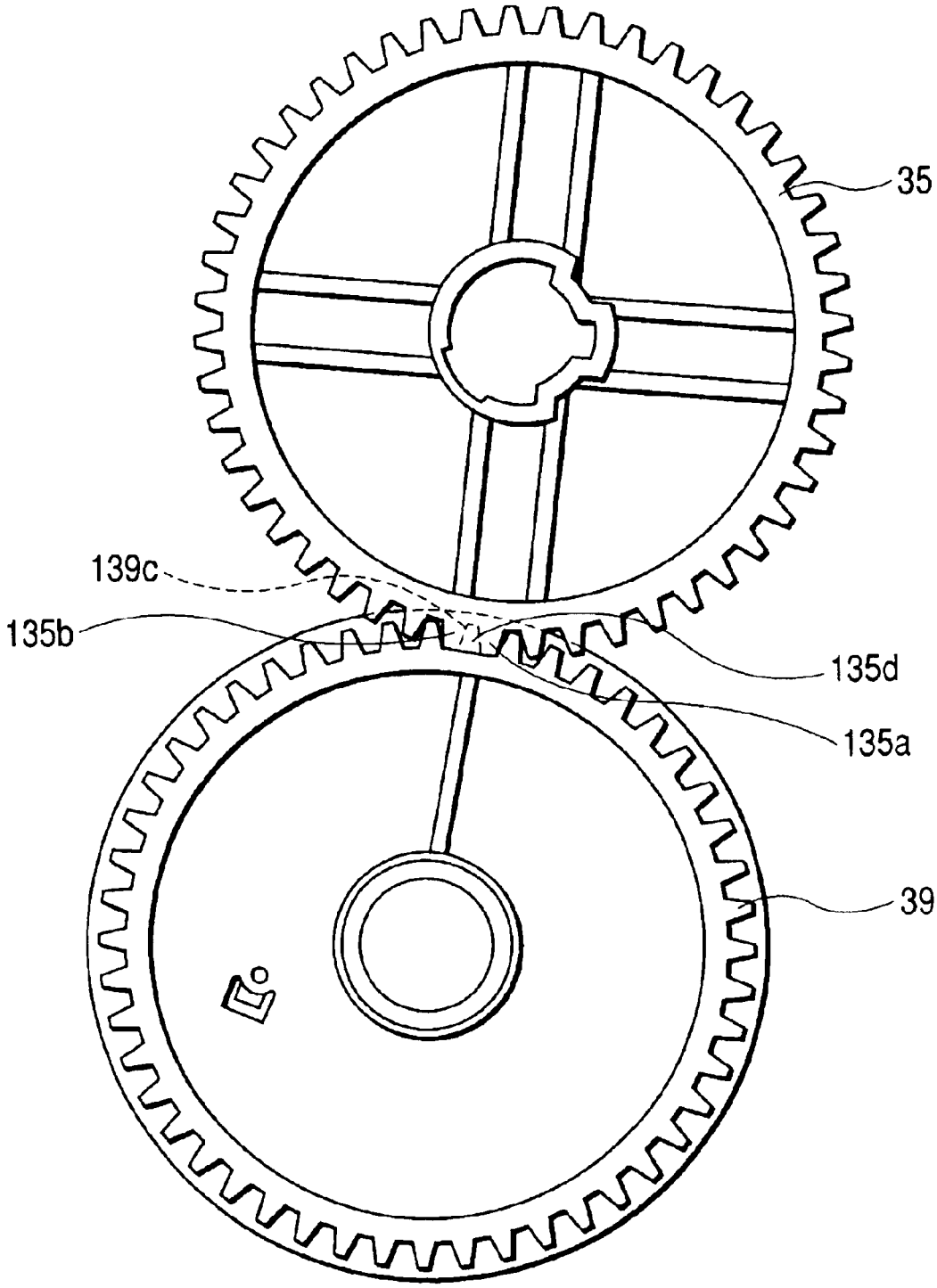
FIG. 45 is a view showing a state that the modified sheet feeding roller gear and the modified spur gear are engaged.

For this reason, in this embodiment, the sheet feeding roller gear 35 and the spur gear 39 are arranged as shown in FIG. 43 through FIG. 45, so that the phases are matched effectively when engaged (assembled). First, in regard to the sheet feeding roller gear 35, as shown in FIG. 43, a tooth groove 135*c* between a tooth 135*a* as one of a number of teeth formed on the periphery and an adjacent tooth 135*b* is partly buried in the widthwise direction thereof (the part designated by numeral 135*d*). On the other hand, in regard to the spur gear 39 that is engaged with the sheet feeding roller gear 35, as shown in FIG. 44, a width-reduced tooth 139*c* is formed in such a manner that it just fits in the tooth groove 135*c*. By allowing the sheet feeding roller gear 35 and the spur gear 39 to engage with each other at the phases such that the width-reduced tooth 139*c* of the spur gear 39 is fitted into the width-reduced tooth groove 135*c* of the sheet feeding roller gear 35 as shown in FIG. 45, it is enabled to perform normal rotational operations.

The width-reduced tooth 139*c* is used as a guide for the phase matching. The guide can be formed at the same time the spur gear 39 is molded from resin, which eliminates the need to attach an identification mark or the like separately after the spur gear 39 was molded. Consequently, not only can the guide used for the phase matching be provided at lower costs, but also there is no risk that the mark is formed at a wrong position (tooth) because the guide can be provided at the same time of the molding.

The same can be said about the sheet feeding roller 35 shown in FIG. 43. In other words, because the width-reduced tooth groove 135*c* can be provided at the same time the sheet feeding roller gear 35 is molded from resin, there is no need to attach an identification mark or the like separately after the sheet feeding roller gear 35 was molded. Consequently, not only can the guide used for the phase matching be provided at lower costs, but also there is no risk that the mark is formed at a wrong position (tooth) because the guide can be provided at the same time of the molding.

In connection with each of the width-reduced tooth 139*c* and the width-reduced tooth groove 135*c*, since a tooth or a tooth groove is kept remained, the sheet feeding roller gear 35 and the spur gear 39 maintain a uniform tooth form (teeth at regular pitches) along the circumferential direction, which eliminates an inconvenience that the gears are engaged unstably.

In addition, according to the sheet feeding roller gear 35 and the spur gear 39 formed in this manner, tools or the like for the phase matching are not needed, and the costs can be thereby saved in this regard. Furthermore, even when the phase matching is not performed accurately, because the sheet feeding roller gear 35 and the spur gear 39 have, strictly speaking, irregular portions (the width-reduced tooth groove 135*d* and the width-reduced tooth 139*d*) along the circumference direction, when the both gears are rotated after they are engaged, a lock position is caused, at which the both gears stop rotating. Thus, it is possible to detect that the phase matching is not performed accurately based on that occurrence. This in turn makes it possible to perform the phase matching accurately.

Moreover, the dimensions of the width-reduced tooth groove 135*c* and the width-reduced tooth 139*c* are preferably enlarged as much as possible to attain more stable engagement.

In this embodiment, one width-reduced tooth 139*c* and one width-reduced tooth groove 135*d* are provided. However, it goes without saying that the function and the effect described above can be achieved as well by providing two or more of each.

Further, although the width-reduced tooth 139*c* is arranged at one widthwise side of the sheet feeding roller gear 35 in this embodiment, the tooth 139*c* may be provided at the widthwise center portion of the sheet feeding roller 35. In this case, the width-reduced tooth groove 139*c* may be accordingly formed so as to receive the tooth 139*c*.

Still further, although the width-reduced tooth groove 135*c* is formed by the buried portion 135*d* in this embodiment, the buried portion 135*d* may be provided as a protrusion of the like.

Alternatively, the guide may be realized by providing a protrusion or the like on the top of one tooth of the spur gear 39, and a recess or the like on the bottom of one tooth groove of the sheet feeding motor gear 35.

What is claimed is:

1. A recording apparatus, comprising:

a recording region;

a first non-recording region, situated in one of both outer sides of the recording region in a main scanning direction of recording;

a second non-recording region, situated in the other one of the both sides of the recording region;

a power source, which provides a driving force;

a driving gear, interconnected with the power source;

a transmission gear, operable to be coupled with the driving gear to transmit the driving force to a rotatable member;

an actuator, operable to move in the main scanning direction;

a first trigger, disposed in the first non-recording region;

a second trigger, disposed in the second non-recording region; and a clutch, interconnected with the trigger so as to couple the driving gear and the transmission gear when the one of the first trigger and the second trigger is actuated by the actuator.

2. The recording apparatus as set forth in claim 1, wherein:

the rotatable member is a medium feeding roller which feeds a recording medium to the recording region;

the driving gear is a ratchet gear;

the clutch comprises a clutcher, formed with a tooth and an engagement portion, the clutcher held by the transmission gear so as to be pivotable between a first position where the tooth is engaged with the ratchet gear and a second position where the tooth is disengaged from the ratchet gear;

the transmission gear rotates with the clutcher when the clutcher is placed in the first position, so that the driving force is transmitted to the medium feeding roller; and the clutch comprises a clutch lever, operable to engage with the engagement portion of the clutcher, and to place the clutcher in the second position when the clutch lever engages with the engagement portion under a condition that the transmission gear rotates with the clutcher.

3. The recording apparatus as set forth in claim 2, further comprising a link, interconnected with the clutch lever, and extending in the main scanning direction from the first non-recording region to the second non-recording region, wherein:

the clutch lever is disposed in the second non-recording region; and at least the first trigger is provided with the link.

4. The recording apparatus as set forth in claim 3, wherein the second trigger is provided with the clutch lever.

5. The recording apparatus as set forth in claim 4, wherein:

a first end of the clutch lever is formed with a hook member;

a second end of the clutch lever is pivotably supported such that the hook member is engageable with the engagement portion of the clutcher, to thereby serves as the second trigger;

the clutch comprises an elastic member which urges the hook member toward the engagement portion of the clutcher;

the link is slidable in the main scanning direction;

the actuator actuates the first trigger such that the link is slid away from the clutch lever; and the clutch lever is pivoted when the link is slid, so that the hook member is disengaged from the engagement portion of the clutcher.

6. The recording apparatus as set forth in claim 5, wherein the hook member is formed with a tapered portion which is to be abutted against the engagement portion of the clutcher.

7. The recording apparatus as set forth in claim 5, wherein:

the medium feeding roller is provided with a cam having a cam face formed with a recess;

the recording apparatus further comprises a cam follower, operable to engage with the cam;

the clutch lever engages with the engagement portion of the clutcher when the cam follower begins to engage with the cam; and the medium feeding roller is rotated by an action that the cam follower engages with the recess, so that the transmission roller is accordingly rotated to place the clutcher in the second position.

8. The recording apparatus as set forth in claim 5, wherein:

the clutch lever is disengaged from the engagement portion of the clutcher and the ratchet gear is rotated reversely in a case where the actuator is to actuate one of the first trigger and the second trigger in connection with operation other than a paper feeding operation, so that the clutch is placed in the second position against an urging force of the elastic member.

9. A recording apparatus, comprising:

a power source, which provides a driving force;

a medium feeding roller, operable to rotate to feed a recording medium;

a transmitter, operable to transmit the driving force to the medium feeding roller;

an actuator, operable to move in a main scanning direction of recording;

a clutch, operable to be actuated by the actuator so that the transmitter transmits the driving force to the medium feeding roller; and a controller, which judges a position in the main scanning direction where the clutch is actuated by the actuator, and determines a reference position of the rotation of the medium feeding roller in accordance with the judged position.

10. The recording apparatus as set forth in claim 1, wherein the actuator is a carriage for reciprocating a recording head which performs recording with respect to the recording medium in the main scanning direction.

11. The recording apparatus as set forth in claim 9, wherein the clutch comprises an actuated member which is pivotable about an axis extending in the main scanning direction, and operable to be actuated by the actuator.

12. The recording apparatus as set forth in claim 11, wherein the actuated member is formed with a portion slanting in the main scanning direction, against which the actuator is to be abutted.

13. The recording apparatus as set forth in claim 9, further comprising:

a recording region;

a first non-recording region, situated in one of both outer sides of the recording region in a main scanning direction of recording;

a second non-recording region, situated in the other one of the both sides of the recording region; and a trigger, operable to be slid by the actuator in the main scanning direction, to actuate the clutch to cause the transmitter to transmit the driving force to the medium feeding roller, wherein the trigger is disposed in the first non-recording region and the clutch is disposed in the second non-recording region.

14. The recording apparatus as set forth in claim 9, further comprising a ratchet gear, interconnected with the power source, wherein:

the clutch comprises a clutcher, formed with a tooth and an engagement portion, the clutcher held by the transmitter so as to be pivotable between a first position where the tooth is engaged with the ratchet gear and a second position where the tooth is disengaged from the ratchet gear;

the transmitter rotates with the clutcher when the clutcher is placed in the first position, so that the driving force is transmitted to the medium feeding roller; and the clutch comprises a clutch lever, operable to engage with the engagement portion of the clutcher, and to place the clutcher in the second position when the clutch lever engages with the engagement portion under a condition that the transmitter rotates with the clutcher.

* * * * *